US011415043B2

(12) United States Patent
Thompson et al.

(10) Patent No.: US 11,415,043 B2
(45) Date of Patent: Aug. 16, 2022

(54) CHEMICAL DELIVERY RATES TO REMOVE CARBON DEPOSITS FROM THE INTERNAL COMBUSTION ENGINE

(71) Applicants: Bernie C. Thompson, Tijeras, NM (US); Neal R. Pederson, Los Alamos, NM (US); Steven G. Thoma, Albuquerque, NM (US)

(72) Inventors: Bernie C. Thompson, Tijeras, NM (US); Neal R. Pederson, Los Alamos, NM (US); Steven G. Thoma, Albuquerque, NM (US)

(73) Assignee: ATS CHEMICAL, LLC, Albuquerque, NM (US)

( * ) Notice: Subject to any disclaimer, the term of this patent is extended or adjusted under 35 U.S.C. 154(b) by 379 days.

(21) Appl. No.: 16/783,008

(22) Filed: Feb. 5, 2020

(65) Prior Publication Data

US 2020/0191050 A1 Jun. 18, 2020

Related U.S. Application Data

(63) Continuation of application No. 16/103,726, filed on Aug. 14, 2018, now Pat. No. 11,193,419, which is a continuation-in-part of application No. 15/906,075, filed on Feb. 27, 2018, which is a continuation-in-part of application No. 15/704,644, filed on Sep. 14, 2017, now abandoned, which is a continuation-in-part of application No. 15/619,223, filed on Jun. 9, 2017, now abandoned, which is a continuation-in-part of application No. 15/617,966, filed on Jun. 8, 2017, application No. 16/783,008, which is a continuation-in-part of application No. 14/843,016, filed on Sep. 2, 2015, now Pat. No. 10,669,932, which is a continuation-in-part of application No. 14/584,684, filed on Dec. 29, 2014.

(60) Provisional application No. 62/471,817, filed on Mar. 15, 2017, provisional application No. 62/458,414, filed on Feb. 13, 2017, provisional application No. 62/348,593, filed on Jun. 10, 2016, provisional application No. 62/061,326, filed on Oct. 8, 2014.

(51) Int. Cl.

| | |
|---|---|
| ***F02B 77/04*** | (2006.01) |
| ***F02M 35/10*** | (2006.01) |
| ***F02D 19/12*** | (2006.01) |

(52) U.S. Cl.

CPC ..... *F02B 77/04* (2013.01); *F02D 19/12* (2013.01); *F02M 35/10209* (2013.01)

(58) Field of Classification Search

None

See application file for complete search history.

(56) References Cited

U.S. PATENT DOCUMENTS

2004/0103920 A1* 6/2004 Gatzke ..... F02B 77/04 134/123

2008/0060680 A1* 3/2008 Esterline ..... B08B 9/00 134/184

* cited by examiner

*Primary Examiner* — Nicole Blan

(74) *Attorney, Agent, or Firm* — DeWitt M. Morgan

(57) ABSTRACT

The present invention relates to the carbon deposit buildup in the internal combustion engine, or more specifically the removal of such carbon from the induction system, combustion chamber, and the exhaust system. The method is one in which a high volumetric flow rate of chemical/chemical mixes are used to remove a greater amount of carbon from the engine. These preferred chemical/chemical mix flow rates are 6 to 9 Gallons per hour, which is approximately 9 times the volumetric flow rate of the industry standard of 1 gallon per hour.

11 Claims, 32 Drawing Sheets

Audi Turbocharged Direct Injected

Honda Port Injected Carbon

| | | Wynn's 61510 valve injector cleaner | Wynn's 60802 air intake cleaner | Wynn's 66201 power charge fuel treatment | Wynn's A6407 decarbon foam | BG 206 air intake system cleaner | BG 208 44K | BG 210 fuel injection cleaner | BG 211 injection system cleaner | Chevron Techron 65714 Complete fuel system cleaner | 3M 8813 fuel system cleaner | 3M 8954 DIY-Intake System Cleaner | NGEN 71434 | Sea Foam SF-16 Motor treatment |
|---|---|---|---|---|---|---|---|---|---|---|---|---|---|---|
| chemical | CAS# | | | | | | | | | | | | | |
| Xylene (mixed) | 1330-20-7 | X | X | | | 10-20 | | 10-30 | 15-40 | | | | | |
| Ethylbenzene | 100-41-4 | X | X | | | | | 1-5 | 1-5 | | | | | |
| Naphtha Light hydrotreated (C9-C16) | 64742-47-8 | X | X | X | | | | | 1-5 | 40-70 | | | 30-50 | |
| naphtha light hydrotreated (C4-C11) | 64742-49-0 | | | | | | | | | | | | | 25-35 |
| solvent naphtha light (C8-C10 aromatic) | 64742-95-6 | | | X | | | | | | 5-10 | | | | |
| Solvent naphtha heavy (C9-C16 aromatic) | 64742-94-5 | | | | | | | | | | 0.5-1.5 | 1-10 | <3.1 | |
| Solvent naphtha light (C5-C10 saturated ) | 64742-89-8 | X | | | | | | | | | | | | |
| Petroleum distillate (C20-C50 paraffinic) | 64742-54-7 | | | | | | 15-40 | | | | | | | 40-60 |
| Petroleum distillate "Ligroin" | 8032-32-4 | | | | | | | | 1-5 | | | | | |
| Petroleum distillate "Stoddard solvent" | 8052-41-3 | | | X | | | | | | 15-40 | | | | |
| Crude distillate (C9-C16) | 8008-20-6 | | | | | | 15-40 | | | | 60-100 | | | |
| Petroleum distillate Middle sweet (C9-C20) | 64741-86-2 | | | | | 40-70 "Trade Secret" | | | | | 10-30 | | 25-32 | |
| 1-methylanphthalene | 90-12-0 | | | | | | | | | | | 0.1-1 | <0.4 | |
| 2-methylanphthalene | 91-57-6 | | | | | | | | | | | 1-5 | <0.8 | |
| naphthalene | 91-20-3 | | | | | | | | | | <0.5 | 1-5 | <1 | |
| 1,2,4-trimethylbezene | 95-63-6 | | | X | 3-7 | | | | | 1-5 | | | | |
| 1,3,5-trimethylbezene | 108-67-8 | | | X | | | | | | | | | | |
| trimethylbenzenes | 25551-13-7 | | | | 1-5 | | | | | | | | | |

X indicates that the MSDS states that the compound is present yet did not provide the amount

FIGURE 3A

| | | | | | | | | | | | | | | |
|---|---|---|---|---|---|---|---|---|---|---|---|---|---|---|
| acetone | 67-64-1 | | X | | | 7-13 | | | | | | | | |
| Methyl acetate | 79-20-9 | | X | | | | | | | | | | | |
| isobutane | 75-28-5 | | | | | | | | | | | | | |
| di-tert-butyl peroxide (DTBP) | 110-05-4 | | | X | | | | | | | | | | |
| 2-butoxyethanol | 111-76-2 | | | | 5-10 | | | | | | | | | |
| isopropanol | 67-63-0 | X | | | | 7-13 | | 1-5 | | | | 25-45 | | 10-20 |
| Propoxylated alcohol | Trade secret | | | | | | | | | | 1-5 | | | |
| 1-methyl-2-pyrrolidone | 872-50-4 | | | | | 10-30 | | | 30-60 | | | | | |
| water | 7732-18-5 | | | | | | | | | | | 5-15 | | |
| Glycol ether | 770-35-4 | | X | | | | | | | | | | | |
| Polyether amine | 39423-51-3 | | | | | | | | | | 5-15 | | 19-25 | |
| Ammonium hydroxide | 1336-21-6 | | | | | | | 1-5 | | | | | | |
| Oleic acid | 112-80-1 | | | | | | | | | | | 5-15 | | |
| Triethanolamine | 102-71-6 | | | | | | | | | | | 1-5 | | |
| Tripropylene glycol methyl ether | 25498-49-1 | | | | | | | | | | | 1-5 | | |
| Petroleum distillate C3-C7 "propellant" | 68476-86-8 | | | | | | | | | | | 25-45 | | |

X indicates that the MSDS states that the compound is present yet did not provide the amount

FIGURE 3B

| | | Run Rite 7012 Zoom | Run Rite 1001 fuel system cleaner | Run Rite 1003 diesel induction cleaner | AC Delco X66P upper engine &FIC | Gumout 510059 fuel tank additive | Gumout 510060 regane fuel tank additive | Lucas deep clean fuel system cleaner | Berryman B12 carb & choke cleaner | CRC 5312 top engine cleaner | CRC 5319 GDI IVD intake valve | Justice Brothers AIC/3P air intake cleaner | Justice Brothers VC/21P intake valve cleaner |
|---|---|---|---|---|---|---|---|---|---|---|---|---|---|
| chemical | CAS# | | | | | | | | | | | | |
| Naphtha Light hydrotreated (C9-C16) | 64742-47-8 | | | | | 60-100 | | | | | | | |
| Petroleum distillate Hydrotreated heavy napthenic (C20-C50) | 64742-52-5 | | | | | | | | | 50-60 | | | |
| solvent naphtha medium (C9-C12 saturated) | 64742-88-7 | X | X | X | | | | 30-60 | | | | | |
| solvent naphtha light (C8-C10 aromatic) | 64742-95-6 | | | | | | | | | | | | X |
| Solvent naphtha heavy (C9-C16 aromatic) | 64742-94-5 | | | | | 1-5 | | | | 1-3 | 1-3 | | |
| Petroleum distillate (C20-C50 paraffinic) | 64742-65-0 | X | X | X | | | | | | | | | |
| Petroleum distillate "Stoddard solvent" | 8052-41-3 | | | | | | | | | | | | X |
| Crude distillate (C9-C16) | 8008-20-6 | | | | | | 60-70 | | | | | | |
| Petroleum distillate Middle sweet (C9-C20) | 64741-86-2 | | | | | 1-5 | | | | | 20-30 | | |
| Liquefied petroleum gas | 68476-86-8 | | | | | | | | | 20-30 | 30-40 | | |
| Diesel fuel no.2 | 68476-34-6 | | | | | | | | | | 20-30 | | |

X indicates that the MSDS states that the compound is present yet did not provide the amount

FIGURE 4A

| | | | | | | | | | | | | | |
|---|---|---|---|---|---|---|---|---|---|---|---|---|---|
| 2-methylanphthalene | 91-57-6 | | | | | | | | | 1-3 | | | |
| naphthalene | 91-20-3 | | | | | 0.1-1 | | | | | <0.2 | | |
| 1,2,4-trimethylbezene | 95-63-6 | | | | | 0.1-1 | | | | | | | X |
| 1,3,5-trimethylbezene | 108-67-8 | | | | | | | | | | | | X |
| acetone | 67-64-1 | | | | | | | | 85-90 | | | | |
| Toluene | 108-88-3 | | | | | | | | <10 | | | | |
| Diacetone alcohol | 123-42-2 | | | | | | | | | 3-5 | | | |
| 2-butoxyethanol | 111-76-2 | | | | | | | | <10 | 5-10 | | | |
| Methyl alcohol | 67-56-1 | | | | | | | | | | | X | |
| 2-butanone | 78-93-3 | | | | | | | | | | | X | |
| Propylene glycol methyl ether | 107-98-2 | | | | | | | | | | | X | |
| Glycol ether | 770-35-4 | | | | 60 "trade secret" | | | | | | | | |
| "aryl alcohol" (aromatic alchol) | | | | | 20 "trade secret" | | | | | | | | |
| Polyether amine | 39423-51-3 | | | | | | 30-40 | 10-30 | | | | | |
| Sorbitan monooleate | 68910-94-1 | | | | | | | | | 1-3 | | | |
| Sorbitan oleate | 1338-43-8 | | | | | | | | | 1-3 | | | |
| Dioctyl sodium sulfosuccinate | 577-11-7 | | | | | | | | | 1-3 | | | |

X indicates that the MSDS states that the compound is present yet did not provide the amount

FIGURE 4B

| Chemical manufacture | Product name | Induction | Fuel Tank | Part# | % of carbon removed |
|---|---|---|---|---|---|
| Wynn's | V.I.C | Yes | | 61510W | 30% |
| Wynn's | Air Intake Cleaner | Yes | | A6601W | 26% |
| Wynn's | Decarbon Foam | Yes | | A6407W | 44% |
| B.G. Products | Intake System Cleaner | Yes | | 206 | 17% |
| B.G. Products | Fuel Injection System Cleaner | Yes | | 210 | 4% |
| B.G. Products | Induction System Cleaner | Yes | | 211 | 15% |
| Run-Rite | Fuel System Cleaner | Yes | | 1001 | 42% |
| Run-Rite | Intake Cleaner | Yes | | 1003 | 59% |
| AC Delco | Upper engine cleaner | Yes | | X66P | 15% |
| Sea Foam | Motor Treatment | Yes | | SF16 | 33% |
| Berryman | B-12 Fuel system Cleaner | Yes | | 116 | 25% |
| CRC | GDI IVD intake valve cleaner | Yes | | 5319 | 65% |
| CRC | top engine cleaner | Yes | | 5312 | 31% |
| 3M | Intake System Cleaner | Yes | | 8954 | 11% |
| Justice Brothers | Air Intake Cleaner | Yes | | AIC/3 | 7% |
| 100% Gasoline | Chevron | | Yes | Regular | 24% |
| NGEN + Gasoline | Liquid Fog | | Yes | 71434 | 35% |
| GUMOUT + Gasoline | Expert Fuel Tank Additive Regane | | Yes | 510060 | 33% |
| GUMOUT + Gasoline | Expert Fuel Tank Additive Fuel system | | Yes | 510059 | 22% |
| Wynn's + Gasoline | Power Charge | | Yes | Brand Name | 24% |
| BG + Gasoline | K44 | | Yes | 208 | 37% |
| Lucas + Gasoline | Fuel System Cleaner | | Yes | 10020 or 1003 | 38% |
| Run-Rite + Gasoline | ZOOM | | Yes | 7012 | 33% |
| 3M + Gasoline | Complete Fuel System Cleaner | | Yes | 8813 | 38% |
| Techron + gasoline | Complete Fuel System Cleaner | | yes | 65714 | 29% |
| Justice Brothers | Fuel injector Cleaner | | Yes | FIC/1 | 37% |
| Justice Brothers | Intake valve cleaner | | yes | VC/21P | 30% |
| All carbon deposit samples are from the same Audi Gasoline Direct Injected Turbocharged engine | | | | | |

FIGURE 5A

| Chemical manufacture | Product nume | Induction | Fuel Tank | Part# | % of carbon removed |
|---|---|---|---|---|---|
| ATS- 505CR | Proprietary Mix | Yes | | 505CR | 95% |
| ATS-Test | Xylenes | Yes | | X 100 | 65% |
| ATS-Test | Light Hydrotreated Naptha (LHN) | Yes | | N 100 | 61% |
| ATS-Test | Dipentene | Yes | | DIP 100 | 60% |
| ATS-Test | Tetrahydronaphthalene | Yes | | THN 100 | 75% |
| ATS-Test | Decahydronaphthalene | Yes | | DHN 100 | 67% |
| ATS-Test | Tributylamine | Yes | | TBL 100 | 63% |
| ATS-Test | Octane | Yes | | OCT 100 | 19% |
| ATS-Test | Bromobenzene | Yes | | BB 100 | 35% |
| ATS-Test | Propylbenzene | Yes | | PB 100 | 29% |
| ATS-Test | Cyclohexane | Yes | | CH 100 | 33% |
| All carbon deposit samples are from the same Audi Gasoline Direct Injected Turbocharged engine | | | | | |

FIGURE 5B

NMP & PEA Testing

| Carbon Type | BMW GDI | Audi GDI | Toyota PI | Ford PI | GM PI | Avg. |
|---|---|---|---|---|---|---|
| Chemical | | | | | | |
| 50% XYL 50% KLO | 52% | 35% | 54% | 71% | 78% | 58% |
| 50% XYL 50% KLO 5% NMP | 34% | 17% | 28% | 39% | 19% | 27% |
| 50% XYL 50% KLO 5% PEA | 40% | 26% | 28% | 34% | 16% | 29% |

FIGURE 6

Chemical Testing of WYNNS Products and ATS 505CR

| Carbon Type | Audi GDI | Mini GDI | BMW GDI | Toyota GPI | GM GPI New | GM GPI Old | |
|---|---|---|---|---|---|---|---|
| Mixes | | | | | | | Average carbon removed |
| WYNNS VIC | 31% | 45% | 29% | 25% | 31% | 39% | 33% |
| WYNNS AIC | 23% | 38% | 24% | 35% | 24% | 50% | 32% |
| WYNNS CS | 16% | 15% | 18% | 40% | 30% | 51% | 28% |
| WYNNS NEW FOAM | 21% | 19% | 28% | 32% | 15% | 43% | 26% |
| **ATS 505CR** | **87%** | **65%** | **40%** | **46%** | **35%** | **90%** | **60%** |

FIGURE 7

Carbon Testing New GDI Formulas

| Mix<br>Carbon Type | ATS 505CR<br>A & B | RunRite GDI | CRC GDI | WYNNS GDI | B.G. GDI |
|---|---|---|---|---|---|
| BMW GDI 178,000 Soft | 42% | 22% | 10% | 19% | 14% |
| BMW GDI 65,000 Soft | 56% | 26% | 31% | 21% | 27% |
| GM GDI Soft oily | 65% | 22% | 20% | 40% | 15% |
| Mini GDI soft | 82% | 56% | 39% | 32% | 24% |
| Audi Q7 GDI Soft | 84% | 52% | 48% | 25% | 23% |
| Ford GPI Hard | 86% | 52% | 69% | 46% | 34% |
| Subaru GPI Hard | 74% | 29% | 54% | 27% | 24% |
| Isuzu GPI Soft Very dense | 56% | 17% | 9% | 29% | 13% |
| Toyota GPI Hard | 83% | 48% | 41% | 39% | 46% |
| Lexus GPI Hard | 74% | 35% | 22% | 29% | 37% |
| BMW M57 DDI soft oily | 90% | 51% | 36% | 52% | 38% |
| Chevy Duramax DDI soft oily | 81% | 72% | 46% | 51% | 54% |
| | | | | | |
| Average of all carbons | 73% | 40% | 34% | 34% | 29% |

FIGURE 8

Chemical Testing 505DCR

| Chemical | 505CR A – 505CR B | 505DCR |
|---|---|---|
| **Carbon type** | | |
| BMW GDI | 25% | 45% |
| Mini GDI | 55% | 55% |
| Audi GDI | 31% | 24% |
| Ford GPI | 73% | 73% |
| GM GPI | 71% | 76% |
| Ford DDI | 81% | 84% |
| GM DDI | 75% | 92% |
| BMW DDI | 60% | 58% |
| MB DDI | 80% | 73% |
| VW DDI | 52% | 73% |
| **Average % Removed** | **60%** | **65%** |

FIGURE 9

| Chemical | Carbon Type | Carbon Type | Carbon Type | Carbon Type | Carbon Type | Percent removed |
|---|---|---|---|---|---|---|
| | BMW | Mini | Audi | Ford | GM | |
| **THN** | **17%** | **26%** | **52%** | **67%** | **34%** | **39%** |
| THN 5% EHN | 25% | 40% | 37% | 78% | 53% | 47% |
| THN 5% TBP | 34% | 56% | 42% | 65% | 60% | 51% |
| THN 5% OCT | 29% | 52% | 28% | 46% | 67% | 44% |
| THN 5% NP | 25% | 59% | 45% | 67% | 65% | 52% |
| THN 5% ISN | 27% | 56% | 53% | 57% | 65% | 52% |
| THN 5% DTBP | 30% | 58% | 91% | 76% | 61% | 63% |
| THN 5% DTAP | 28% | 47% | 89% | 52% | 45% | 52% |
| THN 5% TMP | 25% | 59% | 91% | 65% | 71% | 62% |
| THN 5% DEM | 15% | 69% | 76% | 40% | 56% | 51% |
| THN 5% TAME | 32% | 50% | 42% | 66% | 64% | 51% |
| THN 5% TBPB | 22% | 39% | 29% | 47% | 57% | 39% |

FIGURE 10

Gasoline Mixtures 10%

| Gas – Chemical mixtures | | Carbon type |
|---|---|---|
| | | GM Port injection (All) |
| GAS 100% | Chevron | 27% Removed |
| Gas 90% | 2-EHN 10% | 56% Removed |
| Gas 90% | NP 10% | 45% Removed |
| Gas 90% | ISN 10% | 56% Removed |
| Gas 90% | TBP 10% | 41% Removed |
| Gas 90% | DTBP 10% | 35% Removed |
| Gas 90% | THN 10% | 44% Removed |
| Gas 90% | DIP 10% | 33% Removed |
| Gas 90% | OCT 10% | 30% Removed |
| Gas 90% | DHN 10% | 27% Removed |
| Gas 90% | DTAP 10% | 77% Removed |
| Gas 90% | DTPB 10% | 58% Removed |

FIGURE 23

Gasoline with 2% Chemical mixtures

| Carbon type | BMW GDI | Mini GDI | Audi GDI | Ford GPI | GM GPI | AVG. % |
|---|---|---|---|---|---|---|
| Chemicals | | | | | | |
| Gasoline 100% | 30% | 43% | 29% | 46% | 24% | 34% |
| Gasoline 98% Gumout 2% | 21% | 31% | 34% | 45% | 27% | 32% |
| Gasoline 98% EHN 2% | 28% | 29% | 34% | 56% | 43% | 38% |
| Gasoline 98% TBP 2% | 24% | 40% | 39% | 50% | 44% | 39% |
| Gasoline 98% DTBP 2% | 20% | 30% | 41% | 65% | 48% | 41% |
| Gasoline 98% DTAP 2% | 23% | 40% | 34% | 37% | 60% | 39% |
| Gasoline 98% TBPB 2% | 24% | 49% | 41% | 50% | 45% | 42% |
| Gasoline 98% NP 2% | 28% | 29% | 30% | 53% | 50% | 38% |
| Gasoline 98% IPN 2% | 16% | 45% | 32% | 49% | 35% | 35% |

3X Volume test Gasoline with 2% Chemical mixtures

| Carbon type | Audi GDI | % Difference from gasoline | GM GPI | % Difference from gasoline |
|---|---|---|---|---|
| Chemicals | | | | |
| Gasoline 100% | 50% | 0% | 61% | 0% |
| Gasoline 98% GUMOUT 2% | 53% | 3% | 62% | 1% |
| Gasoline 98% AT5 (3) 2% | 65% | 15% | 76% | 15% |

FIGURE 24

High Temperature Gasoline

| Carbon type | BMW GDI | Mini GDI | Audi GDI | Ford GPI | GM GPI | AVG. % |
|---|---|---|---|---|---|---|
| | | | | | | |
| **505A – 505B** | **28%** | **61%** | **94%** | **73%** | **71%** | **65%** |
| | | | | | | |
| 100% Pump Gas 88 octane | 30% | 43% | 29% | 46% | 24% | 34% |
| | | | | | | |
| HTG Blend | | | | | | |
| 1) High Temp Gas | 31% | 59% | 75% | 63% | 50% | 56% |
| 2)High Temp Gas | 24% | 57% | 73% | 51% | 40% | 49% |
| 3) High Temp Gas | 18% | 39% | 62% | 47% | 26% | 38% |
| 4) High Temp Gas | 25% | 55% | 93% | 65% | 50% | 58% |
| 5) High Temp Gas | 20% | 35% | 40% | 76% | 53% | 45% |
| 6) High Temp Gas | 26% | 46% | 43% | 62% | 61% | 47% |

Based on "Fuel Properties"

| constituent type | 3 part n-alkanes | 6 parts iso-alkanes | 3 part Cyclo-alkanes | 1 part alkenes | 2.5 parts alkylbenzenes |
|---|---|---|---|---|---|
| constituent | Octane or decane | Iso-octane | cyclohexane | dipentene | xylene |
| Presented as a ratio out of 100 | 19 | 39 | 19 | 6 | 16 |
| Boiling point (C/F) | 125/**257** | 99/**210** | 81/**177** | 176/**349** | 139/**281** |

FIGURE 25

Turpentine testing

| Carbon Types / Chemicals | BMW GDI | MINI GDI | VW GDI | Nissan GPI | Ford GPI | Isuzu GPI |
|---|---|---|---|---|---|---|
| THN | 37% | 41% | 26% | 44% | 58% | 80% |
| p-cymene (p-C) | 54% | 52% | 40% | 56% | 45% | 77% |
| terpinolene | 24% | 41% | 33% | 53% | 53% | 90% |
| γ-terpinene (γ-T) | 69% | 48% | 41% | 44% | 58% | 83% |
| turpentine (TPT) | 47% | 35% | 36% | 48% | 49% | 74% |

FIGURE 26

Turpentine Blends testing

| Chemical Mix / Carbon type / Injection type | BMW GDI | MINI GDI | Audi GDI | Nissan GPI | Ford GDI | Isuzu GPI |
|---|---|---|---|---|---|---|
| 50 y-T 50 p-C | 37% | 57% | 47% | 50% | 68% | 78% |
| 50 p-C 50 TPT | 46% | 42% | 41% | 67% | 72% | 94% |
| 50 TPT 25 y-T 25 p-C | 62% | 43% | 38% | 67% | 40% | 84% |
| 30 TPT 30 LHN 20 y-T 20 p-C | 60% | 41% | 24% | 49% | 63% | 62% |
| 30 TPT 30 ISO 20 y-T 20 p-C | 67% | 41% | 35% | 61% | 59% | 88% |
| 30 TPT 30 DIP 20 y-T 20 p-C | 52% | 30% | 49% | 68% | 65% | 88% |
| 30 TPT 30 TMB 20 y-T 20 p-C | 57% | 36% | 34% | 55% | 67% | 77% |
| 30 TPT 30 DOD 20 y-T 20 p-C | 60% | 44% | 44% | 61% | 61% | 78% |
| 30 TPT 30 DEC 20 y-T 20 p-C | 49% | 49% | 55% | 61% | 55% | 87% |
| 30 TPT 30 OCT 20 y-T 20 p-C | 42% | 40% | 28% | 60% | 55% | 71% |
| 30 TPT 30 Cetane 20 y-T 20 p-C | 50% | 41% | 41% | 68% | 61% | 78% |
| 30 TPT 30 Heptane 20 y-T 20 p-C | 56% | 36% | 41% | 53% | 58% | 77% |
| 30 TPT 30 XYL 20 y-T 20 p-C | 48% | 38% | 44% | 79% | 49% | 88% |
| 30 TPT 30 DEM 20 y-T 20 p-C | 41% | 41% | 29% | 44% | 46% | 76% |
| 30 TPT 30 cumene 20 y-T 20 p-C | 43% | 37% | 42% | 61% | 57% | 65% |
| 30 TPT 30 n-nonane 20 y-T 20 p-C | 49% | 54% | 37% | 44% | 65% | 80% |
| 30 TPT 30 PA 20 y-T 20 p-C | 48% | 43% | 39% | 52% | 59% | 60% |
| 30 TPT 30 DOD 15 y-T 15 p-C 10 EHN | 60% | 40% | 44% | 54% | 51% | 93% |
| 30 TPT 30 DOD 15 y-T 15 p-C 10 DTBP | 67% | 41% | 40% | 73% | 53% | 85% |
| 30 TPT 30 ISO 15 y-T 15 p-C 10 TBP | 62% | 47% | 31% | 58% | 63% | 86% |
| **30 TPT 30 DOD 15 y-T 15 p-C 10 TBP** | **70%** | **51%** | **44%** | **69%** | **68%** | **89%** |

FIGURE 27

Viscosity Laboratory Analyses

| Viscosity Test | Index D2270 | cST @ 100C | cST@ 40C | PQ Index | Solids (%) | Good |
|---|---|---|---|---|---|---|
| **Chemical** | | | | | | |
| 30W Motor Oil "Control" | 109 | 9.9 | 76.6 | <10 | <0.1 | yes |
| 30W Motor Oil 10% TPT | 137 | 7.6 | 45.1 | <10 | <0.1 | yes |
| 30W Motor Oil 10% yT | 174 | 7.4 | 36.6 | <10 | <0.1 | yes |
| 30W Motor Oil 10% cP | 141 | 6.4 | 34.2 | <10 | <0.1 | yes |
| 30W Motor Oil 10% DOD | 149 | 7.4 | 40.9 | <10 | <0.1 | yes |
| 30W Motor Oil 10% TMP | 131 | 6.4 | 36.2 | <10 | <0.1 | yes |
| 30W Motor Oil 10% THN | 120 | 6.5 | 38.9 | <10 | <0.1 | yes |
| 30W Motor Oil 10% TPT mix | 120 | 6.4 | 38.1 | <10 | <0.1 | yes |
| 30W Motor Oil 10% THN mix | 121 | 6.2 | 36.0 | <10 | <0.1 | yes |

FIGURE 28

Four Ball Wear Test

| Wear | X Scar | Y Scar | Average Scar |
|---|---|---|---|
| **Chemical** | | | |
| Base 30W motor oil "Control" | 0.65 mm | 0.65 mm | 0.65 mm |
| Base 30W motor oil with 10% TPT | 0.54 mm | 0.53 mm | 0.56 mm |
| Base 30W motor oil with 10% yT | 0.67 mm | 0.67 mm | 0.67 mm |
| Base 30W motor oil with 10% TPT mix | 0.50 mm | 0.49 mm | 0.51 mm |
| Base 30W motor oil with 10% THN mix | 0.53 mm | 0.54 mm | 0.53 mm |

Parameters for all testing; RPM @ 1200, Temperature @ 104.4C, Load @ 40 Kg, Thrust W Bear HAS

FIGURE 29

CHEMICAL DELIVERY RATES TO REMOVE CARBON DEPOSITS FROM THE INTERNAL COMBUSTION ENGINE

This application is a continuation of and claims the priority of application Ser. No. 16/103,726, filed Aug. 14, 2018, which is a continuation-in-part of and claims the priority of: application Ser. No. 15/906,075, filed Feb. 27, 2018; application Ser. No. 15/704,644, filed Sep. 14, 2017; application Ser. No. 15/619,223, filed Jun. 9, 2017; application Ser. No. 15/617,966, filed Jun. 8, 2017; application Ser. No. 62/348,593, filed Jun. 10, 2016; application Ser. No. 62/458,414, filed Feb. 13, 2017; and application Ser. No. 62/471,817, filed Mar. 15, 2017.

This application incorporates by reference the entirety of the following applications: Ser. No. 14/843,016 (herein the "'016 application") filed Sep. 2, 2015 for "Dual Chemical Induction Cleaning Method and Apparatus for Chemical Delivery"; Ser. No. 14/584,684 (the "'684 application") filed Dec. 29, 2014 also for "Dual Chemical Induction Cleaning Method and Apparatus for Chemical Delivery"; and Ser. No. 62/061,326 (the "'326 application") filed Oct. 8, 2014. The '016 application is a continuation-in-part of application the '684 application which, in turn, is a continuation-in-part of the '326 application. The priority dates of these applications are also claimed. All these applications are commonly owned. As the '016 application includes all of the disclosure of the '684 application, reference to just the '016 application is intended as a reference for both. The '016 application was published on Apr. 14, 2016 under Pub. No.: US 2016/0102606 A1 (the "'606 A1 Pub.").

FIELD OF INVENTION

This invention relates to cleaning the induction system, the combustion chambers and exhaust system of an internal combustion engine. And, more particularly, the use of high volumetric flow rates of chemicals and mixtures of chemicals for removing a greater amount of carbon deposit from the engine than could be achieved with prior art chemical cleaning procedures. It has been determined through extensive testing that the more chemical that can be delivered into the running engine the more carbon can be removed. This is in part due to having more chemical available to solubilize into the carbon. The more liquid chemical that is delivered the greater the amount of carbon that can be dissolved into the liquid and, thus, a greater carbon removal rate. These high chemical flow rates help remove the many different types of carbon deposits encountered in internal combustion engines used in "road vehicles". "Road vehicle" or "road vehicles" refers to vehicles that have been driven in cities and on highways under a variety of conditions, including different speeds, acceleration patterns, different fuels, different motor oils, and different weather conditions, thus producing different types of carbon within them. Carbon deposits were taken from the induction systems of these road vehicles for the purpose of bench testing such carbon and product development. More specifically, chemicals (i.e., solvents) and chemical mixes (i.e., solutions) have been accurately tested on such harvested carbon deposits for their ability to remove the various types of carbon deposits that accumulate within road vehicle internal combustion engines. It was determined that certain chemicals and chemical mixtures work to remove certain types of carbon deposits. It has also been determined which of these chemicals and chemical mixtures will work well across different carbon types encountered in road vehicle engines. A preferred embodiment uses a mixture of chemicals that can remove different carbon types from induction systems, combustion chambers and exhaust systems. This invention also relates to apparatus for delivering chemicals and chemical mixes (e.g., those developed as discussed below, prior art products marketed for carbon removal) to the induction system of a vehicle to maximize the effectiveness of delivery and carbon removal.

BACKGROUND OF THE INVENTION

It has long been known that carbon deposits accumulate within internal combustion engines. Such carbon deposits have been unwanted since their discovery over one hundred years ago, and how to remove them from engines continues to be a problem today. Obviously, an engine can be disassembled and manually cleaned, but this method is time consuming and expensive. The alternative is to chemically treat various parts of engines (e.g., induction system, combustion chambers, and exhaust system) with various solutions in order to attempt to remove the carbon deposits.

For many years various chemicals have been used to try to accomplish the removal of carbon deposits. U.S. Pat. No. 2,904,458 to Dykstra et al. discloses a mixture that uses: (1) benzenes, alkyl benzes and "the like" for removal of "oily residue"; (2) various monoalkyl glycol ethers to remove the "gum-like" material; (3) monoamines to remove the lead containing portion of the deposit; and (4) low-volatility chlorinated benzenes as an "evaporation deterrent". See, for instance, col. 2, II. 14-25. As to point (3), Dykstra et al. recognized that lead had an effect on the character of the cylinder deposits. (As is evident from col. 3, I 65-col. 4, I 12, this mixture was developed for removal of deposits in combustion chambers, not induction systems.) While an accurate observation when the application was filed in 1954, modern fuels do not contain lead. Additionally, chlorinated solvents are now not generally in use for environmental and safety reasons.

In addition to dealing with leaded fuels which have long been discontinued, Dykstra et al. was working with carbureted engines which were phased out in vehicles in the 1990's within the United States. Today, fuel is delivered to engines by gasoline port injection ("GPI"), where gasoline is injected in to the induction port and ignited with a spark plug and, more recently, gasoline direct injection ("GDI") where gasoline is injected directly in to the combustion chamber and ignited with a spark plug. Diesel engines utilize diesel direct injection ("DDI") where diesel fuel is injected directly into the combustion chamber and ignited by the heat from the compression within the cylinder. In GPI engines, the fuel is injected into the intake manifold and enters the cylinders through the associated intake ports. In contrast, in GDI and DDI engines highly pressurized fuel is directly injected into the cylinders (thereby by passing the intake ports).

Aside from the through the spark plug hole delivery method disclosed in Dykstra, et al., there are two basic mechanisms for delivering, or at least attempting to deliver, various chemical mixtures (solutions) to various engine components (e.g., combustion chambers) for the purpose of removing/attempting to remove carbon deposits, namely: (1) apparatus for injecting such solutions into engine induction systems; and (2) fuel additives. This second category is, in turn, divided into: (a) chemicals that are mixed into gasoline and diesel fuel by the fuel manufacturer; and (b) fuel additives that are added to vehicle fuel tanks separately from the fuel. Chevron gasoline with Techron® is an example of a gasoline/carbon removing chemicals combination. Techron® Complete Fuel System Cleaner is an example of a fuel tank additive. And with regard to the first category, U.S. Pat. No. 6,530,392 to Blatter et al. discloses apparatus for injecting chemical solvents into induction systems.

In addition to commercial products, such as listed in FIG. 5A and discussed in connection with the Description of the Preferred Embodiment, Applicants are aware of the following prior art. (Note, while the products listed in FIG. 5A are commercially available, the test data (i.e., "% carbon removed") is proprietary information developed by Applicants and not prior art.)

U.S. Pat. No. 6,217,624 B1 to Morris et al. discloses that certain hydrocarbyl-substituted polyoxyalkylene amines control engine deposits, especially combustion chamber deposits, when employed in high concentrations in fuel. More specifically they are intended to keep carbon deposits from forming in combustion chambers and not to remove heavy carbon deposits that have already accumulated. Additionally, as such amines are mixed into the fuel stock, they would not reach the induction system other than the direct intake valve area on GPI engines, or only the combustion chamber area on direct injected engines. Thus on GDI engines, regardless of its possible effectiveness on the combustion chambers, it can have no effect on any portion of the induction system of an engine. Further, independent of how injected into the cylinders, when standard consumer grades of gasoline are used the gasoline base is also a problem. When such gasoline is used as a base for the amine it will flash into a vapor at the engine running temperatures. This will not provide for a liquid base for the carbon to move into (the importance of which is discussed below under, for instance, "Problems and Objectives") which is helpful to remove carbon deposits from the induction system and/or combustion chambers. Additionally, if the gasoline flashes before getting to the carbon deposit, the cleaning agents are much less likely to contact the carbon deposit.

U.S. Pat. No. 6,458,172 to Macduff et al. discloses a fuel additive of detergents combined with fluidizers, and to hydrocarbon fuels containing these fuel additives. The fuel additives of Macduff et al. combine a Mannich detergent, formed from reaction of an alkylphenol with an aldehyde and an amine, with a fluidizer that can be a polyetheramine or a polyether or a mixture thereof and, optionally, with a succinimide detergent. Fuels containing these additives are claimed to be effective in reducing intake valve deposits in gasoline fueled engines, especially when the weight ratio of detergent(s) to fluidizer(s) is about 1:1 on an active basis. As these fuel additives are mixed into the fuel stock they would not reach the induction system other than the direct intake valve area on GPI engines, and only the combustion chamber area on GDI engines. Also, the consumer grade gasoline base is a problem as it will flash into a vapor at the engine running temperatures. This will not allow for a liquid base which is helpful to remove carbon deposits from the induction system and/or combustion chambers. Additionally, if the gasoline flashes before getting to the carbon deposits, the cleaning agents are much less likely to contact such deposits.

U.S. Pat. No. 9,249,377 B2 to Shriner discloses a cleaning composition including a synergistic combination of a pyrrolidinone with a C1 to C12 alkyl, alkenyl, cyclo paraffinic, or aromatic constituent in the 1 position and a C1 to C8 alcohol. A preferred pyrrolidinone is 1-methyl-2-pyrrolidinone. The preferred other component is an alcohol, preferably methanol. These components will form a cleaning composition containing a specific ratio of Volatile Organic Compounds (VOC) compliant and VOC exempt solvents with a viscosity between 0.4 to 2.0 cSt @ 40° C. More specifically, the viscosity will be between 0.5 and 1.0 cSt @ 40° C. Applicants testing (discussed below) has shown that some of these VOC compliant petroleum distillates do not remove high percentages of the carbon types generated in road vehicle engines, sometimes referred to as "road vehicle carbon". Additionally methanol has a flash point that is significantly below engine running temperatures.

In addition to additives which can be added to a fuel tank for the stated purpose of removing carbon deposits, additives have also been developed to boost engine horsepower, improve fuel economy and reduce tailpipe emissions. U.S. Pat. No. 4,684,373 to Vataru et al. and U.S. Pat. No. 4,857,073 to Vataru et al., both assigned to Wynn Oil Company, are examples. The disclosure in the '373 patent is for gasoline engines; the disclosure of the '037 patent, for diesel engines. Except for the statement in the '373 patent ("inasmuch as older vehicles may have developed fuel system and combustion chamber deposits that could compromise the accuracy of emissions data during the test, a new vehicle was chosen as the test car" (col. 4, II 44-47)), neither patent references "deposits" or "carbon deposits". The '373 patent discloses the use of di-tertiary butyl peroxide for adding "supplemental oxygen to the combustion process" and amines for "intake valve cleanliness". See col. 3, I. 30. The '373 patent does not teach that the di-tertiary butyl peroxide is used for the removal of carbon deposits within the internal combustion engine, but instead used as an oxidant for the combustion process. Additionally, Vataru's choosing a test engine that does not have carbon deposits contained within the engine acknowledges this teaching's inability to clean existing carbon deposits. Furthermore, making assessments about cleaning efficacy based on improved mileage alone can be misleading because measured fuel mileage is primarily a measure of combustion efficiency rather than solely the cleanliness of the engine.

U.S. Pat. No. 7,195,654 B2 to Jackson et al. discloses a gasoline additive concentrate including a solvent and an alkoxylated fatty amine, and a partial ester having at least one free hydroxyl group and formed by reacting at least one fatty carboxylic acid and at least one polyhydric alcohol. This mixture is intended to "increase fuel economy, reduce fuel consumption, and reduce combustion emissions in gasoline internal combustion engines." See Summary of the Invention, col. 1, II 61-63. From the discussion in the Description of the Related Art the amines are for improving fuel economy and "lubricity" (the ability of the fuel to act as a lubricant, which is particularly important in the case of diesel engines). (Applicant's testing of amines with regard to their ability to remove road vehicle carbon deposits is discussed below.) Additionally, as with Morris et al. and Macduff et al, the chemicals are mixed into standard consumer grades of gasoline which would not reach the induction system other than the direct intake valve area on GPI engines and only the combustion chamber area on direct injected engines and which will flash into a vapor at the engine running temperatures. Again, this will not allow for a liquid base which is helpful to remove carbon deposits from the induction system.

Problems and Objectives

The relevance of prior art chemical mixtures intended for the removal of today's road vehicle carbon, even assuming that they had some effectiveness at the time they were developed (e.g., 1954 in the case of the mixture disclosed in Dykstra et al.), is questionable for a number of reasons. First, is that the characteristics of carbon deposits have changed over the years. This in part is due to the changes in fuel additives used, such as tetraethyllead which has not been used in automotive based fuels for many years due to health hazards as well as its adverse effect on emissions devices such as catalytic converters. However, when tetraethyllead was used this would have affected the carbon deposits which, in turn, would have affected the actual performance of the carbon cleaning compositions of matter. Dykstra et al. reference a material claimed to penetrate and remove the lead compounds in the deposits. Secondly, engine designs have also changed, as can been seen by the change from basic carburetion to electronic fuel injection. Additionally, motor oils and anti-friction additives contained in these oils have changed (e.g. in the GDI engines the high pressure fuel pump puts a heavy load on the drive mechanism which, in turn, requires a different oil formulation for these type engines). These changes have, in turn, changed the carbon deposits that accumulate within road vehicle internal combustion engines. Finally, some of the chemical constituents of prior art formulations are now deemed unsafe for the public.

In addition to the drawbacks associated with the above referenced prior art and the changes over time in fuel composition, engine design, etc. as discussed above, the failure of currently available products to remove road vehicle carbon deposits from internal combustion engines is also due to both the way the testing is accomplished and to the way that formulations to attempt to remove carbon are developed. The use of the Rapid Carbon Accumulation ("RCA") method for producing engine carbon for testing the effectiveness of various chemicals and chemical mixtures exemplifies this problem. In this method a special fuel base is used that when burned in engines with no prior carbon deposits produces high carbon deposit levels within the engine's combustion chambers, induction system, and exhaust system. The purpose is to generate the same carbon thickness and carbon volume in 5,000 miles, based on the use of dynamometer testing (not on road operation) that a road vehicle engine will generate in 100,000 miles of actual driving. However, the structure of the carbon deposit generated in the RCA method is not the same as that generated in road vehicle engines. First there is the difference in fuel (the special RCA fuel base v. the different commercially available fuels). And, commercially available fuels vary with manufacturer, region of country where they are dispensed, and time of the year (in some states up to 10% of the gasoline is ethanol in winter months). The second difference is that in road use the carbon deposits are only partially created by the fuel, whereas the RCA carbon is mainly comprised of the fuel. In road vehicles a large amount of the induction system carbon deposit is created from the engine oil that is taken in through the Positive Crankcase Ventilation ("PCV") system. Additionally, the Exhaust Gas Recirculation ("EGR") system (whether external of internal) allows burnt exhaust gases to reenter the induction system further contributing to the carbon deposit composition within the induction system. The PCV and the EGR contributed carbon deposits will take many thousands of road miles to accumulate within the induction system. These types of carbon deposits are not typically generated via RCA. Yet another difference between RCA carbon deposits and road vehicle carbon deposits is that RCA carbon deposits do not have the same thermal soak cycles or soak times as a high mileage road vehicle would have.

Nonetheless, as the RCA running times and soak times are meant to duplicate those generated in road vehicles, such times are set as a standard so the RCA carbon deposits can be closely duplicated for testing purposes. However, such times may not be achieved in real world vehicles. For instance, the time that the engine remains at a given temperature, and thus the pyrolysis conditions, can vary widely (e.g. an engine turned off in Alaska in the winter will likely cool down significantly faster than an engine turned off in Arizona in summer). Thus, RCA carbon deposits and road vehicle generated carbon deposits are not typically the same. As far as Applicants are aware, the foregoing differences are either not known in the industry, or ignored.

Soak time refers to the time that the engine is hot and is turned off before it is restarted. Soak cycles refer to the number of times that the engine is turned off at a given temperature. Specifically, a soak cycle refers to when an engine that is at running temperature is turned off. When this happens, the fluids in the engine stop circulating and remain in place at high temperature and the combination of the hydrocarbons and the temperature that are present within the engine allows pyrolysis to be accelerated. Pyrolysis is a type of thermal decomposition that occurs in organic materials exposed to high temperatures. Pyrolysis of organic substances such as fuel and oils produces gas and liquid products that leave a solid residue rich in carbon. Heavy pyrolysis leaves mostly carbon as a residue and is referred to as carbonization.

Furthermore, Applicants have observed that from one road vehicle engine to another road vehicle engine of the same make, the carbon types can be quite different as well. This is due to the many different variables such as the type of hydrocarbons the fuel that is used is made of, the detergents added to the fuel base, the type of hydrocarbons the motor oil is made of, the antifriction additives added to the motor oil, the type and amount of metal particles that are contained in the carbon (which originate from a combination of fuel, oil, additives and engine wear), the operating temperature of the engine, the pressure and or temperature the carbon deposit is produced under, the varying loads on the engine, the engine drive times, the engine soak cycles and the engine soak times. As far as Applicants are aware these differences have not been recognized by others involved in the development of chemistry based products intended to remove engine carbon. An additional variable that affects carbon type is the engine design (e.g., gasoline port injection, gasoline direct injection, diesel direct injection, naturally aspirated, turbocharged, and supercharged). Each of these variables will affect the type of carbon deposit that will be produced and the carbon deposit volume accumulated within the internal combustion engine. And, again as far as Applicants are aware, these differences have not been recognized by others involved in the development of chemistry base products intended to remove road vehicle engine carbon. Finally, Applicants have, through their testing and development of the carbon removing chemical mixtures of the present invention, determined that even for a single engine, the chemical/physical properties of the carbon deposits vary from location to location in such engine (e.g., intake manifold v. combustion chambers).

Once a test engine has been run with the RCA fuel and has enough carbon build up, a mixture of known chemicals (i.e., a solution) is then formulated to remove or try to remove these RCA carbon deposits. The problem here is that this RCA carbon is not the same as the carbons generated over time under road driving conditions. Thus, even if the developed solution can remove at least some of the RCA carbon deposit, it may not work to effectively remove real world carbon deposits. Additionally, the standard method of direct measurement to determine how much carbon has been removed is by disassembly and weighing various engine components so, even if road vehicles are used, accurately determining the chemical to carbon deposit removal rate is difficult. So judging which chemicals/mixtures can remove which carbon types within the engine is very difficult to impossible to accomplish. Furthermore, making assessments about cleaning efficacy based on improved mileage alone can be misleading because measured fuel mileage is primarily a measure of combustion efficiency rather than solely the cleanliness of the engine.

Yet another problem, as noted above in the discussion of the Morris et al. and Macduff et al., is that such fuels only allow for a minimal liquid to come into contact with the carbon to be removed. For a chemical mixture to be able to remove even a portion of the carbon deposit, such mixture should to be in a liquid form. The liquid form is necessary to permit the selected chemicals to solubilize the deposit via solvent-solute interaction (a solute is a substance in which is dissolved into another substance, a solvent; in other words the carbon is dissolved into the solvent base) for carbon removal. If the selected chemicals flash into a vapor at engine running temperatures like the fuel base, there is minimal liquid available for the carbon deposit to be solubilized into and so little carbon is removed. Applicants have determined that vapor is not effective in removing heavy carbon deposits. This is in part because, although the chemical additives in gasoline may contact and alter (e.g., soften) some carbon deposit, they are not in the form of a liquid, which liquid makes it easier to wash softened carbon deposits away. Additionally, based on the use of the various chemicals in the commercially available products marketed for removing carbon deposits, it appears to Applicants that developers of the prior art are unaware of this important factor, which has grown in significance as engines have changed, due to emission regulations, from carburation to fuel injection, and now gasoline direct injection.

As the problems discussed above with regard to the prior art development process are evident, the products that have been developed to remove carbon deposits do not work well to remove various types of carbon deposits from road vehicle engines. This will be evident from the test results provided below.

The above described development produces products that all have problems removing carbon deposits from the internal combustion engine's induction system and combustion chamber in real world situations. Thus, to identify chemicals and develop chemical mixes that will be effective in removing carbon that was produced in actual driving conditions, the development needs to be done on the same high mileage types of carbon that are contained within road vehicle engines and not with RCA generated carbon. It has been found through testing that the carbon type from one road vehicle engine design is quite different from yet another road vehicle engine design. These differences in carbon types from different internal combustion engine designs provide a serious challenge in the development of chemical mixes that can remove multiple carbon types. If different carbon deposits from different road vehicle engines are not tested, one would not likely be aware that these carbon types can be so varied.

For the various carbon types that occur in real world applications (e.g., road vehicle engines, generators) there needs to be a better performing product. The Applicants have found from testing of individual chemicals (e.g., xylene, ethylbenzene, naphtha), commercial products (e.g. the commercial products listed in FIGS. 3A & B, 4A & B and 5A) as well as from development of their own chemical mixes, that one chemical/chemical mixture may work well to remove one of the carbon types, but may not remove any of another carbon types. This presents a major problem for any formulation to effectively function in the carbon removal across the various types of actual engine carbon encountered.

Accordingly, it is important to develop a protocol whereby different types of carbon deposits from different engines (e.g., different manufacturers, different designs, different driving conditions), in which deposits are built up over time in actual street and highway driving conditions, can be tested with various chemicals and chemical mixtures to determine the effectiveness of such chemicals/mixtures in removing such carbon deposits from engines, and does not rely on an inaccurate direct method such as engine disassembly and weighing or an indirect method such as fuel economy.

It is a further object of the invention to identify chemicals and develop chemical/chemical mixtures that are effective in removing various carbon types from engines (GPI, GDI and DDI) that were operated under actual road/driving conditions.

In addition to understanding the characteristics of the various types of carbon deposits encountered in engines, identifying effective chemicals, and developing chemical mixtures (solutions) which will effectively remove at least substantial amounts of such carbon deposits, it is a further object to have an effective mechanism for delivering such chemicals and chemical mixtures to the induction system, combustion chambers and exhaust system of a vehicle.

Additionally, it is an object of the invention to have such chemicals/chemical mixes run within the internal combustion engine during cleaning without heavy smoke, stalling the engine, or creating running problems for the engine.

SUMMARY OF THE INVENTION

The present invention relates to, inter alia, the selection of chemicals, the development of chemical mixtures, and the use of such selected chemicals and developed mixtures in order to remove the various carbon deposits encountered within road vehicle internal combustion engines, regardless of engine type, carbon type, vehicle driving history, mileage, vehicle fuel(s) used, and engine oil(s) used. The present invention also relates to improved apparatus for effectively delivering chemicals/chemical mixtures to vehicle induction systems.

Carbon deposits from internal combustion engines of different designs and different locations within such engines (e.g., induction system, combustion chambers), and therefore different carbon types, were collected, identified (e.g., engine model, location within such engine), and tested in order to determine which chemicals and chemical mixtures are most effective for the removal of the different types of carbon deposits encountered. Based on our empirical laboratory testing it was very surprising to see how different the collected carbon deposits were in both thickness and composition, depending on in the different engine designs as well as different locations therein. This diversity was also analytically observed via Fourier Transform InfraRed (FTIR) spectroscopy and X-ray Photoelectron Spectroscopy (XPS) that verified differences in relative amounts and types of carbon atom bonding environment and hydrocarbon structures between the various deposits. Carbon deposits that have such analytically determined variations we refer to as "different carbon types". By these methods it was also determined that carbon deposits generated from different engine configurations (e.g., gasoline port injection, gasoline direct injection, and diesel direct injection) could vary and therefore be different carbon types. Additionally, we also found that deposits generated from a single engine configuration, but driven and/or maintained under different conditions, could also have different carbon types.

The carbon types analyzed also varied based on their metals content. Parsinejad et al. (Direct Injection Spark Ignition Engine Deposit Analysis: Combustion Chamber and Intake Valve Deposits, JSAE 20119096, SAE 2011-01-2110) and Dearn et al (An Investigation into the Characteristics of DISI Injector Deposits Using Advanced Analytical Methods, SAE 2014-01-2722, Oct. 13, 2014) have shown via chemical analysis that engine carbon deposits may contain a significant number of chemical elements in addition to carbon, hydrogen and oxygen. These include aluminum, boron, calcium, chlorine, chromium, copper, iron, lead, magnesium, manganese, molybdenum, nickel, phosphorous, potassium, silicon, sodium, sulfur and zinc. We have also determined the presence of many of these chemical elements in our carbon samples from road vehicles via X-ray Fluorescence (XRF), which also shows diversity in the elemental content and elemental quantity between different carbon samples. We believe that the presence of these elements added to the diversity of carbon types in two primary ways: (1) physical differences based on how the other elements are incorporated into the carbon deposit, such as their total amount and volumetric dispersion within the carbon deposit; and (2) chemical differences in the carbon deposit itself that are caused by chemical interaction between the hydrocarbon being deposited and the metallic and or non-hydrocarbon based species, for instance via interaction with an oxygenated portion of the hydrocarbon in the deposit with a metal, or by directly transforming the structural nature of the hydrocarbon via catalytic reaction with a metal species.

We categorize carbon cleaning chemicals of the present invention into three general categories that we define as follows. (1) "Non-Specific Solvents" that remove portions of the deposits primarily via solvent-solute interactions such as those described by the solubility parameter, e.g. dispersion (van der Waals), polarity (related to dipole moment) and hydrogen bonding. Examples of Non-Specific Solvents of the present invention include organic solvents such as benzene, toluene and xylenes as well as oxygenated compounds such as alcohols, ethers and ketones. (2) "Specific Solvents" where solvent-solute interaction occurs primarily as a result of electron pair donor/electron pair acceptor interactions in which electron transfer occurs between an electron donating species and an electron accepting species. The chemical complex formed by this interaction is often ionic (non-covalent) in nature. Specific Solvents can be molecules that contain a nitrogen, sulfur and/or an oxygen atom with an unshared electron lone pair such as pyridine, n-methyl pyrrolidone and dimethyl sulfoxide. (3) "Reactive Solvents" that cause deposit degradation by covalent bond disruption. Here the chemical structure of both the solvent and the deposit may be altered as a result of, for instance, bond cleavage. Compounds that can generate free radical species and alkaline hydrolysis compounds/mixtures are examples of Reactive Solvents. (Note: some chemical compounds may act in more than one of these categories depending on the specific system temperature, specific chemistry of the cleaning solvent mixture, and the specific chemical nature of the carbon deposit to be removed.)

The carbon cleaning solutions of the present invention are only effective if they can be applied to the carbon deposits that accumulate within internal combustion engines, namely the induction system (including intake valves and the surrounding port area), cylinders and the exhaust system. (This is also true of prior art products marketed for engine carbon removal.) As with the prior art products themselves, prior art methods of application through the induction system have, at best, limited effectiveness. This includes the use of a hydraulic nozzle (also referred to as an oil burner nozzle) to spray the prior art products at closed throttle plates. As discuss in the '016 application, with this prior method the spray from the nozzle will impinge on the throttle body and throttle plate and tend to puddle in the induction system. From our testing of such prior art delivery methods, including observations of air flow through various induction systems, we determined that the chemical/chemical mix was not being delivered to many of the carbon sites within the engine. It was then clear that if such solvents/solutions could not be delivered to the carbon sites the carbon deposit could not be removed. While this may seem obvious, as far as Applicants are aware this was not known in the prior art.

As a result of our testing we determined that, if the chemicals/chemical mixtures of the present invention were delivered in an aerosol format and not directed at the throttle plate, the liquid droplets of the aerosol will stay suspended within the air flow moving into and through the engine, and the droplets would actually delivered to the carbon sites throughout the induction system and into the combustion chambers. To this end we developed several different nozzles for delivering an aerosol and methods to apply the droplets of solution to the various engine components where the carbon can be soaked by the droplets so the carbon deposit can be removed. These apparatus and methods are disclosed in both the '016 application and the further developments discussed below in detail.

A preferred method of removing carbon build up from an internal combustion engine includes: running the engine; monitoring the position of the throttle plate; opening or snapping the throttle plate (snapping the throttle plate is an opening rate that is quick enough to allow an in rush of air to occur into the engine induction system); discharging chemistry in the form of an aerosol into the induction system through the nozzle only when the throttle plate is opened; and closing the throttle plate and simultaneously discontinuing the application of chemistry to the induction system. The nozzle may be placed in front of the induction system before the throttle plate, in which case the step of delivering is delivering the chemistry to the induction system before the throttle plate. Where the induction system includes a port behind the throttle plate, the nozzle may be placed in the induction system after (behind) the throttle plate, in which case the step of delivering is discharging the aerosol into the induction system after the throttle plate.

While positioning the nozzle after the throttle plate and timing the delivery of the aerosol with the inrush of air when the throttle plate is opening is preferred, it is not necessary so long as contact between the throttle plate and the aerosol is minimized so as not to adversely affect keeping the liquid droplets in the air stream moving through the induction system. This is not an issue where the aerosol is delivered after the throttle plate. Positioning the nozzle in front of the throttle plate has commercial advantages in the form of both reduced equipment and service personal costs. With this placement of the nozzle, the aerosol spray from the nozzle needs to be directed at the gap between the throttle plate and the throttle body when the throttle is in the closed position.

(As those skilled in the design and maintenance of fuel delivery system understand, when the throttle plate is "closed" there is still some opening between the body and plate to provide air to the cylinders when the engine is idling.) This directing is optimized by the flattened nozzle tip of the present invention.

Finally, the present invention relates to the use of some of the chemical/chemical mixes of the present invention as an additive for mixing in a fuel base, such as standard consumer grades of gasoline/diesel fuel.

BRIEF DESCRIPTION OF THE DRAWINGS

FIGS. 3A and 3B is a table showing in the vertical column the percentages of different chemicals contained in the commercially available cleaning products listed in the top horizontal row, as shown on their respective MSDS information.

FIGS. 4A and 4B is an additional table also showing in the vertical column the percentages of different chemicals contained in many of the commercially available cleaning products listed in the top horizontal row, as shown on their respective MSDS information.

FIG. 5A is a table showing the test results from different commercially available manufactured induction and fuel tank chemical cleaning products and fuel tank additives mixed with gasoline. Those marked "Yes" in the "Induction" column are intended for delivery to the engine through the induction system. Those marked "Yes" in the "Fuel Tank" column are intended to be delivered to the engine along with the fuel.

FIG. 5B is a table showing the test results from Applicants proprietary mixture labeled "ATS-505CR" and various chemicals tested for carbon removal ability (e.g., xylenes, light hydrotreated naphtha (LHN)) on the same Audi Gasoline Direct Injection turbocharged engine carbon.

FIG. 6 is a table showing the test results using a chemical mixture of 50% XYL and 50% LHN with other chemicals added to the mixture such as 5% NMP and 5% PEA. All carbon samples for each test series are from the same engine (example; all tests run for the BMW GDI are from the same intake on the same engine), all other variables are controlled equally. The % shown is the amount of carbon removed; accuracy of testing results are within −/+4%.

FIG. 7 is a table showing a number of commercially available Wynn's branded products (namely: Wynns "Valve Intake Cleaner" VIC; Wynns "Air Intake Cleaner" AIC; Wynns "Clean Sweep" CS; and Wynns "GDI, PRI and EGR DE-CARBON FOAM") and the ATS 505CR mixture of the present invention applied to six different carbon types, and the percentage of carbon removed by each product. The % in chart is amount of carbon that was removed from carbon sample. Accuracy of testing results are (+−) 4%.

FIG. 8 is a table showing the test results for four new commercially available Gasoline Direct Injection (GDI) carbon removing products (e.g., RunRite GDI) and the ATS 505CR mixture of the present invention applied to 12 different carbon types from different engines by various manufacturers.

FIG. 9 is a table showing test results for ATS 505CR A-505CR B and 505DCR mixtures of the present invention used on five different carbons types. All carbon samples for each test series are from the same engine (example; all tests run for the BMW GDI are from the same intake on the same engine); gasoline has pump octane rating (87) from the same pump; all other variables are controlled equally. The % shown is the amount of carbon removed; accuracy of testing results are within −/+4%.

FIG. 10 is a table showing test results for various chemical mixtures of THN (the base) working with various Specific Solvents and Reactive Solvents on five different carbon types from different engines.

FIG. 23 is a table showing how various chemicals work in a fuel base, particularly standard consumer grade gasoline at a 10 percent ratio and the percentage of carbon removed by such chemicals when mixed in the gasoline.

FIG. 24 is a table showing how various chemicals work in a fuel base, again standard consumer grade gasoline at a 98 percent ratio with various chemicals added at 2 percent and the percentage of carbon removed by such chemicals when mixed in the gasoline. All carbon samples for each test series are from the same engine (example; all tests run for the Carbon type are from the same intake on the same engine); gasoline has pump octane rating (88) from the same pump; and all other variables are controlled equally. All ATS chemicals are straight chemicals. If blends are produced carbon removal rates will be higher. Except as noted, all tests were run with limited volumes. If greater volumes are used the % of carbon removed between chemical blends would be increased as shown when using two carbon samples Audi GDI and GM GPI carbon. Accuracy of testing results are within −/+4% (% shown is the amount of carbon removed).

FIG. 25 is a table showing how various high temperature gasoline blends work to remove various carbon percentage amounts from various carbon samples. With regard to High Temp Gasoline (HTG): HTG 1)=19% OCT/20% ISO/20% THN/6% DIP/35% XYL; HTG 2)=20% OCT/40% ISO/20% CH/5% DIP/15% XYL; HTG 3)=20% OCT/20% ISO/20% CH/20% DIP/20% THN; HTG 4)=20% OCT/20% ISO/20% THN/20% DIP/20% XYL; HTG 5)=20% DEC/20% ISO/20% THN/20% PB/20% XYL; HTG 6)=80% THN/5% OCT/5% ISO/5% DIP/5% XYL. Accuracy of the testing results are within −+4%. The % shown is the amount of carbon removed. All carbon samples for each test series are from the same engine (example; all tests run for the BMW GDI are from the same intake on the same engine). Gasoline has a pump octane rating (87) from the same pump, with all other variables controlled equally.

FIG. 26 is a table showing a comparison of THN, turpentine, and turpentine derivatives (e.g., p-cymene (p-C)) that are used on different carbon types to show the effectiveness of the chemicals. All carbon samples for each test series are from the same engine (example; all tests run for the Carbon type are from the same intake on the same engine); and all other variables are controlled equally. Accuracy of testing results are within −/+4% (% shown is the amount of carbon removed).

FIG. 27 is a table showing chemical mixes with turpentine and turpentine derivatives used on different carbon types to show the effectiveness of the chemicals. All carbon samples for each test series are from the same engine (example; all tests run for the carbon type are from the same intake on the same engine); and all other variables are controlled equally. Accuracy of testing results are within −/+4% (% shown is the amount of carbon removed).

FIG. 28 is a viscosity laboratory analysis table showing that Oil of Turpentine (TPT), gamma terpinene (y-T), Para cymene (p-C), dodecane (DOD), 2,2,4-trimethylpentane (TMP), and tetrahydronaphthalene (THN), at a 10% ratio can be put directly into an engine oil base without causing a harmful viscosity change.

FIG. 29 is a "Four Ball Wear Test" table showing that Oil of Turpentine (TPT), gamma terpinene (y-T), Para cymene (p-C), dodecane (DOD), 2,2,4-trimethylpentane (TMP), and tetrahydronaphthalene (THN), at a 10% ratio will not cause additional wear of engine components.

DESCRIPTION OF THE PREFERRED EMBODIMENT

Figure 1:
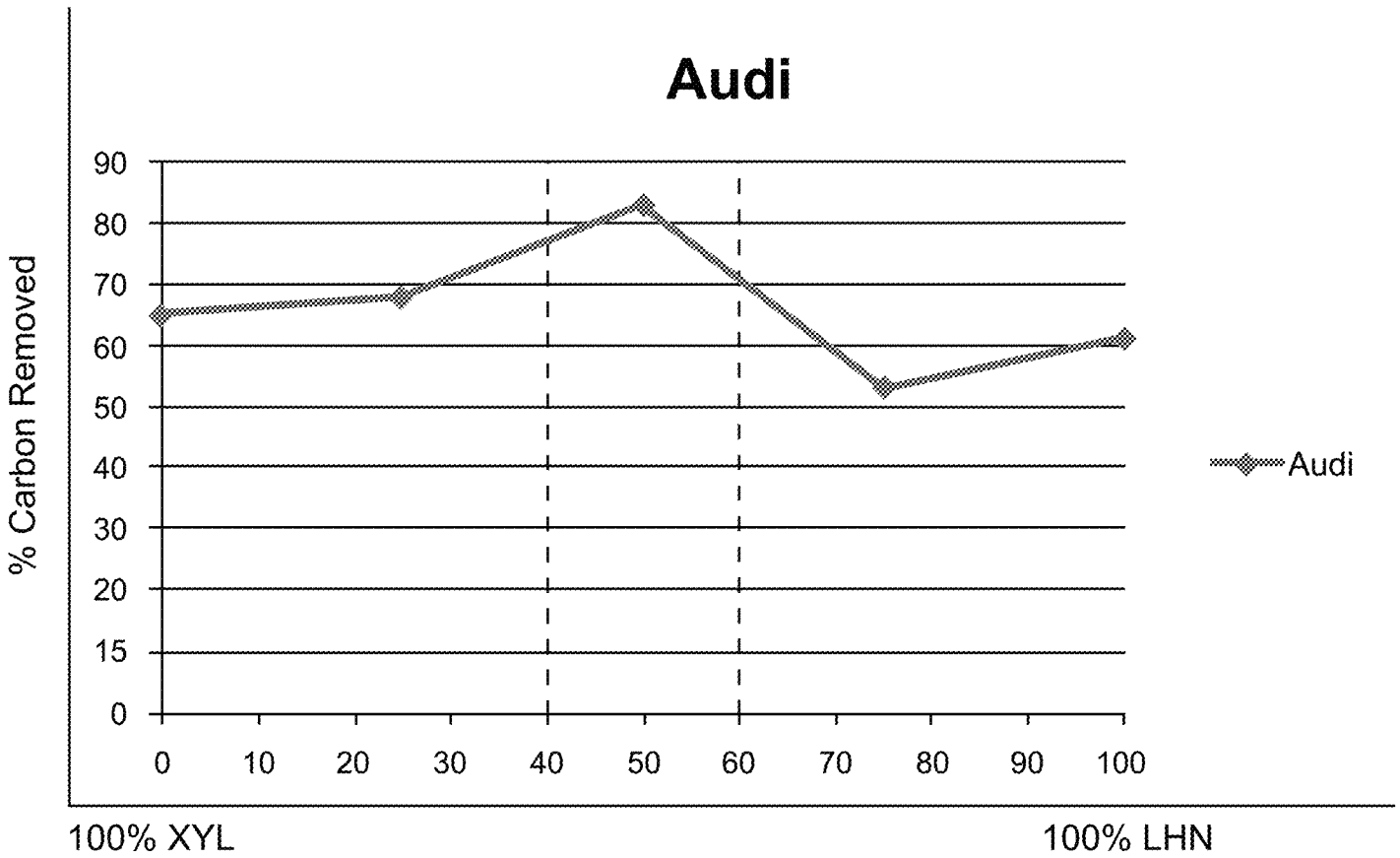
FIG. 1 is a graph showing different percentages of mixtures of xylenes and light hydrotreated naphtha used on Audi turbocharged Direct Injected Gasoline carbon and the percentage of carbon removed.

An in-depth understanding of carbon types and chemicals and chemical mixtures tested for their effectiveness in breaking down carbon accumulations is imperative in order to successfully remove these carbon deposits from road vehicle internal combustion engines. In order to accomplish this a testing procedure was developed including: (1) chemical and chemical mixture bench testing of road vehicle carbon (this is carbon that has been carefully removed by hand from the induction system and combustion chambers of road vehicle engines for the purpose of identifying and testing various carbon types and the effects of various chemicals and chemical mixtures on such various carbon types); and (2) testing the same types of carbon in running road vehicle engines with the same chemicals and chemical mixtures applied to the induction systems of such engines. In step (1) the carbon being tested is weighed both before and after the chemical (or chemical mixture) is applied, so that the amount of carbon removed by such chemical (or chemical mixture) can be quantified. This test procedure verified that the chemicals and chemical mixtures tested and the removal of different carbon types corresponded well to one another regardless of which test method (bench or running engine) was used. Stated another way, the bench tests worked to the same extent that occurred with the running engine tests. The test bench methodology produced a repeatable accuracy of +/−4%. With this level of accuracy a true understanding of the effectiveness of each chemical and chemical mixture tested, and each carbon structure type such chemicals and mixtures were tested on was achieved.

One example of the chemical diversity of a carbon type was observed when testing the chemical bromopropane (a colorless liquid with a melting point of −128.1° F. and a boiling point between 138 and 142° F.). Bromopropane is used to remove asphalt/bitumen (the terms bitumen and asphalt are understood to be interchangeable) deposits from road construction on vehicle surfaces. Although bromopropane is not environmentally favorable and boils below typical engine operating temperatures, we experimented with bromopropane in order to further our understanding. When the bromopropane was used on a sample of Audi turbocharged direct injected carbon collected from the intake port it removed 83% of such carbon. However, when the bromopropane was used on a sample of Honda port injected carbon collected from the intake port it only removed 26% of the carbon.

It was also observed that when this same type of Honda carbon was exposed to the Specific Solvents and Reactive Solvents experimented with, the carbon samples had a large amount of swelling. In other words, the deposit increased in volume due to uptake of the chemicals and chemical mixtures applied. It was also observed during testing that once a carbon sample swelled it was very difficult to remove any additional carbon. It is believed that chemically induced swelling caused the carbon pores to close. Thus, when any additional chemicals or chemical mixtures were applied to the swelled carbon sample they could only contact a much smaller area of the carbon deposit (the exposed external surface rather than both the exposed external surface and the internal surface area located in the pores) and were not effective in removing additional carbon from the sample. This chemically induced swelling was observed with many of the direct injected gasoline and port injected gasoline carbon samples that were tested. However, the Honda carbon tested was more susceptible to this chemical induced swelling. In fact, this Honda carbon was swelled by almost all of the Specific and Reactive Solvents that were applied to it. It thus became apparent that the chemicals and chemical mixtures that were applied to these Honda carbon samples would start to remove carbon from the sample and would then swell it, thereby stopping any additional carbon removal. The carbon removal would plateau with less than approximately 25% of the carbon sample being removed.

Since it was determined that high concentrations of Specific and Reactive Solvents diminished carbon removal of some carbon types, it was reasoned that the use of low percentages of such Specific and/or Reactive Solvents in a Non-Specific Solvent or Non-Specific Solvent mix (e.g., the 50/50 and 40/60 mixes discussed below), which mix would cause little or no chemically induced swelling, could be used as a base solution (or base) to mitigate such Specific/Reactive Solvent induced carbon swelling. Stated another way, if a base of a Non-Specific Solvent or a Non-Specific Solvent mix were to remove carbon at a rate higher than the rate of swelling induced by the Specific and/or Reactive Solvents the problem caused by swelling might be mitigated. A study of various Non-Specific Solvents, Specific Solvents, and Reactive Solvents began. Thousands of different chemicals and mixtures of chemicals were tested.

Non-Specific Solvents were tested on Gasoline Port Injection (GPI) carbons, Gasoline Direct Injection (GDI) carbons, and Diesel Direct Injection (DDI) carbons.

Our testing demonstrated that the ratio of the Non-Specific Solvents when mixed together was more important than we initially expected. If the ratio of one Non-Specific Solvent to a second Non-Specific Solvent were mixed at a 50/50 ratio, the ability of the Non-Specific Solvents to remove carbon improved considerably. When xylenes (XYL) and light hydrotreated naphtha (LHN) are mixed at a 50/50 ratio the solvents' carbon removal ability is increased. This 50/50 mixture is a preferred embodiment for one of the base solutions of the present invention. To demonstrate the effectiveness of this 50/50 ratio pairs of Non-Specific Solvents are mixed at different ratios and then tested on samples of the same Audi turbocharged direct injection carbon collected from the intake. When the preferred XYL and LHN were mixed at a 50/50 ratio 86% of the carbon was removed. However, when this mixture was changed to 25% XYL and 75% LHN only 53% of such carbon was removed. When this mixture was changed to 75% XYL and 25% LHN only 68% carbon is removed.

The Audi GDI carbon used in the 50/50 mixture tests discussed in the previous paragraph is a very easy carbon type to remove when compared to many of the other GDI carbons that were tested. With different carbon types these percentages of carbon removal will vary between the carbon type used and which Non-Specific Solvents are mixed together. It would appear that a carbon removal increase of just 10% is just a slight increase. However, we have determined through testing that a 10% increase is very hard to obtain.

FIG. 1 is a graph showing different percentages of mixtures of XYL and LHN used on the above referenced Audi turbocharged Direct Injected Gasoline carbon. The graph's vertical axis is the percentage of carbon removed from the carbon sample. The graph's horizontal axis shows the mix of chemicals wherein the 0 point is 0% LHN/100% XYL and the 100 point is 0% XYL/100% LHN. It can be seen that with the Audi carbon the 50/50 mix of XYL and LHN was the most effective ratio at removing more of the carbon deposit (84% carbon removed). However, as can be seen from FIG. 1, ratios between 60/40 of XYL to LHN (71% carbon removed) and 40/60 (76% carbon removed) were also effective at carbon removal.

Figure 2:
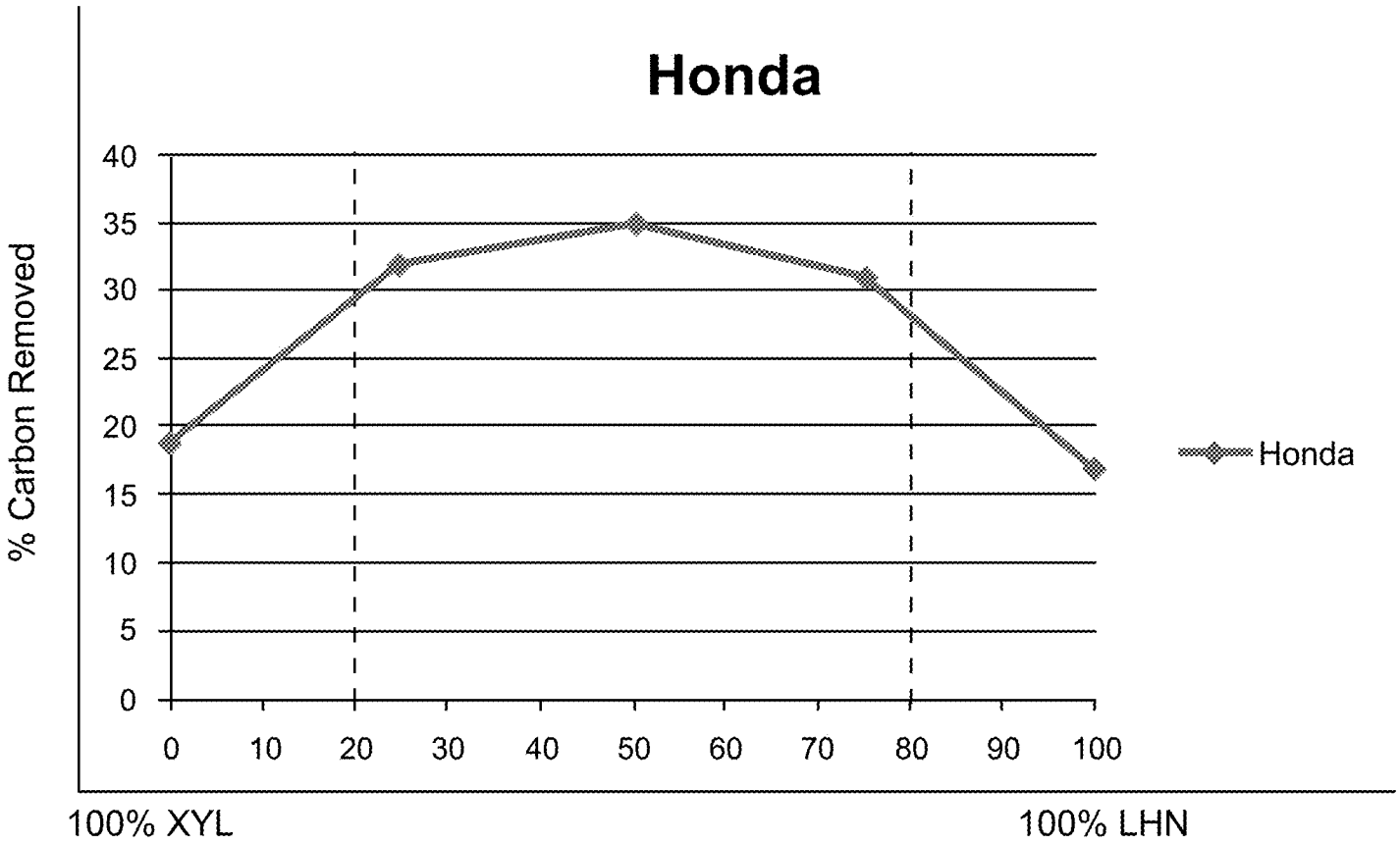
FIG. 2 is a graph showing different percentages of mixtures of xylenes and light hydrotreated naphtha used on Honda Direct Injected Gasoline carbon and the percentage of carbon removed.

FIG. 2 is a graph showing different percentages of XYL and LHN used on the above referenced Honda Port Injected Gasoline carbon. The graph's vertical axis shows the percentage of carbon removed from the carbon sample. The graph's horizontal axis shows the mix of chemicals wherein the 0 point is 0% LHN/100% XYL and the 100 point is 100% LHN/0% XYL. Similar to the results obtained with treating the Audi turbocharged Direct Injected Gasoline carbon, it can be seen that with the Honda carbon the 50/50 mix of XYL and LHN was the most effective at removing more of the carbon deposit (35% carbon removed). Additionally it can be seen from FIG. 2, ratios between 20/80 of XYL to LHN (28% carbon removed) and 20/80 (27% carbon removed) were also effective at carbon removal.

Because the chemical mixtures discussed above in reference to FIGS. 1 and 2 are Non-Specific Solvents little to no chemically induced swelling occurred, including the Honda carbon sample. In the absence of carbon sample deposit swelling, the carbon removal did not plateau. Thus, if more of the 50/50 mix of XYL and LHN was applied it continued to remove carbon from the carbon sample. Additionally, Honda carbon samples that had previously been chemically swelled with Specific-Solvent mix or Reactive Solvent mix that had caused a plateauing of the carbon removal could be treated with the 50/50 mix of XYL and LHN and additional carbon removed from the carbon sample.

As far as Applicants are aware, the use of a base of Non-Specific Solvents mixed in high ratios (e.g., 50/50, 40/60, 20/80) for induction cleaning is not disclosed in any known prior patent or publication nor is known in the industry. This is illustrated by analyzing the MSDS information in FIGS. 3A and 3B and 4A and 4B. While several commercial products show high ratios of solvents for their fuel additives, which by design will be heavily diluted once mixed with the fuel base, none disclose or teach the use of such high quantities of solvents for induction cleaning (i.e., where the solvents are introduced into the engine through the engine's induction system). Furthermore, some of the listed induction cleaning products do not provide complete quantitative ingredient information. Thus, as far as Applicants are aware, none disclose high ratios of mixes of Non-Specific Solvents for removing carbon from internal combustion engines.

Thus, an effective ratio of Non-Specific Solvents, optimized to minimize carbon swelling, was found to be between 20/80 and 80/20 when the Non-Specific Solvent base consists of two solvents. Or a ratio of 33.33/33.33/33.33 (referred to as 30/30/30) if the base consists of three Non-Specific Solvents. An example of the latter would be 33.3% XYL/33.3% LHN/33.3% SS as discussed in greater detail below.

The above described Non-Specific Solvent mixes work well on certain carbon types and represent an improvement over the prior art. However, from our testing we determined that none of these Non-Specific Solvents mixes worked well enough across all the carbon types tested to enable sufficient carbon removal in the typical cleaning time and chemical volumes allotted for this procedure by current industry practice, which is typically 16 oz of chemical delivered over 20 minutes of time. In view of this constraint it was determined that a mix of Non-Specific Solvents to which base one or more Non-Specific Solvents, Specific-Solvents and/or Reactive Solvents would be needed to enhance the base to remove substantial amounts of carbon across all carbon types. It was also determined for the best carbon removal results that the Specific Solvents/Reactive Solvents used would constitute no more than 30 volume percent of the final mix.

In general, a total content of the Non-Specific Solvent base of at least 70 volume percent was found to be preferred in order to mitigate chemically induced swelling from the Specific and/or Reactive Solvents while still providing substantial carbon removal. Small percentages of additional Non-Specific Solvents might be added in the remaining 30 percent to increase the carbon removal rate of the chemical mix, as indicated below with regard to the ATS 505CR mix, ATS 505DCR mix, and ATS 505TCR mix families.

It was found through testing that the best chemicals that we believe act primarily as Non-Specific Solvents are; xylenes (XYL), light hydrotreated naphtha (LHN), Stoddard solvent (SS), toluene (TOL), dipentene (DIP), tetrahydronaphthalene (THN), decahydronaphthalene (DHN), cyclohexane (CH), octane (OCT), pentyl acetate (PA), tributylamine (TBA), propylbenzene (PB), bromobenzene (BB), decane (DEC), diethyl malonate (DEM), 2,2,4-trimethylpentane (TMP), trimethylbenzene (TMB), tertiary-amyl methyl ether (TAME), and glycol ethers such as propylene glycol phenyl ether (PGPhE), propylene glycol propyl ether (PGPrE) and ethylene glycol butyl ether (EGBE). Each of these Non-Specific Solvents worked well across a board range of engine induction carbon and was determined to be suitable for the Non-Specific Solvent base. It was also determined that the Specific Solvents and Reactive Solvents (again noting that some chemicals may act in more than one of these two categories) that work best with the selected Non-Specific Solvents base for removing all carbon structure types are; 2-ethylhexyl nitrate (2-EHN), nitropropane (NP), tert-butyl peracetate (TBP), di-tert-butyl peroxide (DTBP), di-tert-amyl peroxide (DTAP), tert-butyl peroxybenzoate (TBPB), isopropyl nitrate (IPN), and tert-butyl hydroperoxide (TBHP).

It has also been determined that other mixtures of Non-Specific Solvents that do not necessarily include either XYL or LHN can also remove significantly greater amounts of carbon than any one of the individual solvents used alone. Examples of some other Non-Specific Solvents are dipentene (DIP), tetrahydronaphthalene (THN), Stoddard solvent (SS), and toluene (TOL). When the Specific Solvents and/or Reactive Solvents listed in the previous paragraph are mixed with Non-Specific Solvents other than XYL or LHN enhanced carbon removing formulas are also produced. Various mixes can be produced to better remove one carbon type than another carbon type. The problem is to produce a mix to work across all road vehicle carbon types. As previously discussed we have identified many different carbon structure types. With each of these carbon structures the chemical interaction with the carbon changes.

When using Audi turbocharged GDI carbon with Non-Specific Solvent mixtures such as 50% XYL and 50% SS, 59% of the carbon was removed. When this mixture is changed to 50% LHN and 50% SS, 70% of the carbon was removed. When this mixture was changed to 50% TOL and 50% LHN, 77% of the carbon was removed. When this mixture was changed to 50% TOL and 50% SS, 67% of the carbon was removed. Finally, when this mixture was changed to 50% TOL and 50% XYL, 51% of the carbon was removed.

Furthermore, and again in reference to the Audi turbocharged GDI carbon, at least 3 different Non-Specific Solvents can be combined to produce a mixture that has the ability to remove carbon as well. For example when the base mixture is changed to 33% XYL and 33% LHN and 33% SS, 46% of such Audi carbon is removed. When the base mixture is changed to 33% XYL and 33% LHN and 33% DIP, 38% carbon is removed. When the mixture is changed to 33% XYL and 33% SS and 33% TOL, 48% carbon is removed. When the mixture is changed to 33% XYL and 33% LHN and 33% TOL, 51% carbon is removed. When this mixture is changed to 33% LHN and 33% SS and 33% TOL, 28% carbon is removed. And when the base is changed to 33% XYL and 33% TOL and 33% trimethylbenzene (TMB), 72% carbon is removed. With the caveat, as discussed in greater detail below, that care must be taken to avoid selecting a chemical that inhibits the effectiveness of another chemical. Furthermore a mixture of 3 different Non-Specific Solvents is not an upper limit. One such example is demonstrated below using a blend for high temperature gasoline (HTG).

As discussed in greater detail below, through testing it has been determined that, generally speaking, the fewer chemicals contained within the chemical mixture the better the product works across all carbon types. We believe this to be because each of the individual chemicals tested may react with the carbon being tested at slightly different rates, yet there is a finite amount of carbon surface for them to act on (i.e. the efficacy of a particular chemical in a mixture of two or more chemicals is based on their competing carbon-removal reaction rates). In general therefore, the chemical that acts preferentially in a chemical mixture may be the chemical that has both the strongest chemical interaction with the carbon and the fastest reaction rate and will, in effect, reduce access and/or reactivity of the other chemicals to the carbon surface, and thus their efficacy in a particular mixture. Furthermore, solvent-solute interaction, specifically when two different solvents are chemically attracted to each other, may reduce the chemical attraction between those solvents and the carbon. Thus, when the number of carbon removing chemicals is less, the individual chemicals may have a greater efficacy toward carbon removal. It has also been determined that when small volumes of Specific/Reactive Solvents are used the Non-Specific Solvents in the base mix carbon removal may be enhanced. Thus, the final chemical mixture needs to be chosen based on the testing data, in order for the best formulation to be produced.

In addition to the foregoing, it is believed that the various chemicals tested (e.g., XYL, THN, TBP, and DTBP) have different mechanisms for removing carbon from road vehicle internal combustion engines. It is also believed the chemical base (i.e., the Non-Specific Solvent mix) is effective for its solubility parameter type interactions. The Non-Specific Solvents also provide the physical means for removal of the deposits because of their ability to carry the dissolved and loosened portions of the deposits away. (Proprietary technology and methodology for carrying away dissolved and loosened carbon deposits is disclosed below and in the co-pending '016 application.) The Specific Solvents and/or Reactive Solvents are used for their ability to react with the non-saturated hydrocarbon portions of the deposit, which in turn enhances the deposits tendency to be solubilized and/or removed by the Non-Specific Solvents. It is also believed that the oxygenated Specific and/or Reactive Solvents facilitate removal of the metal, alkali metal, and semimetal element portion of the deposit which, in turn, helps release the carbon deposit into the Non-Specific Solvent and thereby remove it from the engine. We believe that the ability of the Specific and or Reactive Solvents such as 2-EHN, TBP, DTBP, DTAP, TBHP, TBPB, NP, and IPN is in part due to their propensity to undergo scission into charged reactive species (e.g. free radicals) at engine operating temperatures. Free radical species generated from such scission are known for their ability to participate in the chemical interactions described above. It is further believed that in order to enhance these types of chemical interactions that the scission occurs in proximity to the carbon deposit and in a liquid phase. Thus, the boiling point of the Non-Specific Solvent base must be higher than the engine running temperature, and the auto-decomposition temperature of the Specific and/or Reactive Solvent needs to be close to the engine running temperature.

The engine running temperature will vary within the engine depending where the temperature is measured, (e.g. normal engine running coolant temperature can run from 180 F to 230 F, throttle body temperatures can run between 150 F and 230 F, intake system temperatures can run 180 F to 275 F, intake valve temperatures can run between 390 F to 1100 F, exhaust valve temperatures can run between 750 F and 1475 F, and combustion chamber temperatures can run 200 F to 1475 F). In the case of the chemical interactions described above, a free radical species interacting with a metal, alkali metal or semimetal element would most likely be acting as a Specific Solvent, but the same radical interacting with a non-saturated hydrocarbon species would most likely be acting as a Reactive Solvent.

The solvents described above were all tested in different formulations that remove substantial amounts of carbon from the different carbon types encountered in road vehicle engines. Those skilled in the art should appreciate the importance that the chemicals selected interact well with one another. Many different carbon removal formulations were mixed and tested. The best Non-Specific Solvents for use as the liquid base were found to be; XYL, LHN, DIP, THN, DHN, TOL, TMP, and SS. With such bases the best Specific/Reactive Solvents found to enhance the bases were; 2-EHN, TBP, DTBP, DTAP, TBPB, IPN, TBHP, and NP. With such bases the best Non-Specific Solvents found to enhance the bases were; OCT, EM, CH, PA, TBA, PB, BB, XYL, LHN, DIP, THN, DHN, TOL, TMP, TAME, and SS.

A significant part of our research was directed at the removal of intake carbon. This is the carbon that is within the induction system that can accumulate in such places as the throttle plate, throttle body, intake plenum, intake manifold, intake runner valves or charge valves, fuel injector tips, intake runners, intake opening, intake ports, and intake valves. However, the developed mixes were also found to remove carbon in the combustion chambers, and carbon from the direct injection injector tips, which we believe is due to both the higher temperatures and the combustion enhancing properties of the Specific and/or Reactive Solvents. Additionally the 2-EHN, TBP, DTBP, DTAP, TBPB, IPN, TBHP and NP provided the engines tested with enhanced engine running capability during induction cleaning. These combustion enhancing properties also allow for up to nine times the industry standard chemical volume (i.e., 1 to 1.5 Gallons Per Hour (GPH)) to be applied into the engine during cleaning without developing engine running problems. In turn, this increase in the chemical volume delivery allows for more carbon to be removed from the engine. The combustion enhancing properties of these chemicals is well known.

We believe that the ability of chemicals such as 2-EHN, TBP, DTBP, DTAP, TBPB, IPN, TBHP and NP to chemically interact with those parts of the carbon deposit that is not readily affected by the Non-Specific Solvent base results from the following. First, the parts of the deposit that were not susceptible to solvent-solute interaction with the Non-Specific Solvent become susceptible to this interaction because of the chemical interactions discussed in above. Second, the other parts of the deposit that are still not susceptible to solvent-solute interaction with the Non-Specific Solvent are carried away by the mechanical force of the moving liquid base (discussed below), thus being removed from the engine and burned in the combustion process.

It is important that all of the carbon that is removed in the cleaning process is burned during the combustion event. Some of the chemicals that can help with this combustion process, such as but not limited to, are; 2-EHN, TBP, DTBP, DTAP, TBPB, IPN, TBHP and NP. Burning all the carbon is important as it prevents such carbon that is removed from the induction system and combustion chambers from impacting the exhaust components, such as but not limited to, turbochargers and catalytic converters. Carbon deposits that are removed from the induction and combustion chambers, but not burned, may end up being deposited on the turbine wheel of the turbocharger. This, in turn, imbalances the turbine wheel which will cause mechanical damage to the turbocharger.

When using different combinations of Non-Specific Solvent bases with Specific Solvents/Reactive Solvents it was observed that some of the mixes worked better on some carbon types than others. It was also observed that when one chemical was added to a mix it could block or retard one of the other chemicals in the mix from working well on a particular carbon type. An example of this is when 5 percent 1-methyl-2-pyrrolidone (NMP) is added to a mix of Non-Specific Solvents (e.g., 50% XYL/50% LHN) that have a carbon removal rate in the 50 percent range, the carbon removal rate would drop to the 20 percent range. Yet another example is when 5 percent of polyetheramines (PEA) is added to a mix of Non-Specific Solvents (e.g., 50% XYL/50% LHN) that have a carbon removal rate in the 50 percent range, the PEA would limit the carbon removal rate to the 20 percent range. It is evident that when these chemicals are used in Non-Specific Solvents such as, but not limited to, NMP and PEA, they diminish the carbon removal ability of such Non-Specific Solvent bases as seen in FIG. 6. On the other hand, when these Non-Specific Solvent bases had Specific Solvents and/or Reactive Solvents added, such as just 5 percent di-tert-butyl peroxide (DTBP), the carbon removal rate would increase from the 50 percent range to the 70 percent range. However, when just 5 percent PEA or 5 percent NMP was added to the Non-Specific Solvent/DTBP mix the removal rate dropped to the 20 percent range. This is a 50 percent reduction in the carbon removal rate. It was also observed that just 2% volume of a chemical could bring the carbon removal rate down over 40%. Thus, it is extremely important to mix the solvents so the interaction between them enhances rather than diminishes their ability to remove the carbon deposit.

In the case where the solvent mixes tested removed substantial amounts of carbon compared to the commercially available products, they did not necessarily initially work across all the carbon types we collected from road vehicle engines. Using the aforementioned reasoning based on the roles of the various solvent types, and then considering physical constraints such as boiling temperatures and auto-decomposition temperatures, as well as health effects, a selection of potential chemicals was chosen to further research. Through extensive testing of these chemicals preferred chemical mixes were formulated to use on gasoline based engines from the following chemicals in the specified ranges, namely: 20-80% xylenes; 20-80% light hydrotreated naphtha; 0.2-20% octane; 0.2-20% 2-ethylhexyl nitrate; 0.2-20% tert-butyl peracetate; and 0.2-20% di-tert-butyl peroxide. This is referred to as the "ATS 505CR" family of mixes. A preferred ATS 505CR mix is: 40% xylenes; 40% light hydrotreated naphtha; 5% octane; 5% 2-ethylhexyl nitrate; 5% tert-butyl peracetate; and 5% di-tert-butyl peroxide. Through extensive testing this mix was demonstrated to remove sufficient carbon given current industry cleaning practices on volume of chemical applied and application time, typically a minimum of 16 fluid ounces applied in 30 minutes or less, to remove a substantial amount of all the carbon types tested from the internal combustion engine.

Alternately, the foregoing preferred ATS 505CR mix family can be utilized as two mix families, namely: (1) ATS 505CR family A; and (2) ATS 505CR family B. The 505CR family A contains: 20-80% xylenes, 20-80% light hydrotreated naphtha, 0.2-20% octane, and 0.2-20% 2-ethylhexyl nitrate. The 505CR family B contains: 20-80% xylenes, 20-80% light hydrotreated naphtha, 0.2-20% tert-butyl peracetate, and 0.2-20% di-tert-butyl peroxide. With reference to the testing disclosed in connection with FIG. 8, ATS 505CR Mix A ("505CR A") is 45% xylenes, 45% light hydrotreated naphtha, 5% octane, and 5% 2-ethylhexyl nitrate; and ATS 505CR Mix B ("505CR B") is 45% xylenes, 45% light hydrotreated naphtha, 5% tert-butyl peracetate, and 5% di-tert-butyl peroxide. In use, for instance, the ATS 505CR A and 505CR B mixes would be directly injected sequentially through the entire induction system by the apparatus and methodology disclosed in the '016 application. This method will provide for a higher percentage carbon removal across all carbon types than a single stage delivery and will mitigate engine knock during induction cleaning. Additionally, such apparatus can deliver chemical mixes during engine crank, which can remove carbon deposits from the exhaust system.

Through testing the best mixes for use on carbon in diesel based engines are shown in FIG. 9 (again noting that DDI stands for Direct Diesel Injection). Diesel engines are based on compression ignition which presents an additional problem with carbon removal. The chemicals and chemical mixtures used for induction cleaning of gas engines knock during induction cleaning of diesel engines. This is true with the use of such apparatus as shown in '016 application, with both existing commercial products and the 505CR family of mixes. To address this problem, we developed the 505DCR mix, which works well across all diesel carbon types and reduces the knocking that occurs during induction cleaning on diesel based engines. The chemical/chemical mixture for carbon removal using THN as the base chemistry is formulated with; 20%-50% THN; 20%-50% TMP; and 20%-50% LHN. The preferred formulation for 505DCR is based on a base mix of Non-Specific Solvents, namely: 90% THN; 5% TMP; and 5% LHN. These were carefully selected for their ability to reduce knock while having a high carbon removal rate. This carbon removal rate can be seen by comparing the 505CR A-505CR B mixes against the 505DCR mix as shown in FIG. 9. The 505DCR mix can also be used on gasoline based engines as well. This is just one example where the chemicals selected by Applicants can be combined in many different configurations that produce outstanding carbon removing results compared to existing commercial product marked for carbon removal.

The ATS 505CR, and ATS 505DCR, mix/mix families result in an HMIS heath rating of (2). Furthermore, as of June, 2017, none of the utilized chemicals are currently listed on the California Proposition 65 regulation.

The ATS 505CR mix family and the ATS 505CR families A and B worked better than any commercially available induction cleaner that was tested. By way of comparison, in reference to FIG. 5A, a number of commercially available brands of induction and fuel tank cleaners that were chosen as being representative of the professional grade cleaners currently available on the market, namely: Wynn's; BG Products Inc.; Run-Rite; CRC Industries; 3M Fuel Additives; Justice Brothers; AC Delco; Seafoam; Berryman Fuel Additives; Lucas Oil Products; Chevron Techron; Gumout Fuel Additives; and NGEN Fuel Additives. Based on our testing the percentages of carbon removed, as also set forth in FIG. 5A, are: Wynn's Valve Injector Combustion Chamber Cleaner (V.I.C)=30% carbon removed; Wynn's Air Intake Cleaner=26% carbon removed; BG Air Intake System Cleaner 206=17% carbon removed; BG Fuel Injection System Cleaner 210=4% carbon removed; BG Induction System Cleaner 211=15% carbon removed; Run-Rite Fuel System Cleaner=42% carbon removed; Run-Rite Intake Cleaner=59% carbon removed; AC Delco Top Engine Cleaner X66P=15% carbon removed; CRC GDI Intake Valve Cleaner=65% carbon removed; CRC Top Engine Cleaner=31% carbon removed; and Justice Brothers Intake Air Cleaner=7% carbon removed. The specifics of the carbon tested are set forth below.

In contrast with the percentages set forth for the commercial products listed in FIG. 5A, FIG. 5B sets for the percentage of carbon removed by the ATS 505CR mix, namely 95%. By way of comparison with Non-Specific Solvents the following removal rates were obtained: xylenes=65% carbon removed; light hydrotreated naphtha=61% carbon removed; dipentene=60% carbon removed; tetrahydronaphthalene=75% carbon removed; decahydronaphthalene=67% carbon removed; octane=19% carbon removed; cyclohexane=33% carbon removed; bromobenzene=35% carbon removed; propylbenzene=29% carbon removed; and tributylamine=63% carbon removed. All these tests were performed on the same road vehicle carbon, as further discussed below.

As is apparent by the testing data listed in FIG. 5B, a single neat Non-Specific Solvent can remove more carbon than a commercial mixture. An example of this is to compare such commercially available mixtures as listed in FIG. 5A with those neat Non-Specific Solvents listed in FIG. 5B. Through testing it has become apparent that high percentages of Non Specific Solvents or Non Specific Solvent mixtures can remove substantial amounts of carbon. Furthermore, when a high percentage of a first Non Specific Solvent is used with a low percentage of a second Non-Specific Solvent (e.g., 95% THN, 5% IPN), the second can enhance the carbon removal rate of the first. Additionally, as discussed in greater detail above, when these Non-Specific Solvents are mixed at a 50/50 ratio the carbon removal rate is increased even further. Furthermore when these Non-Specific Solvents are mixed with a low percentage of Specific/Reactive Solvents, as also discussed in detail above, the carbon removal rate can increase yet even further.

With further reference to FIGS. 5A and 5B, all testing was done on the same carbon from the same road vehicle engine, with all other variables controlled equally for all testing. These test results are all based on using Audi turbocharged gasoline direct injection carbon. This carbon type did not exhibit chemical induced swelling and is an easier carbon type to remove than, for instance, Honda carbon. An example of this would be where the ATS 505CR removed 95% from the Audi GDI carbon, but only removed 78% of the Honda GPI carbon. If the carbon type is changed these numbers will change as well. With other carbon types that are harder to remove these numbers will drop regardless of the chemical/chemical mixture used. This will be seen with the testing results shown in FIG. 9. Additionally, if the chemical volume used is increased additional carbon would be removed. All bench testing results are done using a very low volume of chemical or chemical mixtures to carbon weight. This was to insure that the most effective chemical mixture is produce so that once the chemical mixture is used with a high volume rate within an engine, heavy carbon deposits can actually be removed.

It is clear from the test results that Applicants' preferred mixes work better than the mixes used by the major cleaning chemical manufacturers (as set forth in FIG. 5A) and also better than the pure individual ingredients (as set forth in FIG. 5B). See FIGS. 3A-3B and 4A-4B for chemical makeup of each manufactured carbon cleaning products, per the manufacturers' MSDS data.

With the commercial products set forth in FIG. 5A it might seem apparent that an increase in the percentage of carbon removal rate would be proportional to the chemical used. It was reasoned that if more volume of a particular product was applied to a particular carbon deposit more carbon would be removed. However, our testing demonstrated that this was not the case. It was observed that most of these commercial products tested would plateau at a given percentage (e.g., 30% in the case of Wynn's V.I.C.). This occurred even where there is no observed chemical induced swelling of the carbon. In fact if a carbon deposit was given three times the volume of the same chemical mix there would be no significant additional carbon removed. It also became apparent that once the portion of the carbon that can interact with a particular commercial product is removed from the carbon deposit there will not be additional carbon removed even with great volumes of the same mix. When swelling occurred a plateau in removal was also observed comparable to that discussed above with regard to Specific Solvents and Reactive Solvents when used without a Non-Specific Solvent base mix. As discussed above, swelling is a significant problem.

In contrast to the commercial products tested, it was observed through testing that if suitable oxygenated Specific and/or Reactive Solvents were used with Applicants' Non-Specific Solvents (e.g., XYL, LHN, DIP, THN, DHN, TOL, TMP AND SS) the carbon removal rate of such a mix would not plateau. To the contrary, the higher the volume of mixture that was applied the more carbon would be removed from the carbon deposit. It is believed this occurs when the removal rate from a Non-Specific Solvent (or mix thereof) is greater than the induced swelling rate of the carbon. In the ATS 505CR family of mixes the carbon removal rate does not plateau, but instead will continue to remove carbon from the carbon deposit with additional volumes of the mix being applied. This continued carbon removal occurs whether there is or there is not swelling of the carbon.

When the Non-Specific Solvents in the preferred formula of ATS 505CR are mixed together with the preferred Specific Solvents and/or Reactive Solvents the resultant mixture's ability to remove carbon deposits is enhanced as discussed above. With reference to FIG. 7, six different carbon types taken from the intake ports on the identified GPI and GDI engines were bench tested with respected some of Wynns commercially available induction cleaning products, which are believed to be a representative sample commercial products currently available in the market for induction cleaning. (After testing over 30 professional commercially available products, we observed that the Wynns (CS and New Foam) fall in the middle of the chemical to carbon removal rates of all chemicals tested.) These same carbon types were also tested with the preferred ATS 505CR mix under the same conditions. The accuracy of the testing results is +/−4%. It can clearly be seen that the ATS 505CR has higher carbon removal percentages across all carbon types. The ATS 505CR removal rate ranged from 35-90%, with an average of 60%. In contrast, the average removal rate for the various WYNNS products ranged from 26-33%, with an average of 30%.

With reference to FIG. 8, twelve different carbon types from the 12 different identified engines were bench tested with four manufacturers new GDI chemical mixes and both the ATS 505CR Mix A and ATS 505CR Mix B. All carbon samples for each test series (e.g., all tests run on the BMW GDI 178,000 Soft carbon) are from the same intake on the same engine. All other variables (e.g., temperature, method of applying the chemical/chemical mixture to the sample, controlling the volume of the chemical/chemical mixture delivered, weighing each sample before and after testing) were controlled equally. Each of the commercial products was delivered to the carbon deposit per the manufacture's recommended procedure. For example: the RunRite GDI was delivered in one continuous application; the CRC GDI was delivered in one continuous application; the WYNNS GDI Foam was delivered first in one continuous application and then was followed by the WYNNS Clean Sweep delivered in one continuous application (collectively identified in FIG. 8 as "WYNNS GDI"); and the B.G. Products GDI IVC was delivered first in one continuous application and was followed by the B.G. Products FI CCC delivered in one continuous application (collectively identified as "B.G. GDI"). The ATS 505CR Mix A was applied for 30 seconds, followed by a 30 second off time, followed by an application of ATS 505CR Mix B for 30 seconds, then followed by a 30 second off time, with this cycle repeated until the volume of both Mix A and Mix B was completely used. As indicated, the RunRite GDI and CRC GDI are one stage applications. The Wynns GDI, the B.G. GDI, and the ATS 505CR A and B are all two stage products. In all of the tests the total volume of carbon cleaning solution used was equal, with all other variables controlled equally as well. This chart best illustrates how different carbon types respond to the different formulations. It is clear that ATS 505CR Mix A and Mix B combination worked better across all carbon types than all other commercial products that were tested with an average carbon removal percentage of 73%. In contrast, the average carbon removal for the four commercial products ranged from 29-40%, with an average of 34%. Again, the accuracy of the testing results are within +/−4%.

It has been demonstrated through extensive testing that the ATS mixes that contain high ratios of Non-Specific Solvents (e.g., 50/50) with the right mix of Specific Solvent and/or Reactive Solvents are more effective at removing all types of internal combustion engine carbon than the Specific Solvents or Reactive Solvents used by the major induction cleaning chemical manufacturers.

In the prior art, including the commercially available induction chemical cleaning products, fuel tank additives, there is no known teaching of the Non-Specific Solvent base mix of the present invention, or the Specific Solvents and Reactive Solvents added to this base to form the preferred ATS 505CR mix, the ATS 505CR Mix A, the ATS 505CR Mix B, or the ranges of chemicals which contain these specific mixes (e.g., ATS 505CR family A). The specific chemicals listed herein and their beneficial effectiveness in removing carbon from road vehicle engines was determined from our experimentation. Other similar chemicals that also can undergo scission, decomposition into reactive fragments, or that have monopropellant properties may be substituted, so long as the base mix/Specific and/or Reactive Solvent mix has a melting temperature at or below expected ambient storage and use conditions, has a boiling and or decomposition temperature at or near the expected engine operating temperature, and is soluble/miscible at the desired percentages in the chosen Non-Specific Solvent base.

Regardless of how delivered to the induction system of an engine, the preferred ATS 505CR mix has been found to be very effective in removing the range of carbon types that have been tested from the engines they were accumulated in, even though they may temporarily induce light knocking in a running engine during a cleaning process. It has also been determined that the addition of anti-knock additives to the mix such as, but not limited to, 2,2,4-trimethylpentane (TMP), diethyl malonate (DEM) and tertiary-amyl methyl ether (TAME) will mitigate knocking. Based on our testing, we have determined that these chemicals (TMP, DEM, and TAME) also provide a good carbon removal rate. It is believed that this occurs because they are also very effective Non-Specific Solvents. As there are multiple chemicals known for their ability to limit knock produced from the fuels rapid burning rate that leads to engine knock, it is important to select such a chemical based on its ability to remove carbon as well as reduce engine knock.

Yet another way to mitigate knock during induction cleaning is to use a chemical base which produces a slower burn rate. THN is one such chemical as it has a slow burn rate which resists knocking within the engine. We have determined from our testing that THN also has a high carbon removal rate across many different road vehicle carbon types. When Specific Solvents and Reactive Solvents such as 2-EHN, TBP, DTBP, DTAP, TBPB, IPN, TBHP and NP are used with the THN base, they increase the effectiveness of the resulting chemical mixture to remove additional carbon. This can be seen in the testing results in FIG. 10, noting that for BMW GDI carbon THN alone removes 17% of the carbon while THN with 5% TBP removes 34%. Since the Specific Solvents and Reactive Solvents have a fast decomposition rate, in the absence of THN they would accelerate the burn rate which can lead to engine knock. Thus, THN, with a slower burn rate, can be mixed with these fast decomposing chemicals and have very little to no knock. Thus, THN is another preferred base.

In addition to Specific Solvents/Reactive Solvents as discussed above, THN also works well will many of the Non-Specific Solvents. This can be seen in FIG. 10. The THN chemical when used in the base solution is effective in the carbon removal process across many different carbon types, which makes it another preferred chemical to use as or in the chemical base for carbon removal for internal combustion engines. As can be seen from FIG. 9 the performance of 505DCR (which has a THN/Non-Specific Solvent base) is enhanced by the Non-Specific Solvents such as TMP and LHN as seen above in ¶[094]. Additionally, the ATS 505DCR burns well within the engine, which allows for a greater chemical delivery rate such as the preferred 6 to 9 GPH. This in turn allows for a high carbon removal rate.

Additionally, as set forth in the commonly owned '016 and '684 applications, not all prior art methods of delivering solutions intended for cleaning the induction system of an engine are effective in getting such a solution to where it is needed. Thus, in addition to having a chemical mix which will remove substantial amounts of such carbon deposits, it is highly desirable to have an effective mechanism for delivering such a chemical mix to the induction system, combustion chambers and exhaust system of a vehicle. The apparatus and methodology of the '016 application provides such an effective mechanism and, together with the preferred chemical/chemical mixes (discussed above) of the present invention, they provide a "one-two" punch for removing engine carbon. The apparatus and methodology of the '016 application/'606 A1 Pub. is applicable to the use of a single chemical mix or multiple chemical mixes.

As discussed in the '606 A1 Pub., getting the chemicals to the carbon sites can be very challenging. This is due to several problems that occur as discussed in detail in this application. For instance, the problem of the chemical/chemical mix hitting the closed throttle plate and impinging on it and then puddling in the induction system is discussed. Additionally it is shown that opening the throttle with a Wide Open Throttle (WOT) snap will help break up the puddling in the induction system and change the RPM during the induction cleaning process. This will allow the air column flowing into the engine to have greater energy which helps with the cleaning process. See, for instance, ¶¶[0071]-[0073] of the '606 A1 Pub. Further improvements to this apparatus and methodology are discussed below.

It has been determined through extensive testing on multiple running engines, that in some engines there is a tendency for the carbon cleaning solution that is sprayed from a nozzle in the form of an aerosol to condense into a bulk liquid and puddle in the induction system. As disclosed in the '016 application/'606 A1 Pub., the throttle will need to be opened multiple times during the cleaning period in order to limit this aerosol from puddling in the induction system. This method has not been recognized in the industry. Rather it is common practice to place a throttle stick (an expandable stick that is placed between the accelerator pedal and steering wheel) on the accelerator pedal in order to hold the throttle at a steady state during the cleaning process. The industry recommendation is a steady state Revolutions Per Minute (RPM), usually between 1200 and 1800. Through the Applicants' testing it has been determined that this practice of holding the throttle at a steady state will increase the degree to which the chemical mixture aerosol will puddle within the induction system and can further limit equal distribution within the engine.

It is also clear that if the chemical/chemical mixture aerosol directly hits the throttle plate it will impinge on the throttle plate creating large droplets that will not stay suspended within the air flowing through the induction system. Additionally, the use of an air bleed nozzle that by-passes the throttle plate, such as illustrated in FIG. 10 of the '606 A1 Pub, produces droplet sizes that are large and have a tendency to fall out of the air flowing into the engine. In either of these prior art delivery methods, this allows the chemical/chemical mix to puddle within the induction system. Additionally, these puddles will not have equal distribution within the induction system as the air flowing through the induction system can move these puddles along the induction system floor, whereby the chemical/chemical mix cleans the floor, but leaves the carbon on the port sides and top. This channel that is cut through the carbon on the induction floor during cleaning, can result in additional air turbulence that can decrease the power and fuel mileage from the engine after the cleaning as occurred. When carbon deposits are not equal in size/shape/distribution within the induction system the incoming air flow into the engine hits these non-uniform deposits and becomes turbulent/more turbulent. This turbulent or erratic air creates uneven cylinder volume filling, which directly affects the power output from the engine. The very reason for cleaning the induction system is to increase the power and fuel economy of the engine by removing the carbon deposits from the engine and, thus, limiting this turbulent air flow. However, with prior art cleaning methods, it is possible to actually make this turbulence worse by making the carbon deposits more non-uniform or cutting a channel through the carbon on the induction system floor. This decrease in power and economy from the engine, after the completion of the chemical carbon removal treatment of the engine, is a direct result of not keeping the chemical/chemical mixture suspended in the air flowing into the engine with equal distribution. During testing using prior art applicators, multiple vehicles that had chemical/chemical mixtures applied with such apparatus had performance problems from the carbon cleaning procedure. Four different vehicles lost between 1 to 3 miles per gallon in fuel economy. When we addressed this problem it was determined that the chemical/chemical mixture was falling out of the air flowing into the engine which, in turn, created non-uniformed carbon deposits. These non-uniformed deposits then increased the turbulence within the air flow which created cyclic variations in cylinder volume charge rates.

It has also been determined through our testing that one way to mitigate puddling in the induction system, and to accomplish more even distribution of the liquid chemical/chemical mix droplets that constitute the aerosol throughout the engine, is to have the throttle plate opened and closed during the cleaning process. This is true for both prior art products as well as prior art apparatus/methods of delivery (e.g., air bleed nozzle or oil burner nozzle). This is due to the high pressure differential that is created between atmosphere pressure and the induction system pressure when the throttle plate is closed on a running engine. When the throttle is opened the inrush of air into the induction system, due to this high pressure differential, is quite high. This inrush of air increases the volume and velocity of the air moving into the engine. Furthermore we have determined that, if the delivery system applies chemical/chemical mixtures during this throttle opening, the liquid droplets will have a much better chance to stay suspended in the air flowing into the engine. During a throttle opening this high volume/high velocity air will help to suspend the droplets in the moving air column. Additionally, this air inrush creates turbulence as it passes the throttle plate which helps mix the liquid droplets into the air which, in turn, helps keep them suspended within the air. This turbulent air helps pick up any of the chemical/chemical mixture that has puddled within the induction system and moves it back into the air stream. All of this helps to keep the chemical mixture in an aerosolized form that can be suspended within the air so that the cleaning mixture can be delivered to the carbon sites (e.g., the carbon contained on the intake port and intake valve).

In order for this turbulence to occur the chemical application will be timed with the opening of the throttle plate. As those skilled in the art should appreciate this can be accomplished in many different ways such as, but not limited to: using a pressure transducer to sense the pressure change as the throttle plate is opened; using an optical sensor to monitor the throttle plate movement; using a microphone to monitor the sound change of the throttle plate opening; using a potentiometer to monitor the throttle plate opening; using a tailpipe pressure sensor so as to determine the engine RPM increase, using a pressure sensor in the crankcase so as to determine the engine RPM increase; ignition discharge so as to determine the engine RPM increase; using an alert system such as lights to indicate to a service person when to open the throttle; and using a mechanical means where the throttle plate movement opens a valve which would allow the chemical mixture to be injected into the engine only when the throttle was opened.

Regardless of the method used the outcome is what is important. When the chemical/chemical mixture is delivered in conjunction with this throttle plate opening movement, the chemical mixture is carried by the air column moving into the engine at a much greater rate, thus mitigating puddling in the induction system, and creating far better distribution of the liquid droplets to all of the cylinders within the engine.

Figure 11:
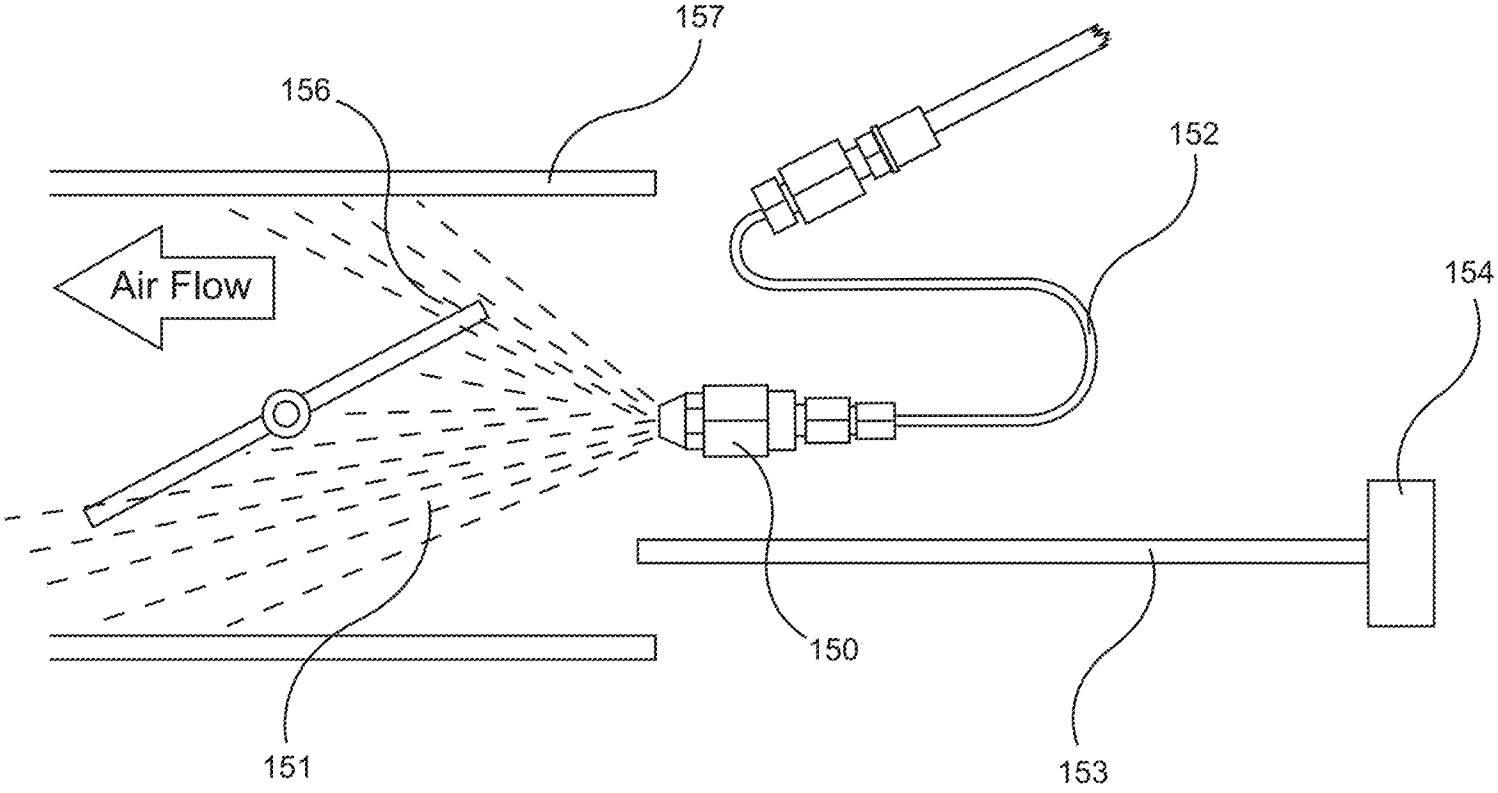
FIG. 11 illustrates one of the chemical delivery systems of the present invention that times the chemical/chemical mixture delivery with the throttle opening and with the injector in front of the throttle plate.
Figure 12:
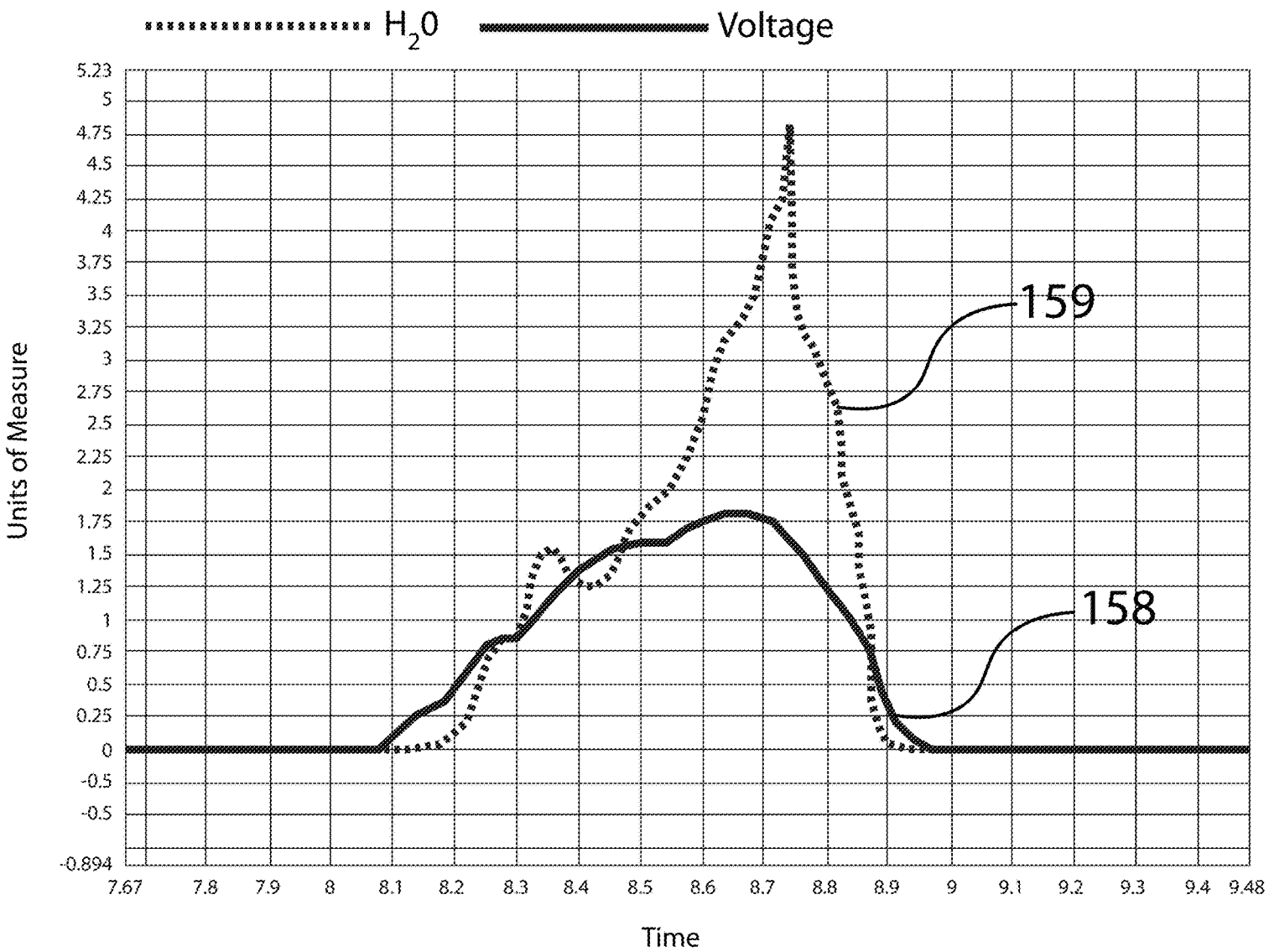
FIG. 12 illustrates the waveform produced form a Throttle Position Sensor (TPS) and a pressure transducer that is placed in the throttle housing.
Figure 18:
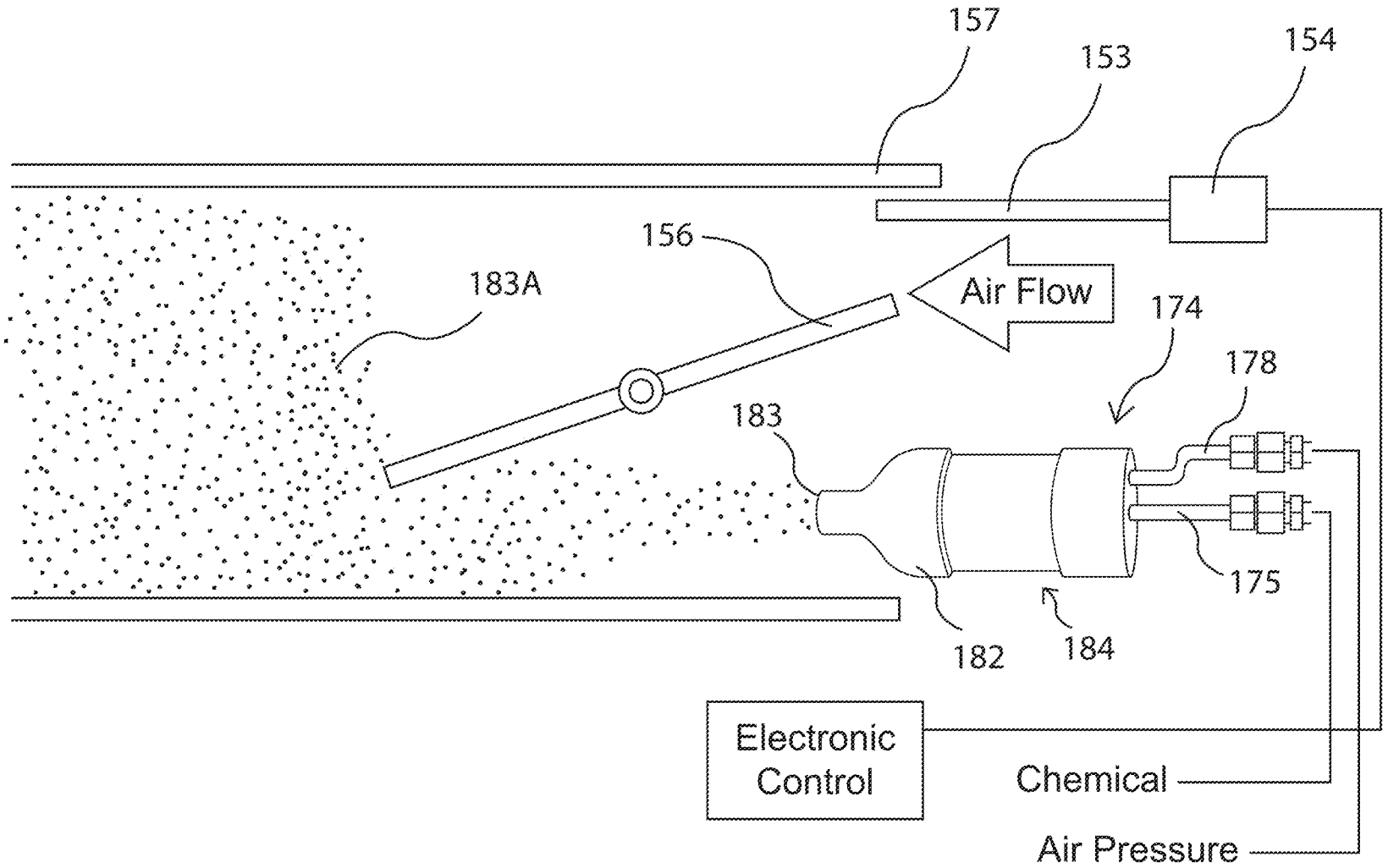
FIG. 18 illustrates the nozzle in FIG. 18 in use in front of the throttle plate.

As shown in FIG. 11 the current invention uses a pressure transducer 154 (that is calibrated in inches of water column) to monitor the pressure change within the throttle body 157. We feel this system is an easy, economical way to implement chemical delivery. Since the injector 150 (in this case a conventional hydraulic nozzle also referred to as an oil burner nozzle) is placed in front of the throttle plate 156, near or in the throttle housing 157, a pressure sensing tube 153 that is in communication with a pressure transducer 154 is place next to the injector 150. As is evident from FIG. 11, injector 150 is connected to a chemical/chemical mix source (not shown) via hose 152. As the throttle plate 156 is opening the pressure change in or by the throttle housing 157 is shown in FIG. 12, wherein the vertical axis is scaled for both voltage 158 and for inches of water 159, and the horizontal axis is time for both. Thus, FIG. 12 shows the voltage 158 produced from the throttle position sensor (potentiometer, not shown) as the throttle plate is opening and closing, and the pressure changes 159 based on the throttle plate movement, as measured by pressure transducer 154. The voltage output from the pressure transducer 154 is monitored by conventional microprocessor or electronics (as disclosed in the '606 A1 Pub., and as schematically illustrated in FIG. 18 noting that it does not show the pressure transducer circuit). When the microprocessor's program acknowledges that the throttle has been opened by the voltage rise produced from the pressure transducer 154, thus breaking a programed threshold, the injector 150 is commanded on, spraying chemical/chemical mixture aerosol 151. This, in turn, allows the mixture to be delivered into the engine.

Figure 13:
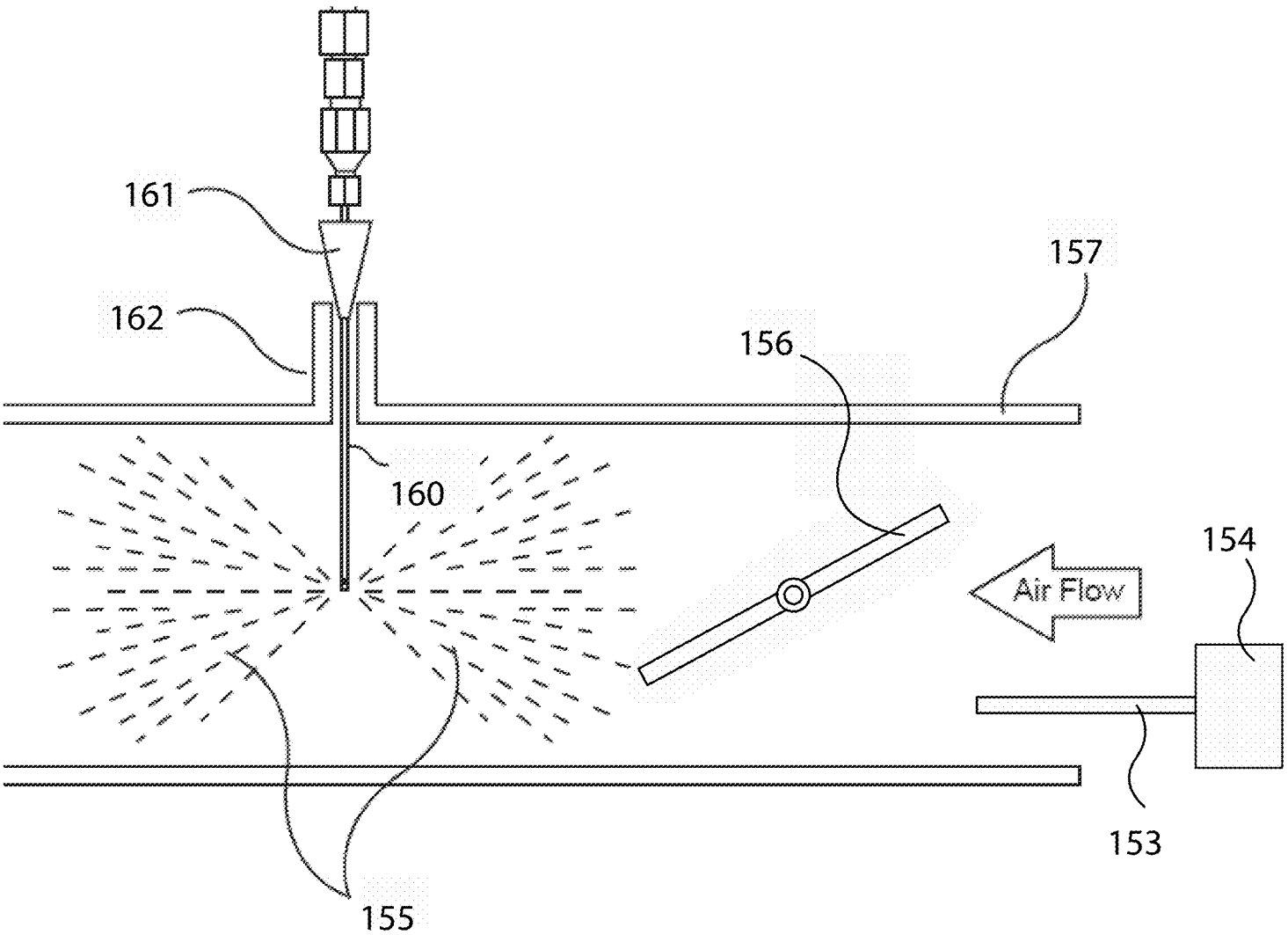
FIG. 13 illustrates an alternate chemical delivery system of the present invention that times the chemical/chemical mixture delivery with the throttle opening and with the injector behind the throttle plate.

Additionally, as shown in FIG. 13, the foregoing method of keeping the liquid droplets suspended can be implemented by the use of a nozzle as disclosed in the '606 A1 Pub. In this embodiment, after nozzle 160 is inserted into vacuum port 162 behind throttle plate 156 and sealed to port 162 with tapered seal 161, it sprays the chemical/chemical mixture 155 into the moving air column in throttle body 157 behind throttle plate 156. The delivery of aerosol is stilled timed with the opening of throttle plate, as discussed above in connection with FIG. 11.

Thus, this method of timed delivery can be implemented with the nozzle in front of the throttle plate or with the nozzle behind the throttle plate. This is because mixture impingement on the throttle plate is minimized regardless of whether the aerosol is injected in front of or behind the throttle plate. If the nozzle 150 is used in front of throttle plate 156 and only delivers chemical/chemical mixtures aerosol when the throttle plate 156 is opening, the inrushing air moves the cone shaped aerosol around the throttle plate. See FIG. 11. Otherwise the aerosol would directly hit a closed throttle plate, which would otherwise cause impingement. Instead, the aerosol is injected through the throttle plate opening which, in turn, reduces impingement of the droplets on the throttle plate.

We have also determined that a much larger injector flow rate than commonly used in the industry is achievable and desirable. While commonly used prior art injector flow rates are between 1 to 1.5 Gallons Per Hour (GPH), with our apparatus and methodology the preferred injector flow rate is 6 to 9 GPH with a 45 degree hollow cone from oil burner nozzle 150 (or equivalent). This chemical/chemical mixture spray pattern is hollow in the center and will help mitigate such pattern from directly hitting the throttle plate. Additionally it has been determined that when an increased volume of chemical/chemical mixture is used (e.g., 6 to 9 GPH) far more carbon can be removed. Further, with this increased chemical volume the delivery is pulsed on and off. This controls the chemical delivery rate so the engine can run during cleaning without stalling. When the chemical/chemical mix aerosol is injected in front of the throttle plate, the throttle plate is opened and closed between 1200 RPM and 3000 RPM. When the microprocessor (not shown) acknowledges that the throttle plate has been opened the injector (e.g., 150) is commanded on for 1.5 seconds. This allows the injector to deliver the aerosol at the high rate of volume discussed above when the throttle plate is open. This, in turn, allows the droplet mixture to be delivered when the air column (both speed and turbulence) moving into the engine is optimal. Thus, the increased amount of the droplet mixture delivered from a high volume injector can stay suspended in the moving air column until it reaches the intake ports and intake valves, thereby increasing the carbon removal rate of these components.

In order to not inject to much chemical/chemical mixture to the engine the preferred method is to turn the injector (e.g., 150) on every throttle opening for eight throttle sequential openings. Then the injector is turned off for a pause period of, preferably, 30 seconds. This is to allow the exhaust components, such as but not limited to, the catalytic converter and turbocharger time to cool down. This also allows the delivered liquid droplets time to soak the carbon deposit, thus allowing enough time for such droplets to start to interact with the carbon deposit. During this injector off time an alert lamp (such as disclosed in '606 A1, noting ¶[0065]) can be used to indicate to the service personal to allow the engine to idle. When the preferred wait time of 30 seconds is up, an alert lamp indicates to the service personal to rev the engine between the preferred engine RPM's of 1200 RPM and 3000 RPM. The droplets are once again delivered for eight throttle openings, followed by another pause period where the injector is turned off for the preferred 30 second pause period. This cycle is repeated until the recommended chemistry volume of carbon cleaning solution is totally used.

The foregoing method can be used with a single chemical/chemical mixture, or with multiple mixtures such as, but not limited to, 505CR chemical A and 505CR chemical B. In the case of using multiple chemicals/chemical mixtures, the two chemistries will be alternated between chemical A for eight throttle openings, then the preferred 30 second pause period, and then chemical B for eight throttle openings, and another pause period for 30 seconds. This cycle will be repeated until both chemistry volumes are totally used.

Figure 14:
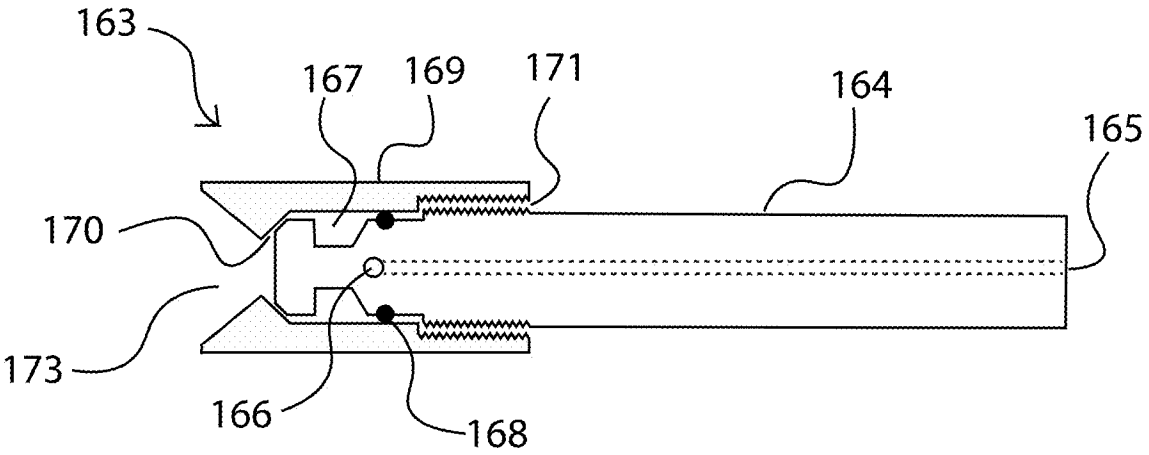
FIG. 14 illustrates a nozzle design of the present invention that allows the nozzle to be place in front of the throttle plate or behind the throttle plate.
Figure 15:
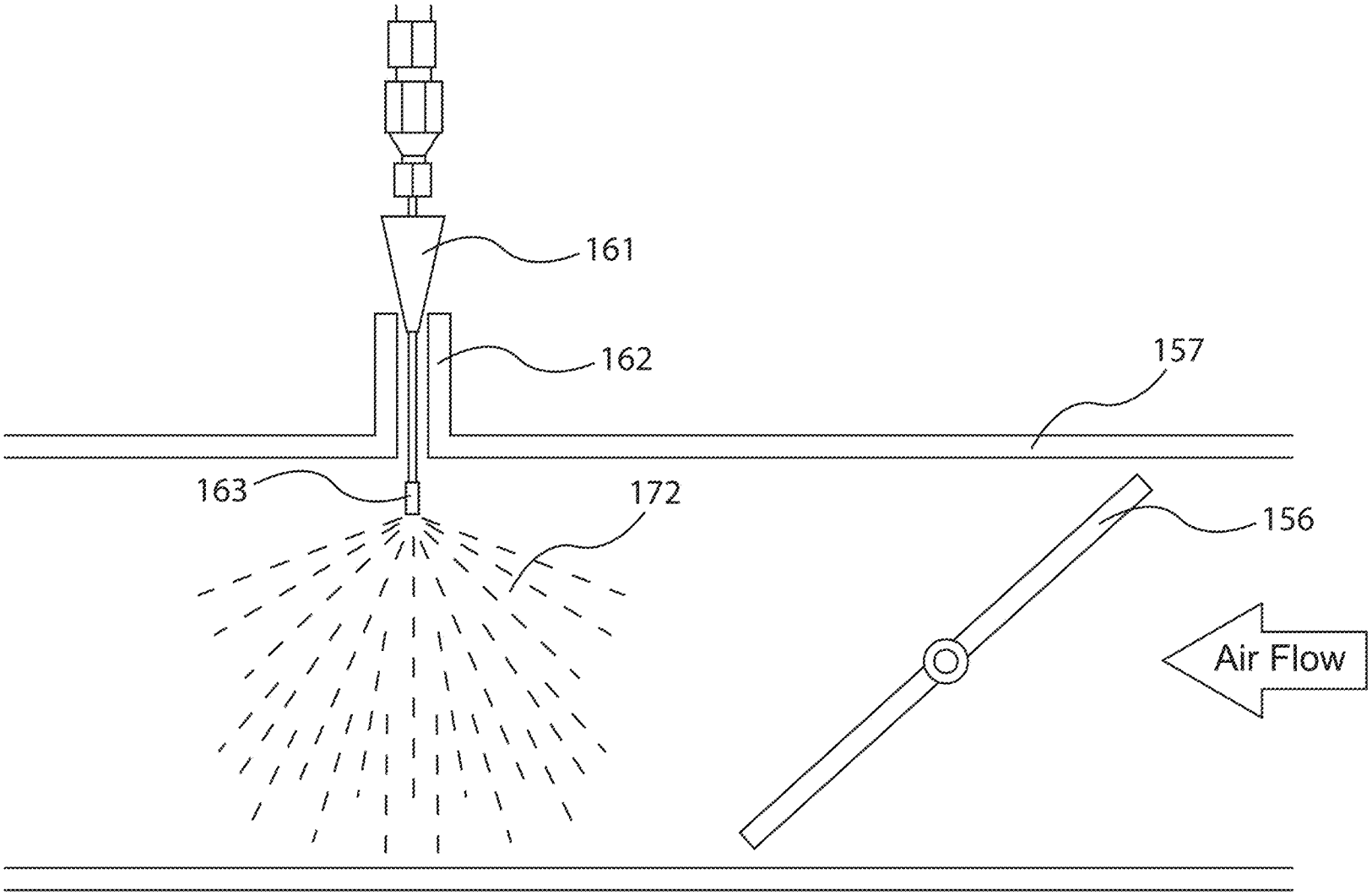
FIG. 15 illustrates the nozzle in FIG. 15 in use behind the throttle plate.
Figure 16:
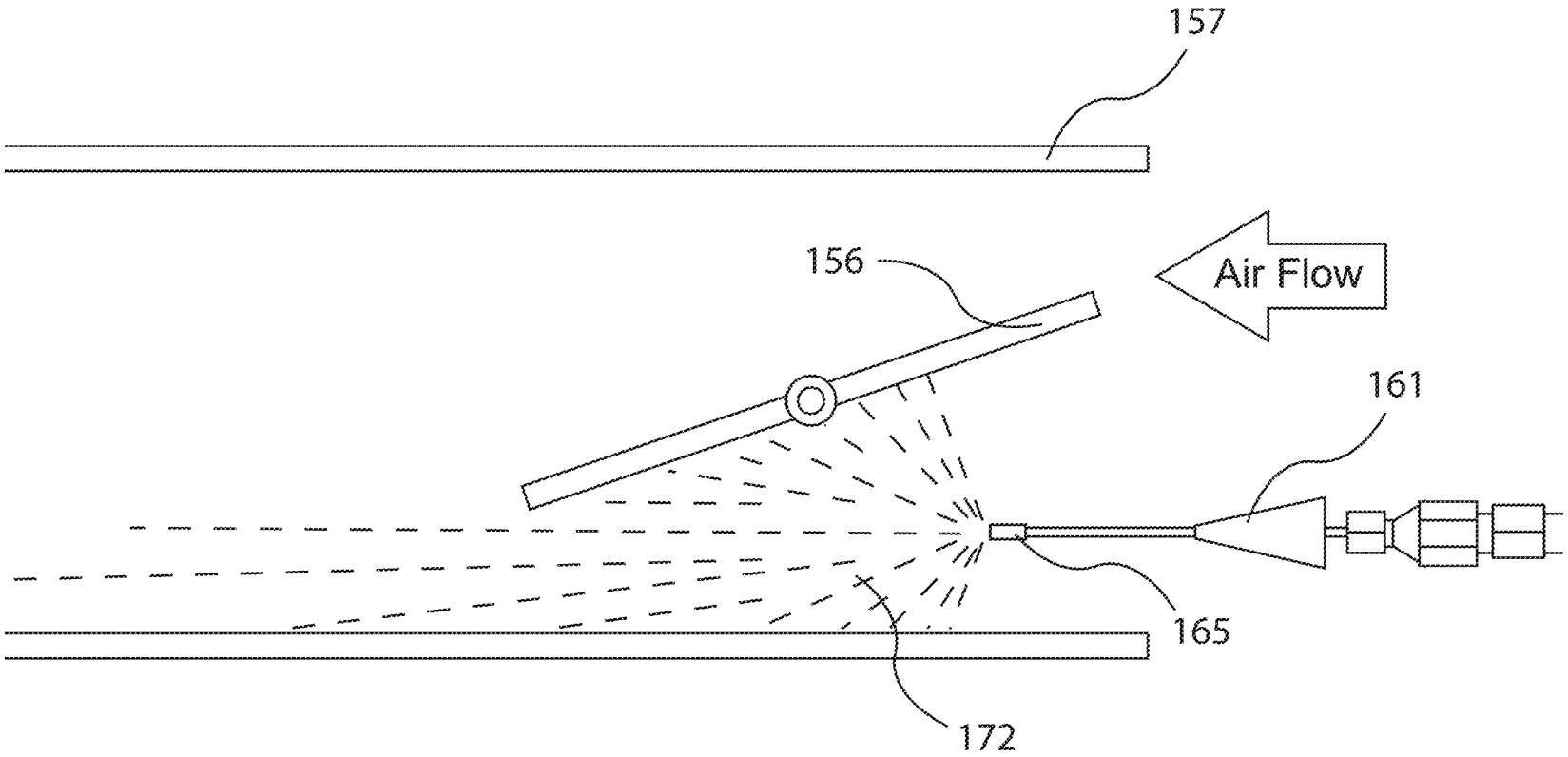
FIG. 16 illustrates the nozzle in FIG. 15 in use in front of the throttle plate.

Another nozzle design for induction cleaning is shown in FIG. 14. Nozzle 163 is that of a hydraulic style designed so it can be used through an access port 162 behind the throttle plate into the interior of the induction system as illustrated in FIG. 15, or be used directly in front of the throttle plate as shown in FIG. 16. This diversity is needed so when a vacuum port is not accessible the nozzle can be used in front of the throttle plate. When this hydraulic nozzle is used behind the throttle plate it is preferred to have the nozzle inserted into the induction opening as shown in FIG. 15. However this nozzle will still provide chemical/chemical mixture delivery into the induction system if it is not completely inside the induction system. For example this nozzle can be installed above a vacuum port or induction opening (not shown). This nozzle is supplied with chemicals/chemical mixes by apparatus such as illustrated and described in the '016 application. With reference to FIG. 14 nozzle body 164 has fluid passage 165 which connects to cross drilled passage 166. Nozzle body 164 is connected to a pressurized source of, for instance, ATS 505CR, not shown. Cross drilled passage 166 allows the pressurized carbon cleaning liquid to fill cavity 167. Pressurized liquid is sealed from leakage at one end of cover 169 by O-ring 168 so that it is forced to exit through restriction 170. Restriction 170 is adjustable by threads 171 that are on nozzle body 164 and nozzle cover 169. The restriction at 170 is set up by the distance between nozzle cover 169 and nozzle body 164. As the fluid pressure drops across restriction orifice 170 a fine spray 172 (shown in FIGS. 15 and 16) is discharged from nozzle 163 out nozzle end 173. This spray is then directed into the engine to clean the induction system. As is evident from FIG. 16, some of spray 172 will impinge on throttle plate 156. However, this impingement is mitigated by the sudden inrush of air as throttle plate is opened from its idle position (such as shown in FIG. 15) to the open position illustrated in FIG. 16. This inrush would tend to both bend the spray around throttle plate 156 and move any droplets which did impinge along the surface of the plate and back into the air stream.

Figure 17:
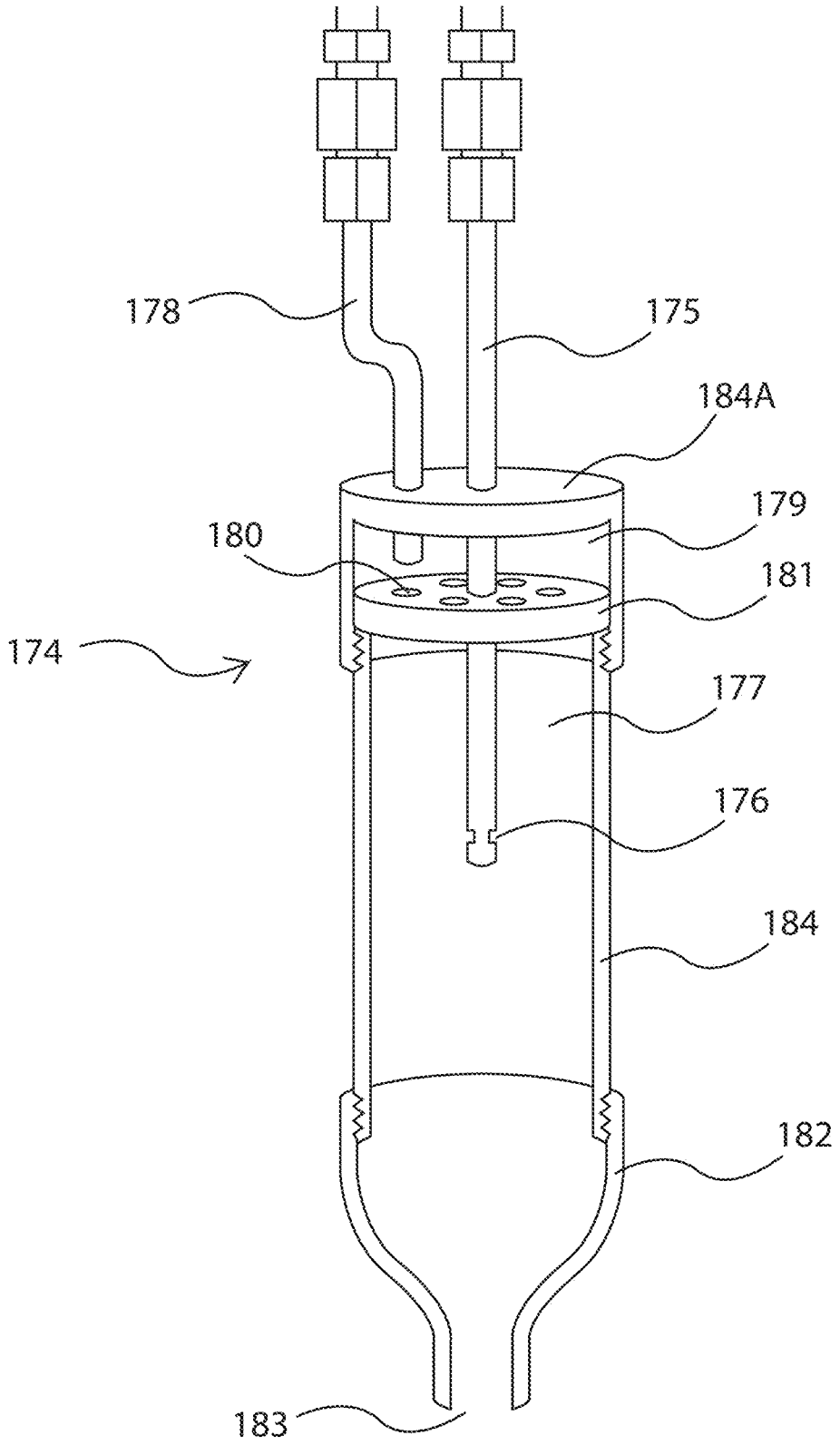
FIG. 17 illustrates a preferred embodiment for a nozzle, which is an air assist nozzle design for applying chemical/chemical mixtures to the internal combustion engine.

Yet another nozzle design is shown in FIG. 17, and is the overall preferred nozzle for delivering an aerosol spray of a chemical/chemical mixture (whether one disclosed in the prior art such as B.G. Products Induction System Cleaner 211, or those of the present invention) to an internal combustion engine. Nozzle 174 includes cover 182, nozzle body 184, and cap 184A. The interior is divided into mixing chamber 177 and air chamber 179 by plate 181. In operation, the liquid chemical/chemical mix under pressure is force through nozzle tube 175 and exits out restriction orifices 176 into chamber 177. (Apparatus of delivering the liquid mix under pressure is disclosed in '606 A1, noting FIG. 4 and reservoir 4, $CO_2$ cartridge 8, pressure regulator 5 and pressure gauge 7.) As the liquid under pressure is force through restriction 176 a pressure drop takes place whereby it changes from a high pressure liquid to a low pressure one. At the same time compressed air (or another compressed gas such as but not limited to $CO_2$ or $N_2$) flows from air pressure line 178 which in turn fills air chamber 179 and is then directed through air direction holes 180 in air plate 181 and on into mixing chamber 177. The air direction holes 180 direct the pressurized air, having the necessary volume and air velocity around nozzle tube 175. In turn the liquid being discharged out nozzle restriction 176 is redirected by the directional air flow. This moving air flow mixes the chemical/chemical mix with the air where it forms small liquid droplets, which droplets are then forced out nozzle opening 183 in nozzle cover 182.

These small liquid droplets are based, in part, on the chemical/chemical mixture flash point. With the chemical/chemical mixtures flash point accurately identified, it has been determined that these droplets can be smaller than, approximately, 125 microns. This small size allows the droplets to stay suspended in the moving air column into the engine. The air assist nozzle produces a discharge of a gas/chemical mixture in the form of fine liquid chemical droplets propelled by the gas volume flowing out the nozzle opening. Once the small droplets are delivered into the engine, they are driven by the moving air and will impinge all-round the interior of the induction system. These small droplets will also combine with other droplets, become larger and thus will be able to wet and remove carbon deposits throughout the induction system.

Nozzle cover 182 is threaded on to nozzle body 184 so it can be quickly changed for different hose sizes and induction system configurations. These different connection hoses can be attached to different sizes of vacuum ports or induction openings on the induction system. This allows the small liquid droplets 183A (shown in FIGS. 18 and 19) to be forced through a vacuum port or induction opening with velocity and volume. This can be done with the engine cranking or with the engine running. The air pressure (or gas pressure) to air line 178 can be adjusted (by, for instance, a pressure regulator, not shown) which will change the liquid droplet size to create the correct droplet size for the chemical/chemical mixture that will be used. If the chemical/chemical mixture has a high flash point the droplet size can be made smaller by increasing the air pressure. If the chemical mixture has a lower vapor point the chemical droplet size can be made bigger by decreasing the air pressure. Preferably the vacuum port that will be used is one that is in a centralized location, such as the positive crankcase ventilation port or fuel purge valve port which is located behind the throttle plate and sealed to the nozzle so during an induction cleaning the engine will run well. As no sensors are removed or disconnected from the engine control system during the cleaning process no DTC will be set in the control unit for the engine. This will make it easier for the service personal to complete the cleaning procedure. Regardless of the port type or configuration, the air pressure will be set so that it will push the mixture through it with the requisite velocity and volume, which in turn will keep the air/chemical mixture in the form of small droplets as it exits the port. It has been determined that even if the induction port has a difficult entry or exit that the high pressure air will carry the chemical/chemical mix into the engine with a fine particle size. This will allow the chemical/chemical mix to stay suspended within the air moving into the engine.

Additionally the pressure on the liquid chemical/chemical mix can be changed as well. This will allow the chemical delivery volume to be increased or decreased. For example, this is very useful as it permits increasing delivery volume when cleaning an 8 cylinder engine, and decreasing the delivery volume when cleaning a 4 cylinder engine. With this style of nozzle, whether used in front of the throttle plate or used behind the throttle plate, it has been determined that if an increased chemical/chemical mixture is used (the preferred 6 to 9 GPH) far more carbon can be removed. This allows the carbon to be soaked with liquid chemical where the carbon can be solubilized and move into the carbon cleaning fluid. If the chemical was allowed to just flow at this high volume rate the engine would run poorly and or stall. So with high chemical volume rates it is necessary for the chemical/chemical mixture delivery to be pulsed on and off. This on and off volume flow rate is accomplished with electric solenoid(s) that are control with an electric circuit or microprocessor as illustrated in the '016 application. These solenoid(s) control the chemical delivery so the engine can run during cleaning. The preferred method is to turn the chemical delivery on for 2 seconds and off for 3 seconds, and then back on for 2 seconds and then off for 3 seconds. This cycle is repeated for 8 pulses and then a 30 second soaking pause period is given. The soak period allows the chemical/chemical mixture additional time to interact with the carbon deposits, which in turn helps with the remove of the carbon deposit. This pause period also helps with controlling the exhaust components temperatures. After the preferred soaking pause time the cycle is started again. If multiple chemical/chemical mixes are used, after the pause period the next chemical/chemical mix is used. These chemical/chemical mixes will be cycled repeatedly until the recommended chemistry volume of carbon cleaning solution is totally used.

The overall instantaneous volumetric flow rate of chemical/chemical mix applied into an internal combustion engine while it is running is preferred to be approximately 6-9 gallons per hour (GPH). This is set at a steady state constant volumetric flow rate, which equates into 768-1152 ounces per hour, or 12.8-19.2 ounces per minute. However, we have determined that if a chemical/chemical mix is applied to an engine at these rates for too long, the engine would most likely stall. Therefore the instantaneous volumetric flow rate needs to be changed to a time averaged volumetric flow rate during the chemical application. This can be accomplished in many different ways. Where a single chemical/chemical mix is used, the preferred method is to introduce the chemical at the preferred instantaneous volumetric flow rate but intermittently stop and start the chemical flow, thus changing the time averaged volumetric flow rate per minute. This preferred method is one where the chemical flow is turned on for 1 to 1.5 seconds and then stopped for 3 seconds, then turned on for 1 to 1.5 seconds, and then turned off again for 3 seconds. This cycle is repeated four times and then a longer pause time where no chemical is applied for 10 seconds is added to the chemical/non-chemical delivery sequence. After this 10 second pause the on-off-on-off cycle is repeated again and then a longer pause time, where no chemical is delivered, of 20 seconds is added (e.g. 4 chemical pulses-10 second no chemical pause-4 chemical pulses-20 second no chemical pause-4 chemical pulses-10 second no chemical pause-4 chemical pulses-20 second no chemical pause). These cycles will repeat until the total amount of chemical (e.g., 32 oz.) is totally consumed. If two different chemicals/chemical mixes are used the preferred method is where the first chemical/first chemical mix is delivered in the first eight pluses (four pulses-10 second no chemical pause-four pulse) followed by a pause period of 20 seconds. Then the second chemical/second chemical mix is applied for the next eight pulses (four pulses-10 second no chemical pause-four pulse). This is followed by another pause of 20 seconds where no chemical is applied; another eight pulse sequence of the first chemical/first chemical mix; another 20 second pause; and then another eight pulse sequence of the second chemical/second chemical mix is applied. This cycle is repeated until all the chemical/chemical mixes are consumed (e.g., 32 oz.).

Another way to limit the chemical/chemical mix application would be to alternately slow and increase the instantaneous volumetric flow rate of the chemical/chemical mix without stopping the chemical flow. There are several ways in which this can be accomplished. One method would be to have a chemical source connected to a nozzle by a pressure regulating apparatus. By changing the applied chemical pressure the instantaneous volumetric flow rate could be changed without stopping the flow of the chemical. A low pressure applies a low instantaneous volumetric flow rate, while a high pressure applies a high instantaneous volumetric flow rate. This method could be accomplished using one or two nozzles. Using two nozzles helps keeps the droplets of chemical optimized for both applied pressures, however one nozzle could be utilized. Whether one or two nozzles are used the chemical/chemical mix would be continuously applied into the engine with the low flow rate while a burst of a high flow rate would be applied for a short period of time. Alternately, by changing the nozzle aperture or restriction the instantaneous volumetric flow rate could be changed without stopping the flow of chemical. These methods, by way of example but not limitation, would provide the same or similar results as the on off method. These methods work with an instantaneous volumetric flow rate at least 3 GPH and a second instantaneous volumetric flow rate less than the first high volumetric flow rate. During testing the method included the use of a reservoir with low pressure chemical/chemical mix and a reservoir with high pressure chemical/chemical mix. The high instantaneous volumetric flow rate was set at 9 GPH, the low instantaneous volumetric flow rate was set at 0.5 GPH. The low flow rate ran continuously and the high flow rate turned on in bursts. This changes the time averaged volumetric flow rate applied into the engine. The time sequence was set similar to the time sequence for the pause method discussed above. The delivery apparatus uses electronics that are programmed to automatically run a run profile which includes a chemical/chemical mix delivery at a high flow rate greater than 3 GPH (preferably 9 GPH), a chemistry delivery at a low flow rate less than the high flow rate (preferably 0.5 GPH), a chemistry delivery at a high flow rate greater than 3 GPH, a chemistry delivery at a low flow rate less than the high flow rate, and repeating this cycle until all of the chemical/chemical mix to be applied to the induction system is consumed. In this testing the chemical/chemical mix did not stop its flow into the engines induction system, but instead slowed and increased the instantaneous volumetric flow rate. With this type delivery the end result is a higher instantaneous volumetric flow rate, which allows a greater amount of chemical/chemical mix to be carried by the air flow into the engines valve pocket area, where it can remove a greater amount of carbon while still maintaining the engines ability to run. Run profiles are discussed in greater detail in the 606 A1 Pub, particularly paragraphs [0069], [0070], [0090], [0091] and the associated drawings, particularly FIGS. 24, 25A and 25B. Again, this disclosure is incorporated by reference.

The preferred nozzles' available instantaneous volumetric flow rate is 9.5 GPH. That is at an overall instantaneous volumetric flow rate. However, as discuss above the flow rate is not constant, but is sequentially turned on and off. By turning the flow rate on and off this changes the overall chemical/chemical mix applied into the engine over time. This equates into a lower chemical/chemical mix delivered over time (e.g. on-off-on-off) as compared with the overall instantaneous volumetric flow rate delivered over time (e.g. continuous). Thus, the time averaged gallons per hour that are delivered into the engine will be far less than the total available instantaneous volumetric flow rate of 9.5 GPH. The preferred time averaged chemical flow rate that is put into the engine is approximately 1.0-4 GPH. It has been determined through testing with cameras inside the induction system while the engine is running that when a burst (a high instantaneous volumetric flow rate for a finite time period) of chemical is applied the chemical has a greater propensity to be carried by the air flow into the intake valve pocket area where it can remove carbon deposits. This chemical burst puts so much chemical into the engine at once that the entire air column moving through the engine is filled with chemical droplets. This enables the chemical to be carried and very evenly distributed throughout the induction system. Additionally since the time averaged volumetric flow rate is sufficiently low the engine will continue to run without stalling. This burst technology permits the removal of more carbon via a high instantaneous volumetric chemical flow rate applied during the carbon removal procedure to enhance liquid delivery and droplet distribution throughout the induction system while enabling the engine to continue to run relative well without stalling. The burst technology method is superior to prior art for removing carbon from the internal combustion engine.

The instantaneous volumetric flow rate can also be lower than the preferred 6-9 GPH while still removing more carbon than the industry standard instantaneous volumetric flow rate of 1 to 1.5 GPH. For example, through testing it has been determined that doubling the industry standard so that the instantaneous volumetric flow rate is 3 GPH will increase the carbon removal rate. Additionally, if the chemical/chemical mixture is engineered to burn well within the combustion chamber the engine can run well. These volumetric flow rates are given for the automotive style engine, (e.g. approximate liter size range of 1.0 to 6.5). If larger liter size engine are to be cleaned the instantaneous volumetric flow rate will be increased.

It is important to realize that the volumetric flow rates into the engine will change based on the chemical/chemical mix that will be used. With some chemical/chemical mixes the volumetric flow rate into the engine can be higher, and with some chemical/chemical mixes the volumetric flow rate into the engine must be lower. This is based on how well the chemical/chemical mix combusts and burns within the combustion chamber. In order to best utilize the burst method the chemical/chemical mix should be designed to combust efficiently under normal engine operating conditions so that high volumetric chemical flow rates can be used. If the chemical/chemical mix is not very combustible the engine will run poorly and/or most likely stall.

It has also been determined through testing that the total amount of carbon removed can be increased if the volumetric flow rates are set based upon the size of the engine to be cleaned. This is because as the engine size changes (engine displacement) the total air volume moving through the engine will be different as well. With these different air flow rates moving into the engine the chemical delivery rates should be adjusted to match the engine liter size or number of engine cylinders. This allows the interior of the induction system to remain wet with liquid, which testing has shown is a requirement for carbon removal. Thus, adjusting the time averaged volumetric flow rate based upon engine size, or cylinder number, is preferable in order to maintain optimal carbon removal.

The preferred method to set the time averaged volumetric flow rates based on the number of cylinders that the engine has is using a 3 position electric switch. The electronics of the chemical delivery apparatus monitor the switch position and will change the volumetric flow rate into the engine based on the number of cylinders that the service personal sets the switch to. The preferred method is to indicate the number of cylinders next to the switch such as; 3-4 cylinders, 5-6 cylinders, 8-10 cylinders. When the number of cylinders selected changes, the time averaged volumetric flow rate delivered into the engine will change as well. The more cylinders the engine has the more chemical should be delivered. Since the volumetric flow rate is applied to a central location in the induction system, the chemical/chemical mix is divided by the number of cylinders. Thus, the greater number of cylinders the more chemical/chemical mix is delivered into the engine so that the induction system is similarly wet with liquid chemical regardless of engine size. The preferred method to accomplish this is where the chemical on time is change to deliver more or less chemical to the running engine (e.g. 3-4 cylinders=1 second of chemical on time, 5-6 cylinders=1.25 seconds of chemical on time, 8-10 cylinders=1.5 second of chemical on time). The nozzle flow rate, the applied pressure, and the solenoid on time will set the chemical instantaneous volumetric flow rate into the engine. However, any one of these could be used to change the instantaneous volumetric flow rate. The preferred method is to change the solenoid on time.

It has been determined through testing that another way to get a higher carbon removal rate is to use a higher total volume of chemical/chemical mix. The preferred method is to add a third chemical/chemical mix. This will increase the total amount of chemical used from 32 oz. during the cleaning process to 48 oz. (16 oz. first chemical, 16 oz. second chemical, and 16 oz. third chemical) during the cleaning process. First chemical/chemical mix and second chemical/chemical mix will be alternated until all of these two chemicals/chemical mixes are consumed. Then the third chemical/chemical mix will be applied until all of this chemical/mix is consumed. This is advantageous because there is a greater total volume of chemical allowing for a higher volumetric chemical flow rate over a longer period. Thus, there is more time over the entire cleaning procedure for the chemicals/chemical mixes to interact with the carbon. Also, the third chemical mix is a different chemical mix from the first chemical/chemical mix and the second chemical/chemical mix. This allows the third chemical mix to be formulated specifically so that it removes the carbon that is left from the first chemical/chemical mix and the second chemical/chemical mix, thus producing greater total carbon removal.

Because liquid chemicals have the ability to turn to vapor and the tendency to do so increases with, among other things, increased temperature, if the starting temperature of the liquid is lower it may remain liquid for a longer time period in the running engine, for example, particularly in a hot engine (180 F to 230 F) and/or a hot ambient day (60 F to 115 F). It has been determined through testing that if the chemical/chemical mix is cooled there will be more liquid chemical delivered to the carbon deposits. The preferred method is to cool the chemical/chemical mix to approximately 30 F to 40 F prior to use. The preferred method of cooling is refrigeration though other methods such as ice or dry ice may also be used. This allows the chemical/chemical mix to be applied into the engine cold which, in turn, allows for more of such chemical/chemical mix to stay liquid for a longer time in the running engine. Because carbon is only removed by liquid chemicals, if the chemical is applied cold there will be more liquid chemical available providing for a greater carbon removal.

Further testing included placing cameras on the inside of induction systems (e.g., the induction system of a Ford V8 with a scroll style induction system) and filming what the chemical/chemical mix droplets do as they enter the induction system, and then what occurs to them as the droplets move through the induction system. It was observed that when these liquid particles are forced into the induction system under high velocity and high flow volume, with a nozzle such as the air assist nozzle of FIG. 17, the liquid droplets tend to remain suspended within the air flow that is moving into the engine. This is true even if the throttle is held steady with a throttle stick. As nozzle 174 creates high velocity with high volume flow rates from the discharge of nozzle end 183, the discharge spray 183A will comprise a large air volume with a fine or small particle size of liquid chemical droplets suspended within it. This creates an air/mixture where the droplets stay suspended in the air flowing into the engine. As the air/chemical mixture moves through the induction system the chemical droplets will impact on the induction system walls at different locations. The air moving through the induction system will push these droplets along the intake walls where they will combine with other small chemical droplets. Thus, these droplets become bigger as they are moved along the inside of the intake by the moving air flow. If carbon is present the droplets soak the carbon deposits that are attached to the intake walls. If no carbon is present the droplets are driven along the intake walls by the moving air through the induction system and into the intake port areas. Additionally, some of these droplets break free of the intake walls and are caught and re-suspended by the air flow moving through the engine. These re-suspended droplets are then moved with the air until they impact the intake port areas and intake valves, thus helping to clean them.

Figure 19:
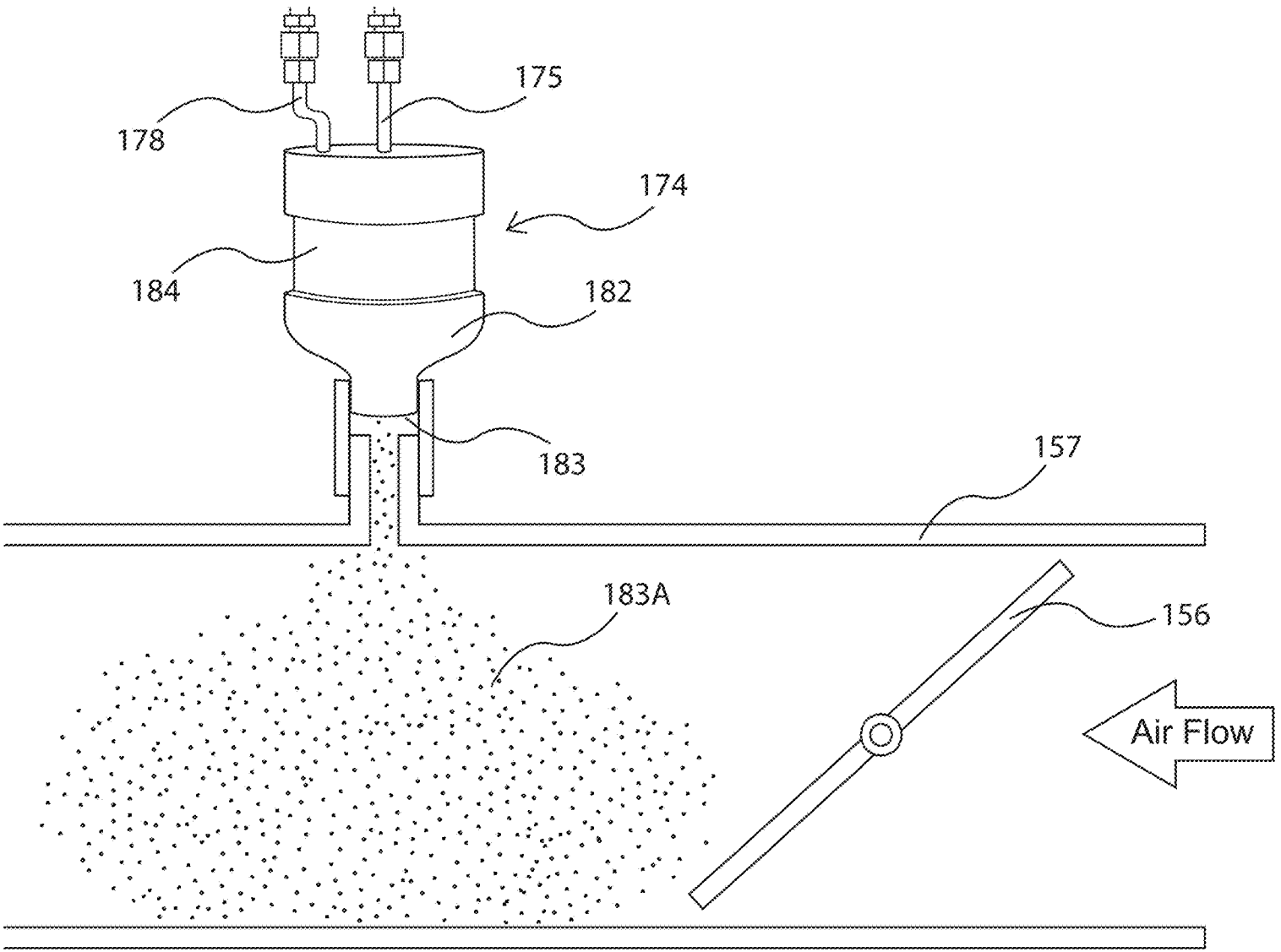
FIG. 19 illustrates the nozzle in FIG. 18 in use in the preferred method of applying the chemical/chemical mixture behind the throttle plate.

Nozzle 174 can be used in front of the throttle plate as shown in FIG. 18, or behind the throttle plate as shown in FIG. 19. If used in front the preferred method is to inject the chemical mixture when the throttle plate is opening as previously discussed. In either position, in front of or behind the throttle plate, the air velocity and air volume keeps the chemical droplets suspended in the engines air flow. It generally is preferred to use nozzle 174 behind the throttle plate so the throttle plate cannot restrict the air/chemical droplet flow from nozzle opening 183. It has been observed that when nozzle 174 is used behind the throttle, as shown in FIG. 19, that the injected mix has the best opportunity to have the droplets evenly distributed to all cylinders within the engine. It was also observed that when nozzle 174 is used in this configuration, chemical/chemical mixture droplets could be consistently delivered to the intake valve pocket even on difficult scroll style induction systems, including hard areas to reach such as the top port area above the intake valve.

Additionally, when nozzle 174 is used behind the throttle plate and the chemical mixture is one that is combustible, the mixture acts as a fuel, which when mixed with the pressurized air creates a combustible mixture that burns within the cylinders. This insures the carbon that was removed during the cleaning process will be burned within the combustion chamber. Additionally, the mixture being combustible allows the engine to rev (increases crankshaft rotational speed) without opening the throttle. This increase of engine RPM helps the engine to pump more air, thus increasing the volume of air moving through the engine. This, in turn, helps to limit the chemical from puddling in the induction system even when a throttle stick is used. When used with a throttle stick a service person will not have to open and close the throttle plate during an engine carbon cleaning procedure. (With prior art techniques and prior art chemical/chemical mixes, where no service personnel is available to open and close the throttle, the use of a throttle stick would not have these benefits.)

The 174 type nozzle also works well where there is no throttle plate. Throttle plate-less engines, which may be a diesel or gasoline based engines, are dramatically helped by the high velocity high volume discharge from nozzle 174. Thus, all types of internal combustion engines can have the liquid cleaning chemicals/chemical mixes applied evenly and effectively to the associated induction systems. These throttle plate-less engines, such as a diesel, will also need to have the engine rev as the chemical/chemical mixture is being applied. This additional RPM will help keep the chemicals suspended within the air column flowing into the engine. Additionally, the device that adds a throttle plate attachment to the throttle plate-less engine, as disclosed in the '606 A1 Pub., FIGS. 21-23, can be used with these air assist nozzles.

Figure 20:
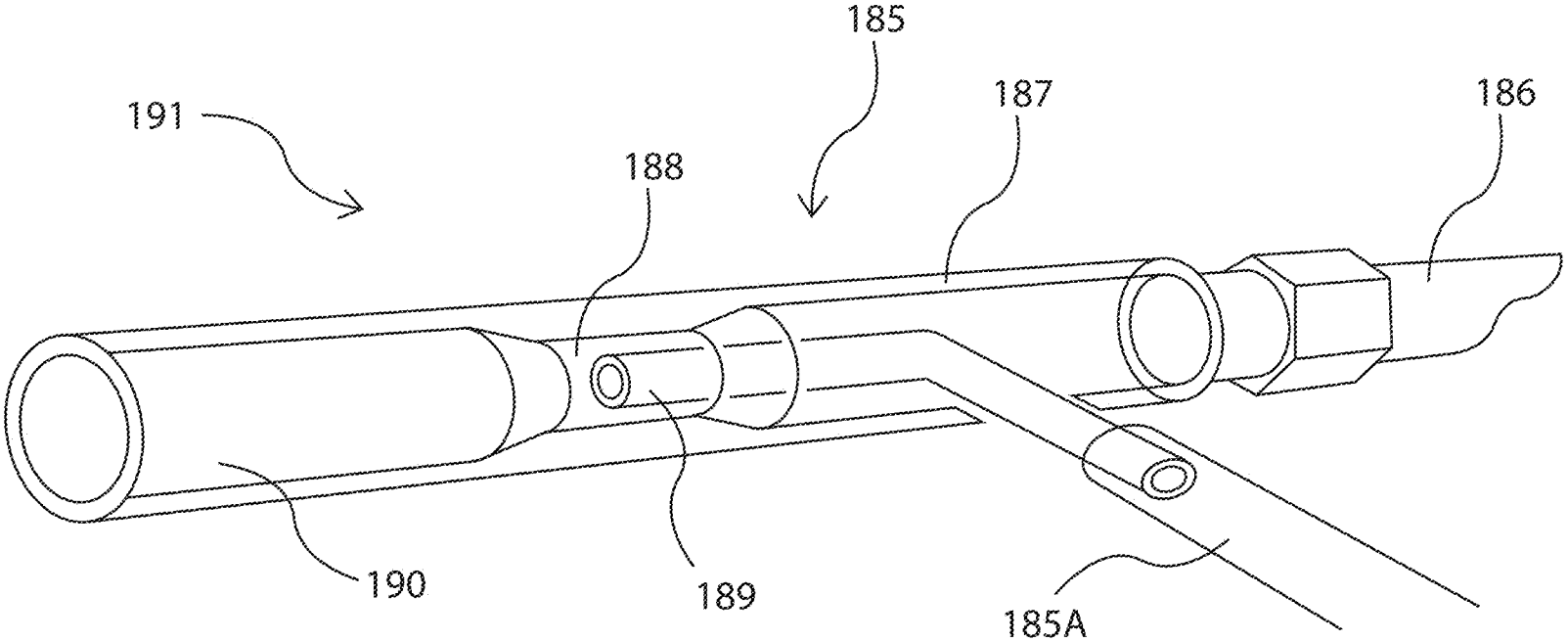
FIG. 20 illustrates other type of air assist nozzle for applying one or more chemicals to the induction system of the engine.

It will be important to understand the nozzle design can also be one such, as shown in FIG. 20. With nozzle 191, the liquid chemical/chemical mix is pulled up through tube 185A out of the chemical reservoir (not shown) by a pressure differential. This pressure differential is created by compressed air flow, or pressurized gas flow (e.g., $CO_2$), entering port 186 and moving down nozzle body 187. This compressed air flow, which has both high velocity and high volume, is accelerated in nozzle body 187 as it moves through Venturi 188. This sets up the Bernoulli principle, which is the Venturi Effect, which creates a low pressure area in Venturi 188. (The Venturi effect is the reduction in fluid pressure that results when a fluid flows through a constricted section (or choke) of a pipe thus creating a low pressure area.) This low pressure sucks the liquid chemical/chemical mix from the chemical reservoir (not shown) through tube 189 into Venturi 188, where it is then mixed with the compressed air in nozzle body 187 and then discharged out nozzle outlet 190. This accomplishes the same goal as nozzle 174 does, which is to keep the chemical moving out of the nozzle with a high droplet velocity rate and a high volumetric air flow rate.

The discharge rates from nozzles 174 and 185 are much higher than obtainable from a basic hydraulic nozzle (e.g., oil burn nozzle 150) in that the compressed air supplies the nozzle (174, 185) with a linear velocity where the volumetric flow rate from the compressed air accelerates the liquid chemical droplets. The droplets are then suspended within the high volumetric flow rate of the compressed air in the format of very fine liquid droplets. The discharge rate of these compressed air based discharge nozzles (174 and 185) is high when compared to the traditional oil burner nozzle, or a hydraulic nozzle, that has been used in the automotive carbon cleaning industry for decades. When using the hydraulic based nozzle the liquid volume can be increased which, in turn, can create a higher discharge rate. However the velocity from such a nozzle is only slightly increased. Further, with the traditional hydraulic nozzle the cleaning chemicals tend to fall out of the air flow moving through the engine. Additionally these traditional hydraulic nozzles do not work well when placed behind the throttle plate. Video inspection of the induction system in multiple engines clearly shows that the compressed air based or air assist nozzles of the present invention keeps more of the chemical/chemical mixture suspended as droplets in the air flow moving through the engine. Additionally, when the preferred pressurized gas air having 21% oxygen content is mixed with a cleaning formulation that can burn, this combination will provide the engine with a combustible mixture that will insure that the carbon that was removed during the cleaning process will be burned within the combustion chamber. Further, such combustible air/mixture can increase the RPM of the engine. Increasing the RPM helps keep the chemicals suspended in the air flow due to an increase of the engines volumetric pumping ability, which moves more air flow through the engine. Thus, the use of compressed air based nozzles, or air assist nozzles, for induction cleaning within the internal combustion engine has been determined to have multiple advantages. Whether the air assist nozzle is that of the type having the chemicals pressurized to the nozzle as with nozzle 174, or that of the type having a low pressure suck the chemical into the nozzle as with nozzle 185 the results are superior over prior art.

Figure 21:
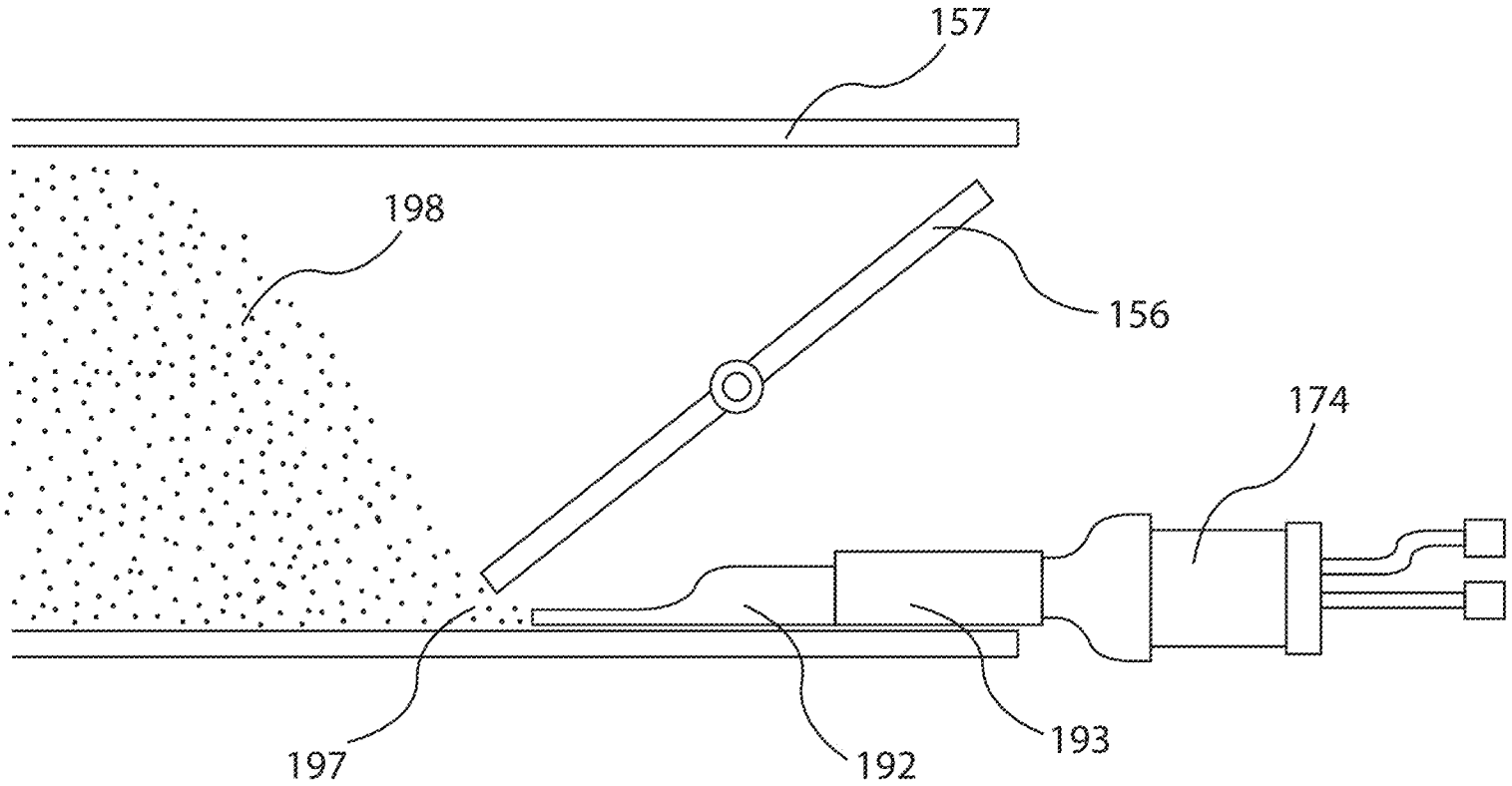
FIG. 21 illustrates the preferred nozzle tip where the nozzle is in front of the throttle plate.

When using nozzle 174 or nozzle 191 and there is not an induction port or opening located behind the throttle plate that could be used for induction cleaning, nozzle direction tip 192 can be used as shown in FIG. 21. Nozzle tip 192 connects to nozzle 174 (shown) or nozzle 185 (not shown) with hose 193 so that nozzle direction tip 192 directs the chemical mixture directly at opening 197 which is between throttle plate 156 and throttle body 157. When using this nozzle tip with a throttle stick the throttle is opened so that the RPM of the engine is increased to 2000-3000. By slightly opening the throttle plate to obtain this RPM the area between the throttle plate 156 and throttle body 157 and space 197 are enlarged. This larger area allows the mixture to be forced through space 197 with the necessary velocity and volume to produce droplets 198 and keep them in suspension. Since the chemical/chemical mixture is directed at opening 197 less chemical will impinge on throttle plate 156 and throttle body 157. This allows for more of the chemical or chemical mixture to stay suspended in the air moving into and through the induction system. This method can be used with the throttle at a steady state (throttle stick) or with the preferred opening and closing the throttle as discussed above. When used with opening and closing the throttle the RPM will be varied between 1200 and 3000.

Figure 22:
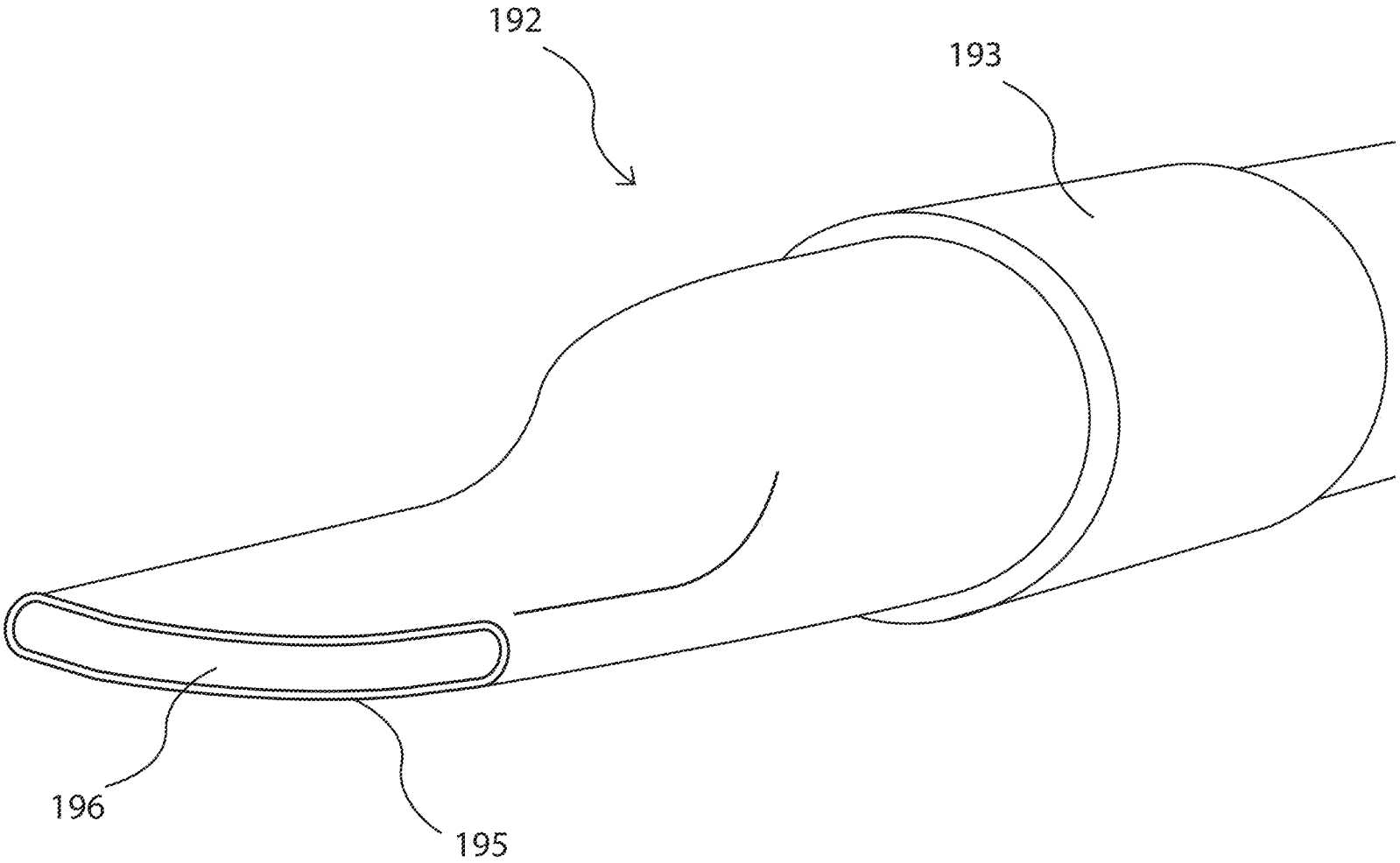
FIG. 22 illustrates the details of the nozzle tip of FIG. 21.

Nozzle tip 192, as shown in greater detail in FIG. 22, has a slight curve 195 at nozzle opening 196. This curve matches (or, at least, approximates) the throttle body curve so that the nozzle can lay against the throttle body housing closely. This also allows the shape of nozzle opening 196 to match (or, at least, approximate) the shape of opening 197, which allows the chemicals to be discharged directly at opening 197 and minimize impingement on throttle plate 156. When chemical or chemical mixtures are discharged by the air assist nozzle (174 or 191), the nozzle tip 192 directs the force that the air assist gives such chemical/mixture accelerating such chemical with velocity and volume. As previously discussed, this air flow will also permit the engine to rev without opening the throttle plate. This is helpful when there is not a service person that can open and close the throttle, in which case a throttle stick would be used. When the engine revs more air is pumped by the engine, which additional air flow helps keep the droplets suspended in the air moving through the engine. Regardless of the shape or type of the nozzle, what is important is to direct the chemical or chemical mixture directly at throttle opening 197.

Due to the inherent limitations of fuel based delivery, it is preferred to clean the induction system, combustion chambers and the exhaust system of an engine with a method and apparatus that delivers the chemical mixture into a centralized location of the induction system of the engine, preferably as disclosed above and in the '016 application. However, some of the chemicals of the present invention when mixed with a fuel base, such as standard consumer grades of gasoline, E-85 or diesel fuel, are effective in removing carbon, as shown in FIG. 23. With regard to this figure, carbon samples were taken from the induction port of a GM PI engine and treated with various gasoline-chemical mixtures as indicated in the left hand column (e.g., Gas 90% 2-EHN 10%). The gasoline used was regular Chevron gasoline (88 octane rating) at a 90% concentration, with the added chemical at a concentration at 10%. With regard to FIG. 24 five different carbon types were used to test various chemicals at a 2% concentration in a 98% concentration of regular Chevron gasoline (88 octane rating from the same pump as used in the testing on which FIG. 23 is based). For each series of tests (e.g., on the BMW GDI engine) all carbon was from the same engine with all other variables equal. Further, in order to provide a comparison between the chemical/chemical mixtures of the present invention that would be used in a fuel base and commercially available chemistries that are used in a fuel base, Gumout Expert fuel tank additive "Regane" was chosen to test as it contains PEAs which are extensively used in gasoline bases for maintaining valve cleanliness. (Additional testing of Gumout products is discussed below in connection with FIG. 5A.) As can be seen in FIGS. 23 and 24 we determined that the following chemicals worked well in gasoline to remove carbon deposits: 2-EHN; NP; ISN; TBP; DTBP; THN; DIP; OCT; DHN; DTAP; DTPB; and TBPB.

It is important to understand that all carbon removing chemicals and chemical mixtures used for induction cleaning, for spark ignition engines must work well with the gasoline that is being sprayed onto the intake port of a GPI engine, or combustion chamber of the engine of a GDI engine, so that the engine can run. When cleaning the induction system or combustion chambers of the engine, with apparatus disclosed in the '016 application, the gasoline will be at least partially mixed with the cleaning chemicals. Thus, whichever chemical/chemical mix are chosen to remove carbon deposits from the engine should work well with gasoline. Based on our testing we have determined that many of the chemicals we have identified for carbon removal work well with gasoline (e.g., OCT, EM, CH, PA, TBA, PB, BB, XYL, LHN, DIP, THN, DHN, TMP, DEC, and TAME.). Additionally some of these chemicals (e.g., 2-EHN, NP, ISN, TBP, DTBP, DTAP, and DTPB) have an added advantage that would provide better combustion characteristics as well When carbon removing chemicals are directly added to the fuel base (e.g., standard consumer grades of gasoline, diesel fuel) of the vehicle there could be two different methods used. One is where the fuel manufacture or fuel distributor pre-mixes the selected chemicals into the fuel base. The other method would be one where the individual adds the fuel additives directly to the vehicles fuel tank separately from the fuel. In either case the chemical/gas mixture would be delivered through the injectors and would clean carbon from anywhere the chemical mixture contacted.

FIG. 5A also illustrates Applicants' testing with regard to how well the commercially available "Fuel Tank" additives worked to remove carbon deposits. The carbon used is the same as used for the induction cleaning tests (i.e., all carbon is from the induction system of the same Audi turbocharged direct injection engine used for the induction cleaning tests illustrated in FIGS. 5A and 5B, with all variables for testing equal). These fuel tank additives were mixed to the manufacturer's recommendation for volumetric volumes of gasoline to additive. The problem with all fuel additives is that when they are mixed into the fuel stock for the engine they will become highly diluted, thus making them less effective to remove heavy carbon deposits in most cases. If the chemicals match the particular carbon type extremely well heavy carbon deposits can be removed. But with the diversity of carbon types across many different engines, and engine configurations, this ability to remove heavy carbon deposits is unlikely across the multiple carbon types. One advantage of a chemical mixture being supplied to the engine by the fuel delivery system is that it is supplied over a much longer period of time, which can be helpful. When the gasoline is delivered over the entire tank of fuel, there are times that the engine is running with the engine cold, which will not flash the gasoline base into a vapor. This liquid fuel base will help to remove carbon deposits where the chemicals are delivered. The problem here is the engine is not run with the temperature being cold for very long. The design of the modern cooling system accelerates the coolant warm up time for emission control of the tail pipe exhaust gases. However the more chemical mixture delivered over the long period of time, the more carbon can be removed, which can be quite helpful in removing carbon from anywhere the gasoline additive can be delivered.

Another problem with regard to fuel stocks such as standard consumer grades of gasoline, is that they are formulated to release thermal energy in the internal combustion engine and not to clean the heavier carbon deposits from such an engine. Such gasoline blends are designed to flash from a liquid to a vapor at the running temperature of the engine. In port injected engines the fuel injectors spray pattern is aimed at the intake valve which is the hottest part of the induction system. This means that the fuel tank additives are using a base that is turning into a vapor as soon as it hits the hot intake valve. In direct injected engines the injectors spray pattern is delivered directly into the hot combustion chamber which vaporizes the fuel. This means that the fuel tank additives are using a base that is turning into a vapor as soon as it hits the hot combustion chamber. As previously discussed, through our testing we have determined that a chemical mix in the form of a vapor is not ideal to remove heavy carbon deposits.

Gasoline can be effective in removing carbon deposits has seen in FIG. 24. Thus, the gasoline chemistry base can remove carbon deposits where it contacts such carbon deposits, such as directly around the intake valve pocket area on a GPI engine. However, no gasoline or chemical tank additive is delivered anywhere else within the induction system. This becomes a problem with heavy carbon build up that occurs within the induction system anywhere other than that carbon that is directly around the intake valve pocket area. Additionally, as discussed above, a liquid base provides a medium for the carbon to dissolve into and then be washed away. Thus, gasoline additives that are added to fuel tanks are primarily effective at keeping the carbon from forming on the intake valve and around the intake valve pocket area, and not to remove carbon throughout the induction system. Another problem for these fuel additives is that in direct injection engines (GDI and DDI) the fuel with the additive is sprayed directly into the hot cylinder. In this case the intake cannot be cleaned as the product is only in the combustion chamber and not in induction system.

It has been determined through testing that a chemical mixture that represents gasoline but mixed with higher boiling point chemicals, referred to as High Temperature Gasoline (HTG) and not to be confused with standard consumer grades of gasoline, will work well to remove carbon from the induction system of the engine. This HTG mix can be applied by the apparatus described above and as disclosed in the '016 application. The formula of some of Applicants' HTG based mixes, as well as the effectiveness of such mixes on previously described induction carbon (e.g., BMW GDI) is set forth in FIG. 25. In FIG. 25 there is also a chart that shows a basic blend guide to produce a high temperature gasoline. With an HTG mix the HTG gasoline does not vaporize at the engine running temperatures. Thus, this mix remains in a liquid droplet format and can remove certain types of carbon deposits well. In connection with the Audi GDI carbon (previously described) note that HTG 4 removed 93% compared to the 94% rate achieved with the 505A-505B mix. Anyone skilled in the art could make changes to the HTG mix and have similar results. Additionally, if Specific and or Reactive Solvents such as 2-EHN, TBP, DTBP, DTAP, TBPB, TBHP, NP, and IPN are added to the HTG mix the carbon removal rate can be increased, as well as an increased ability for the engine to run well during induction cleaning. These Specific and or Reactive Solvents have already been discussed and shown to work well in gasoline bases as shown in FIG. 23.

Continued testing of various chemicals has identified additional chemicals and chemical mixtures for the use of removing carbon deposits from the internal combustion engine. Some of these chemicals and chemical mixtures have proven to work better across many different carbon types than anything that we have previously tested. For a chemical to work well on one carbon type is not that unusual. However for a chemical to work well on many different carbon types is unusual.

One of the chemicals tested is really a chemical group, referred to herein as terpenes. Terpenes are a group of chemicals that work extremely well across many different carbon types produced within internal combustion engines. Some of these terpenes do not exhibit some of the problems that prior chemicals tested have shown, namely low carbon removal rates on just a few of the carbons types. This can be seen in FIG. 26, which shows a comparison with THN (which is one of the best chemicals that we have previously tested), the terpenes have a more consistent carbon removal yield rates across all the carbons types that were tested.

These yield rates from a single chemical are higher than most blends that have previously been tested. It may seem like just a 5% increase of carbon removal is a small amount. However we have determined through years of testing that 5% additional removed carbon is very hard to obtain.

These chemical terpenes are produced from plants. A known mixture of terpenes is known as turpentine (also called spirit of turpentine, oil of turpentine, wood turpentine and colloquially turps), which is a fluid obtained by the distillation of resin obtained from trees, mainly pines and firs. Terpenes have been identified and determined, through our research and testing, to be extremely effective at removing the carbon that is produced within internal combustion engines. Due to the price concerns with regard to some terpenes, we have determined which chemicals can be used in current economic conditions. It will be important to understand that other chemicals in the terpene family can also be used for the removal of carbon from the internal combustion engine (e.g. (+)-beta-pinene, longifolene). The terpenes that we considered to be economic at the time of this filing are; oil of turpentine (TPT), y-terpinene (y-T), p-cymene (p-C), terpinolene (TO), alpha-pinene (A-p), (−)-beta-pinene (b-p), camphene (ch), and 3-carene (3-c). Each of these chemicals can be used alone, as the base for one or more other chemicals (including other terpenes), or used to enhance other chemical mixtures (including, but not limited to, mixtures including other terpenes).

In the last few hundred years many uses have been found for turpentine. For instance, turpentine oil is used as medicine and can be applied to the skin for joint pain, muscle pain, nerve pain, and toothaches. Turpentine is a thin, volatile, essential oil, which is distilled from the resin of certain pine and other trees. It is used familiarly as a paint thinner and solvent, additionally it is used as furniture wax. With turpentine and terpenes being so readily available for so long, it was surprising to us that no one had previously made any connection that these chemicals would work at all to remove the multiple carbon types from the internal combustion engine, let alone remove the carbon as well as our testing has demonstrated. Perhaps this oversite comes from a belief that terpenes that are gentle enough to be used for medicine and paint thinner could not break down the complex carbon structures produced from hydrocarbons (e.g. gasoline, E85, and diesel) burning in the internal combustion engine. Terpenes have been proposed as alternate fuels for internal combustion engines [U.S. Pat. No. 4,759,860]; have been experimented with as a suspension aid for engine cleaning solutions, though it was concluded that terpenes were inadequate for this usage [U.S. Pat. No. 9,617,505]; and used as a blend with dibasic esters for cleaning asphaltene deposits [U.S. Pat. No. 8,628,626]. Yet, nowhere to our knowledge, is there any teaching or suggestion that the turpenes themselves are superior cleaning agents for removing carbon deposits from internal combustion engines. Turpentine, terpenes, and the chemicals that are derived from tree resins have been determined through our testing to work better than any other chemical tested so far for the removal of carbon from the internal combustion engine. These terpenes and turpene mixtures remove carbon from the engine and can be applied directly into the induction system, combustion chamber, or exhaust system of the internal combustion engine. Additionally they can be used as an additive which is added to the fuel (e.g. gasoline, E85, diesel), either by a manufacture of the fuel, or that which is poured directly in to the fuel system of the vehicle.

Additionally, we have determined through our testing, other terpenes which work well across many different carbon types. These terpenes are limonenes, namely; R-(+)-limonene and S-(−)-limonene. When these two limonenes are mixed together DL-limonene (also called dipentene (DIP)) is produced, which has been previously discussed above.

Other chemicals that we have determined through are testing to work well across many different carbon types that are produced in the internal combustion engine are identified in FIG. 27, together with the percentage of carbon removed. These chemicals are, dodecane (DOD), n-Heptane (HEP), n-nonane (n-n), cumene (CUM) and hexadecane (HD) also known as cetane. All have shown that they work well across various carbon types that are produced within the internal combustion engine.

When these chemicals are carefully chosen and correctly mixed together a preferred chemical mixture is produced. This preferred mixture, shown in FIG. 27, is made up of; 30% turpentine (TPT), 30% dodecane (DOD), 15% y-terpinene (y-T), 15% p-cymene (p-C), and 10% tert-butyl peracetate (TBP). This chemical mixture which is made up of Non-Specific Solvents and Specific/Reactive Solvent produces a more consistent carbon removal yield rate across all the carbons types that have been tested. Any of the chemicals disclosed in this application can be used within the chemical mixture to remove carbon deposits from the internal combustion engine.

Additional testing with turpentine and terpenes, hereafter referred to as "terpenes", has shown that these chemicals can breakdown carbon which has been deposited within the engine's oil base. Such carbon deposits form in the motor oil from heat, pressure, and namely combustion gases that have leaked pasted the piston rings. This combustion gas leakage is referred to as blow-by gases. Motor oils have detergents within them to control such carbon deposits. The blow-by gases are initially broken down by the detergents (e.g. magnesium sulfonates) that are put into the motor oil by the petroleum companies, oil blenders, and or manufactures. Additionally detergents can be based in a pour-in format, this is where a service person may install additional products to the engine motor oil. However whether these detergents are poured in or added by the motor oil manufacture over time carbon deposits may still form within the internal combustion engine.

Motor oil, engine oil, or engine lubricants are any of various substances comprising base oils enhanced with additives, particularly anti-wear additives, detergents, dispersants, and for multi-grade oils viscosity modifiers. These oils are used for the lubrication of the internal combustion engine. The internal combustion engine has small clearances for oil to minimize the friction and allow smooth movement of engine components. New engines have much tighter component clearances such as bearing ranges from 0.0005"-0.0015". The closer the tolerance is to the 0.0005" mark, the more the oil base will be required to be thinner with good lubricity. The engine bearings will need to be protected by the motor oil because the load put on the engine bearings is quite high. Most gasoline engine bearings will withstand forces of 6,000-8,000 PSI as normal bearing load. Diesel engines typically have 8500-10,000 PSI on their bearings. Additionally forced air induction, such as turbocharging and or supercharging, will add additional load and heat that the motor oil will have to support as well. It will be very important that any additive put in the motor oil will not detract from the main goal of the oil composition, to protect the engine components.

The detergents and dispersants are used to help keep the engine clean by minimizing sludge buildup. Sludge is where the combustion by-products that have entered the oil base saturate this oil base, thus forming a thick carbon rich substance. This sludge is not wanted within the engine. Sludge and or carbon deposits in the motor oil cause problems such as; sticking piston rings, sticking lifters, sticking camshaft phasers, sticking oil control valves, sticking timing chain tensioner, restricted oil screens (e.g. oil pump pick up) and this is just to name a few of the problems. Terpenes have been found through testing to remove these deposits. Additionally these terpenes can be used to remove similar types of deposits in other systems such as but not limited to; transmission fluid, gear oil, power steering fluid, and differential fluid. The terpenes and terpene mixes have be determined to remove deposits and varnishes from such systems.

The modern engine uses low tension piston rings to limit the parasitic fiction loss. Therefore these low tension rings are prone to sticking. As previously discussed some of carbon deposit with in the induction system are produced from the PCV system. Piston ring sealing issues such as sticking rings allow additional pressure into the crankcase. This additional crankcase pressure will carry motor oil out of the engine and into the induction system through the PCV system. This added motor oil within the induction system will help add to the carbon deposit buildup within the induction system, combustion chamber, and exhaust system. When cleaning the carbon deposits from the induction system, as discussed in depth above, it will be necessary to also clean the piston ring area to limit crankcase pressure as well as oil consumed by the engine. This will be accomplished by adding terpenes or terpene mixes into the motor oil and then running the engine. This will allow for less future carbon accumulation within the induction system, combustion chambers, and exhaust system.

Turpentine is a thin, volatile, essential oil, which is distilled from the resin of certain pine and other trees. Since turpentine is an oil based product it can be put in to the motor oil without harming the engine. Through testing as seen in FIG. 28, it has been determined that Oil of Turpentine (TPT), gamma terpinene (y-T), Para cymene (p-C), dodecane (DOD), 2,2,4-trimethylpentane (TMP), and tetrahydronaphthalene (THN) can be put directly into the engine oil base without causing a harmful viscosity change. Additionally as seen in FIG. 29 these terpenes and mixes will not cause additional wear of engine components. Thus these chemicals have been proven not to be harmful to the internal combustion engine.

Since turpentine and terpenes have clearly been proven to remove heavy carbon deposits from the induction system, combustion chambers and exhaust system, it was thought that it would work well to break down the carbon deposits within the engine lubricating system. Through testing it has been determined that terpenes work extremely well at breaking down these carbonaceous oil deposits. Terpenes can directly breakdown oil sludge and or carbon deposit so that they are suspended within the motor oil fluid base. These carbon deposits are then caught within the motor oil filter. It is preferred once the terpenes and or mixes have been added to the engines motor oil, and the engine has been run for a period of 20 minutes that the oil base from the engine be changed with the engine oil filter. However it has been determined through testing that the terpenes can be run at length in the engines motor oil.

Terpenes, terpene mixes, THN, and or THN mixes can free piston rings so that the ring can seal properly. With proper combustion chamber sealing the blow-by will decrease thus lowering the amount of motor oil carried into the induction system. Additionally the oil consumed by the engine will drop considerably. Camshaft lifters, camshaft phasers, hydraulic control valves, just to name a few, can be cleaned so that they no long create problems. These terpenes have been found through testing, to work well to remove carbon deposits and sludge deposit from the lubricated internal combustion engine components, while not creating any lubricating problems for the engine. These terpenes, terpene mixes, and mixes could be added to the motor oil base with a pour in, or be added to the motor oil by the petroleum companies, oil blenders, and or manufactures.

It will be important to understand that the carbon that was harvested from the engines for testing was taken from many different engines over several years. In each testing run the carbon for that particular test sequence is always from the same engines induction system. However, for example, the BWM carbon used for the test in FIG. 6 is not from the same engines induction system as in FIG. 25. Additionally, the engines used over the years to harvest carbon may be of the same configuration of engine, or may be a different configuration of engine produced from the same manufacture. For example some of the BMW GDI carbon was taken from 8 cylinder engines and some was taken from inline 6 cylinder engines. These various BMW engines (as well as all engines) can have different carbon types where one is easier to chemically remove, where yet another may be more difficult to chemically remove. Furthermore the carbon deposit samples and chemical/chemical mixtures used to best represent the invention in this application are but a small example compared to the total numbers actually used in testing to select the most effective chemicals, and develop the mixtures of the present invention.

It is also apparent that the mixtures of the present invention may include chemical stabilizers whose primary purpose is to add to the shelf life by reducing the rate of decomposition of the free radical generating chemicals that may be in the mixture. Examples of such stabilizers may be found in U.S. Pat. No. 6,893,584 (also published as WO2004096762) and U.S. Pat. No. 6,992,225.

Whereas the illustrations, charts, and accompanying description have shown and described the preferred embodiments of the present invention, it should be apparent to those skilled in the art that various changes may be made in the forms and uses of the inventions without affecting the scope thereof.

We claim:

1. A method of removing carbon deposits from an internal combustion engine; an internal combustion engine including an induction system, at least one combustion chamber, and an exhaust system; the method including the steps of:

continuously running the engine;

supplying compressed gas to a nozzle from a source of compressed gas, the nozzle including a discharge opening;

supplying chemistry to the nozzle from a source of chemistry at a volumetric flow rate out of the discharge opening greater than 3 gallons per hour;

using the compressed gas flowing through the nozzle to mix with the chemistry in the nozzle to form liquid chemistry droplets and to propel the gas and liquid chemistry droplets out the discharge opening; and directing the liquid chemical droplets propelled by the gas flowing through the discharge opening into the engine's induction system for the purpose of removing carbon deposits.

2. The method as set forth in claim 1, wherein the induction system includes a throttle plate and an opening for connecting the nozzle to the induction system behind the throttle plate whereby, once the nozzle is attached to the induction system through such opening, the step of directing the liquid chemistry droplets into the engine's induction system includes propelling the gas and the liquid chemistry droplets directly into the induction system behind the throttle plate.

3. The method as set forth in claim 2, wherein the step of directing the liquid chemistry droplets propelled by the gas flowing out the discharge opening into the engine's induction system includes the step of attaching the nozzle to the opening in the induction system and sealing the nozzle to the opening so during an induction cleaning the engine will not run poorly and/or stall.

4. The method as set forth in claim 1, further including an electrical means for starting and stopping the supply of gas and the supply of chemistry to the nozzle in order to control the flow rate of liquid chemistry droplets propelled out of the discharge opening and into the induction system while the engine is still running.

5. The method as set forth in claim 4, further including a means for turning off the electrical means for a predetermined period of time to allow for the liquid chemistry droplets to soak and interact with carbon deposits within the engine.

6. The method as set forth in claim 4, wherein the exhaust system includes one or more components, further including a means for turning off the electrical means for a predetermined period of time to allow for the one or more components time to cool.

7. The method as set forth in claim 4, wherein the means for starting and stopping is turned on and off to control the flow rate of liquid chemistry droplets from the discharge opening so that the volume rate of greater than 3 gallons per hour from the nozzle is not continuously applied to the engine, which volume rate, if continuous, would cause the engine to run poorly and/or stall.

8. The method as set forth in claim 1, wherein the source of compressed gas is compressed air.

9. The method as set forth in claim 1, the engine includes a control system including sensors, and further including the step of not removing or disconnecting any of the sensors from the engine's control system whereby no Diagnostic Trouble Code will be set.

10. A method of removing carbon deposits from an internal combustion engine; an internal combustion engine including an induction system, throttle plate, at least one combustion chamber, and exhaust system; the method including the steps of:

continuously running the engine;

connecting a nozzle to an opening into the induction system behind the throttle plate, the nozzle including a discharge opening;

supplying compressed gas to the nozzle from a source of compressed gas;

supplying chemistry to the nozzle from a source of chemistry at a volumetric flow rate out of the discharge opening greater than 3 gallons per hour; and using the compressed gas flowing through the nozzle to propel the gas and chemistry mixture in the form of liquid chemistry droplets out the nozzle opening; and directing the liquid chemistry droplets flowing through the discharge opening into the engine's induction system for the purpose of removing carbon deposits.

11. The method as set forth in claim 10, further including an electrical means for starting and stopping the flow of gas and the liquid chemistry droplets out of the nozzle discharge opening in order to control the flow rate of droplets into the induction system while the engine is still running.

* * * * *